US006778787B2

(12) United States Patent
Kinoshita et al.

(10) Patent No.: US 6,778,787 B2
(45) Date of Patent: Aug. 17, 2004

(54) IMAGE FORMING APPARATUS WITH CONTROL TO DIVERT SHEET TO USABLE PATH

(75) Inventors: Hidehiko Kinoshita, Chiba (JP); Manabu Yamauchi, Chiba (JP); Shigeo Aoyagi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/392,889

(22) Filed: Mar. 21, 2003

(65) Prior Publication Data

US 2003/0190179 A1 Oct. 9, 2003

(30) Foreign Application Priority Data

Apr. 5, 2002 (JP) ..... 2002-103937
May 13, 2002 (JP) ..... 2002-137090

(51) Int. Cl.[7] ..... G03G 15/00

(52) U.S. Cl. ..... 399/21; 399/16; 399/18; 399/388; 399/401

(58) Field of Search ..... 399/21, 397, 401, 399/364, 369, 388, 16, 18, 381

(56) References Cited

U.S. PATENT DOCUMENTS 4,573,789 A 3/1986 Wada ..... 355/14 SH
5,393,043 A * 2/1995 Nitta ..... 271/9.06
5,532,793 A * 7/1996 Kogure ..... 399/19
5,727,784 A * 3/1998 Sagawa ..... 271/265.01
6,317,581 B1 * 11/2001 Boehmer et al. ..... 399/401
6,330,422 B1 12/2001 Sato et al. ..... 399/382
6,549,748 B2 * 4/2003 Miura ..... 399/401
6,556,794 B2 * 4/2003 Miura ..... 399/18
6,615,018 B2 * 9/2003 Funato ..... 399/322
6,647,243 B2 * 11/2003 Sato et al. ..... 399/407

FOREIGN PATENT DOCUMENTS

JP 58-182655 10/1983
JP 06-035265 2/1994

* cited by examiner

*Primary Examiner*—Andrew H. Hirshfeld
*Assistant Examiner*—Dave A. Ghatt
(74) *Attorney, Agent, or Firm*—Fitzpatrick, Cella, Harper & Scinto

(57) ABSTRACT

A first reversing inlet path and a second reversing inlet path are branched from a path for transporting a sheet having an image formed thereon by a printer unit. A first reversing path and a second reversing path are connected respectively to the first reversing inlet path and the second reversing inlet path. The sheet having the image formed thereon by the printer unit is transported through the first reversing inlet path or the second reversing inlet path for reversing the sheet. When one of the first reversing inlet path and the second reversing inlet path is unusable, the sheet reversing operation is continued using the other reversing inlet path.

23 Claims, 38 Drawing Sheets

| FIG. 22A | FIG. 22B |
|---|---|

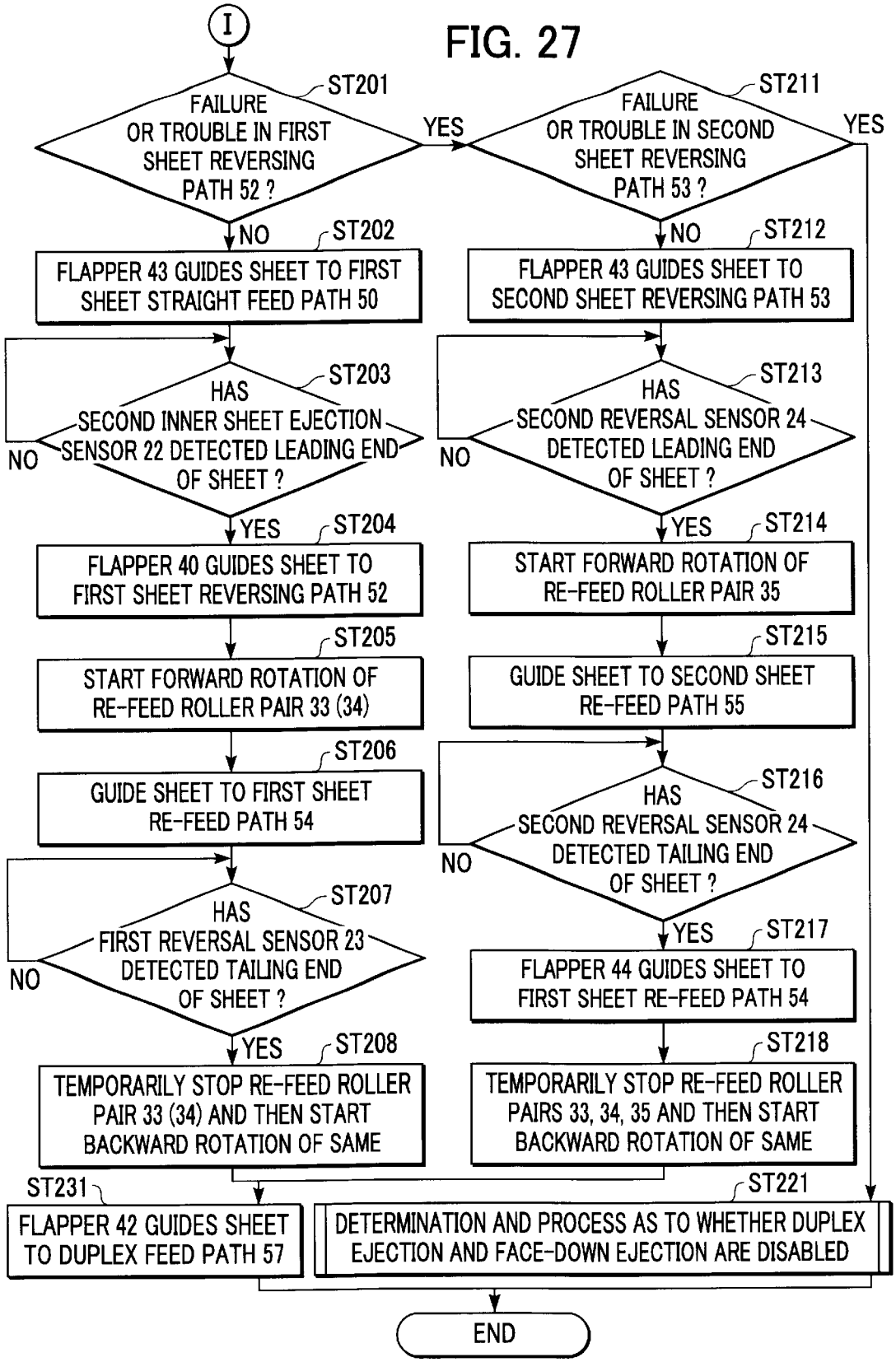
FIG. 27
I
ST201
FAILURE OR TROUBLE IN FIRST SHEET REVERSING PATH 52 ?
YES
NO
ST211
FAILURE OR TROUBLE IN SECOND SHEET REVERSING PATH 53 ?
YES
NO
ST202
FLAPPER 43 GUIDES SHEET TO FIRST SHEET STRAIGHT FEED PATH 50
ST212
FLAPPER 43 GUIDES SHEET TO SECOND SHEET REVERSING PATH 53
ST203
HAS SECOND INNER SHEET EJECTION SENSOR 22 DETECTED LEADING END OF SHEET ?
NO
YES
ST213
HAS SECOND REVERSAL SENSOR 24 DETECTED LEADING END OF SHEET ?
NO
YES
ST204
FLAPPER 40 GUIDES SHEET TO FIRST SHEET REVERSING PATH 52
ST214
START FORWARD ROTATION OF RE-FEED ROLLER PAIR 35
ST205
START FORWARD ROTATION OF RE-FEED ROLLER PAIR 33 (34)
ST215
GUIDE SHEET TO SECOND SHEET RE-FEED PATH 55
ST206
GUIDE SHEET TO FIRST SHEET RE-FEED PATH 54
ST216
HAS SECOND REVERSAL SENSOR 24 DETECTED TAILING END OF SHEET ?
NO
YES
ST207
HAS FIRST REVERSAL SENSOR 23 DETECTED TAILING END OF SHEET ?
NO
YES
ST217
FLAPPER 44 GUIDES SHEET TO FIRST SHEET RE-FEED PATH 54
ST208
TEMPORARILY STOP RE-FEED ROLLER PAIR 33 (34) AND THEN START BACKWARD ROTATION OF SAME
ST218
TEMPORARILY STOP RE-FEED ROLLER PAIRS 33, 34, 35 AND THEN START BACKWARD ROTATION OF SAME
ST231
FLAPPER 42 GUIDES SHEET TO DUPLEX FEED PATH 57
ST221
DETERMINATION AND PROCESS AS TO WHETHER DUPLEX EJECTION AND FACE-DOWN EJECTION ARE DISABLED
END

| FIG. 28A1 |
| --- |
| FIG. 28A2 |

FIG. 28A1

FIG. 28A2
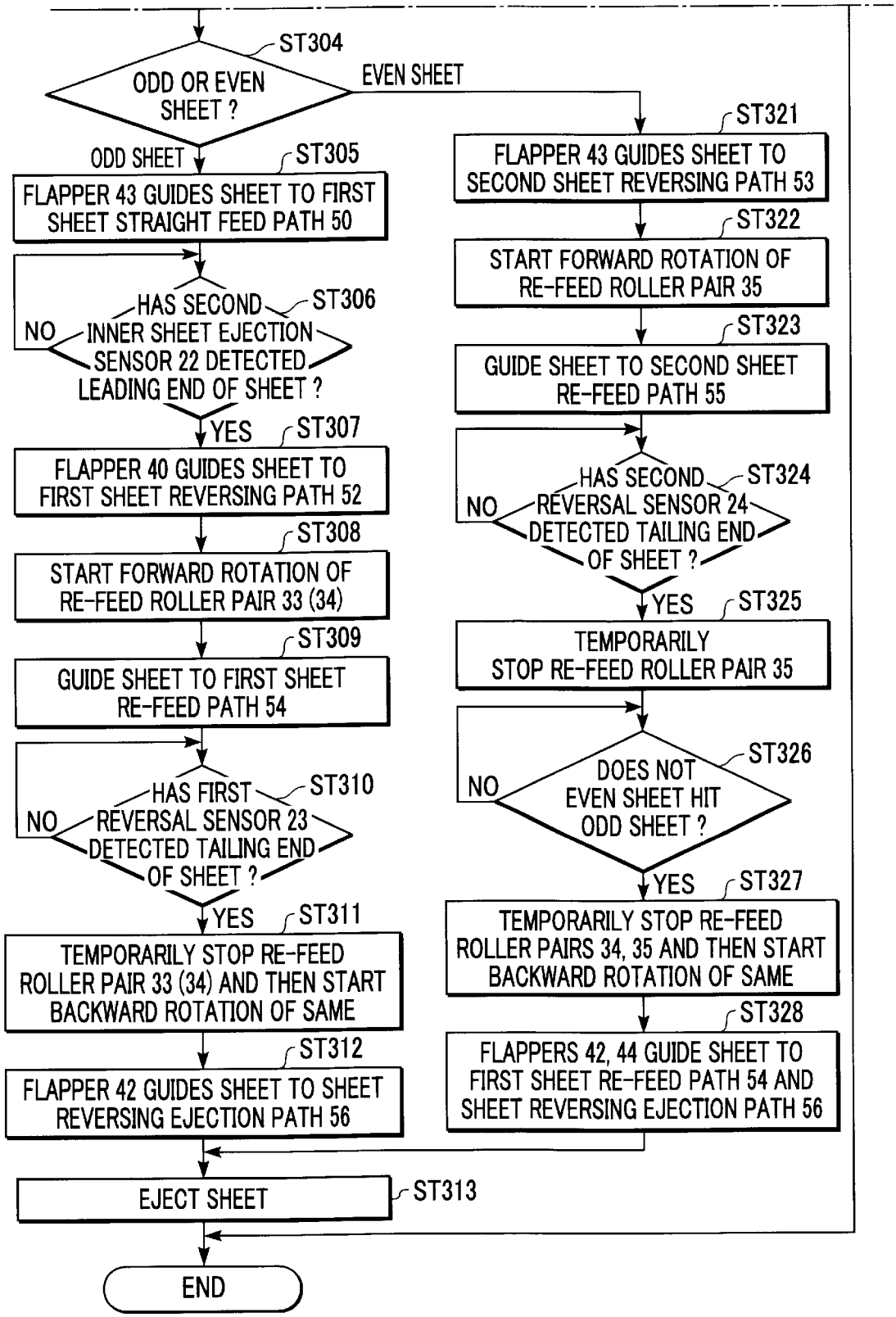

IMAGE FORMING APPARATUS WITH CONTROL TO DIVERT SHEET TO USABLE PATH

BACKGROUND OF THE INVENTION

1. Field of the Invention

The present invention relates to an image forming apparatus that functions to form images on both sides of a sheet.

2. Description of the Related Art

Hitherto, in some image forming apparatuses such as copying machines and page printers, after reversing a sheet having an image formed on one (front) side, the sheet is transported again to an image forming section to form an image on the other (rear) side of the sheet. Such an image forming apparatus includes a duplex (double-sided) feed mechanism for reversing a sheet having an image formed on one side, and then transporting the sheet again to the image forming section.

There is also known an image forming apparatus provided with a mechanism for reversing each sheet from a face-up to a face-down state before ejection so that sheets having images formed thereon are ejected in proper page order.

Then, a demand for increasing the efficiency in operation of those duplex feed mechanism and reversing mechanisms has arisen.

For example, a duplex feed mechanism disclosed in Japanese Patent Laid-Open No. 58-182655 includes a duplex copying aid means that comprises a sheet ejection section, a switching gate, a switchback section, a return section, and a reversing section. When copying an image on the rear side of a sheet on the front side of which an image has been copied, the duplex copying aid means increases a copy return speed so that the sheet having finished copying of an image on the front side more quickly reaches a predetermined return position from which copying of an image on the rear side can start. As a result, efficiency of duplex copying can be increased.

In the conventional image forming apparatus including the duplex feed mechanism to increase the speed in transporting a sheet, on one side of which an image has been printed, to a reversing unit as disclosed in Japanese Patent Laid-Open No. 58-182655, a great improvement in processing speed cannot be expected even though a slight increase in speed of the duplex image formation is expected.

Also, in an apparatus provided with a plurality of sheet reversing routes as disclosed in Japanese Patent Laid-Open No. 6-35265, the overall size of the apparatus is enlarged, the cost is increased, and the apparatus is not satisfactorily convenient for users.

Meanwhile, speedups in operation of image forming apparatuses have increased the output volume in recent years. Correspondingly, a problem has occurred with an increase of the time during which the image forming apparatus cannot be temporarily used, i.e., the so-called "downtime", and how to reduce the downtime has become a very important issue to be overcome. The downtime is increased because of a part failure, a sheet jam, and other troubles.

SUMMARY OF THE INVENTION

In view of the state of the art set forth above, it is an object of the present invention to provide an image forming apparatus capable of forming images on both sides of a sheet at high speed, and with reduced downtime.

To achieve the above object, the present invention provides an image forming apparatus comprising an image forming section; a plurality of reversing units each for reversing a sheet having an image formed thereon by the image forming section; and a control unit for controlling the plurality of reversing units so that when one of the plurality of reversing units is unusable, a sheet feed operation continues using reversing units which are usable.

Also, the present invention provides an image forming apparatus comprising a reversing feed path for reversing a sheet; a re-feed path for re-feeding the sheet having been reversed in the reversing feed path to the image forming section; a reversing inlet feed path for transporting, to the reversing feed path, a sheet having an image formed on one side by the image forming section; a plurality of reversing outlet feed paths branched from the reversing feed path at plural points and for transporting, to the re-feed path, the sheets having been transported to the reversing feed path; and a control unit for controlling the plurality of reversing outlet feed paths so that when one of the plurality of reversing outlet feed paths is unusable, a sheet feed operation continues by using reversing outlet feed paths which are usable.

Further, the present invention provides an image forming apparatus comprising a reversing feed path for reversing a sheet; a re-feed path for re-feeding the sheet having been reversed in the reversing feed path to an image forming section; a plurality of reversing inlet feed paths joining with the reversing feed path at plural points and transporting, to the reversing feed path, sheets each having an image formed on one side by the image forming section; a plurality of reversing outlet feed paths branched from the reversing feed path at plural points and for transporting, to the re-feed path, the sheets having been transported to the reversing feed path; and a control unit for controlling the plurality of reversing inlet feed paths so that when one of the plurality of reversing inlet feed paths is unusable, a sheet feed operation continues by using reversing inlet feed paths which are usable.

Still further, the present invention provides an image forming apparatus comprising a main feed unit for feeding a sheet having an image formed thereon by an image forming section; a first sheet switchback transport unit and a second sheet switchback transport unit arranged side by side, for transporting the sheet fed from the main feed unit to a downstream side when rotated forward, and then for transporting the sheet backward to an upstream side when rotated backward; a sheet switchback transport path selecting unit for selectively advancing the sheet fed from the main feed unit to the first sheet switchback transport unit and the second sheet switchback transport unit; a failure detecting unit for detecting a failure in operation of at least one of the first sheet switchback transport unit and the second sheet switchback transport unit; and a control unit for controlling the first sheet switchback transport means and the second sheet switchback transport means so that when information indicating a failure in operation of one of the first sheet switchback transport unit and the second sheet switchback transport unit is recognized based on information from the failure detecting unit, operation of the non-failed sheet switchback transport unit continues.

Further objects, features and advantages of the present invention will become apparent from the following description of the preferred embodiments with reference to the attached drawings.

BRIEF DESCRIPTION OF THE DRAWINGS

FIG. 27 is a flowchart, continued from FIG. 26, showing the duplex copying mode in the image forming apparatus of FIG. 24.

DESCRIPTION OF THE PREFERRED EMBODIMENTS

Preferred embodiments of the present invention will be described below with reference to the drawings.

First Embodiment

Figure 1:
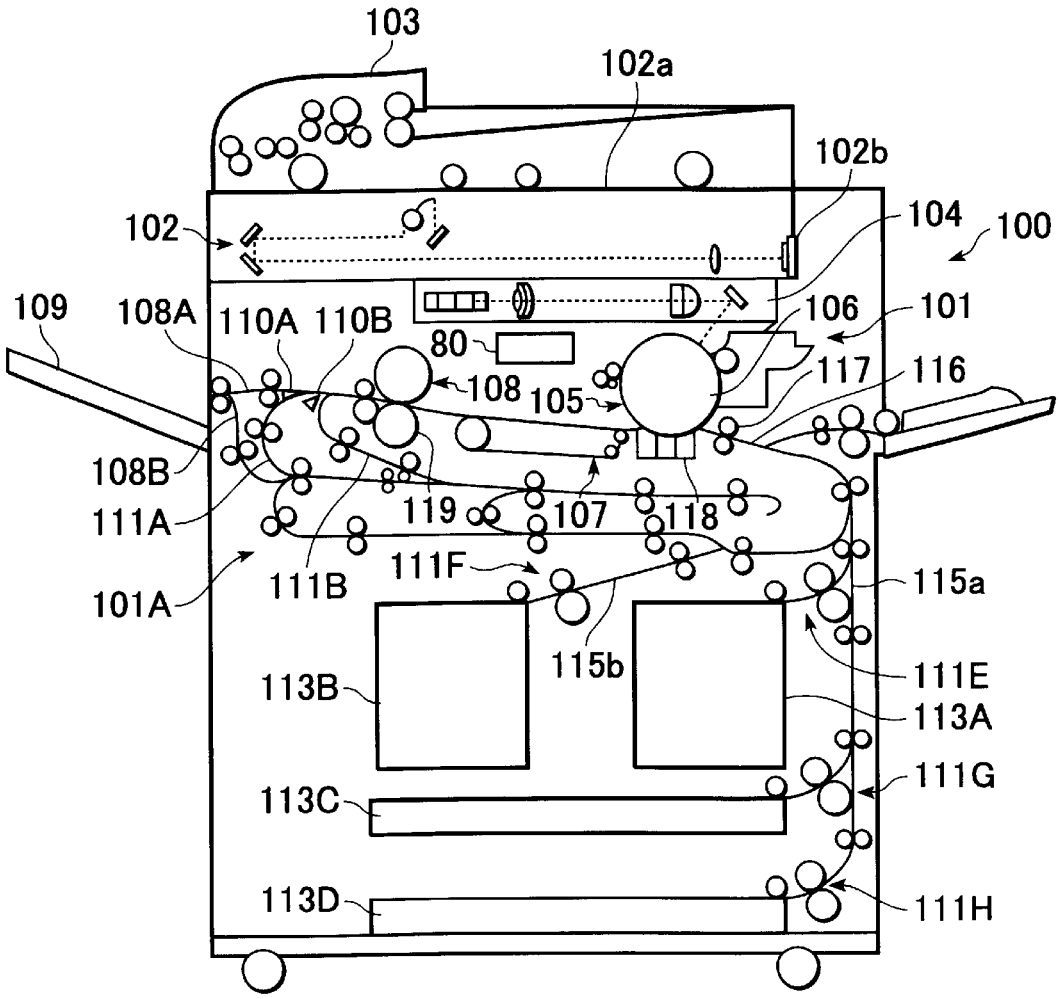
FIG. 1 is a schematic overall view of a copying machine as one example of an image forming apparatus according to a first embodiment of the present invention.

FIG. 1 is a schematic overall view of a copying machine as one example of an image forming apparatus according to a first embodiment of the present invention. Note that the image forming apparatus embodying the present invention is not limited to a copying machine, but it may be embodied as a facsimile machine, a printer, a composite machine, etc. Further, a sheet as used herein is not only a piece of plain paper, but may also be a thin resin sheet, a postcard, a piece of cardboard, an envelop, a plastic thin sheet, etc. which are used instead of plain paper.

Referring to FIG. 1, a copying machine 100 comprises a printer unit 101 including an image forming section 105, and an image reader 102. Also, the copying machine 100 includes an automatic document feeder 103 provided above the image reader 102. The automatic document feeder 103 automatically feeds documents (not shown) set thereon one by one onto a platen glass 102*a* at the top of the image reader 102. The document is scanned by the image reader 102, and digital information from a CCD camera 102*b* is stored as latent image data in a memory (not shown).

Further, in the copying machine 100, a latent image is formed on a photoconductive drum 106 of the image forming section 105 using a scanner 104 in accordance with the stored latent image data. The latent image is then developed with a toner, whereby a toner image is formed on the photoconductive drum 106.

Sheet supply cassettes 113A, 113B, 113C and 113D are disposed below the image forming section 105 of the printer unit 101 to serve as sheet containers each containing a number of sheets. Sheets contained in the sheet supply cassettes 113A, 113B, 113C and 113D are supplied one by one respectively by sheet supply units 111E, 111F, 111G and 111H, and are transported to an in-register introducing section 116 at predetermined timing through a feed path 115*a* or 115*b* serving as a part of sheet feed paths.

A register roller pair 117 is provided in the in-register introducing section 116. Skewing of each sheet is corrected by the register roller pair 117, and thereafter the sheet is transported to a transfer/separation charger 118 at a predetermined timing. The transfer/separation charger 118 transfers the toner image onto the sheet from the photoconductive drum 106.

Further, a sheet feed section 107 transports the sheet, onto which the toner image has been transferred, to a fusing section 108. The toner image on the sheet having been transported through the sheet feed section 107 is fused by a fusing roller pair 119 of the fusing section 108. After the toner image has been fused, the sheet is selectively advanced to a sheet ejection tray 109, a first reversing inlet path 111A or a second reversing inlet path 111B by sheet ejection flappers 110A, 110B provided in a (first) sheet ejection path 108A.

The sheet ejection flappers 110A, 110B are controlled by a controller 80 (described later) such that they are switched over for transporting a sheet to the sheet ejection tray 109 in the one-sided copying mode in which an image is formed on only one side of a sheet, and to the duplex feed mechanism 101A in the duplex copying mode in which images are formed on both sides of a sheet or in the multi-copying mode in which images are formed on one side of a sheet plural times.

Figure 2:
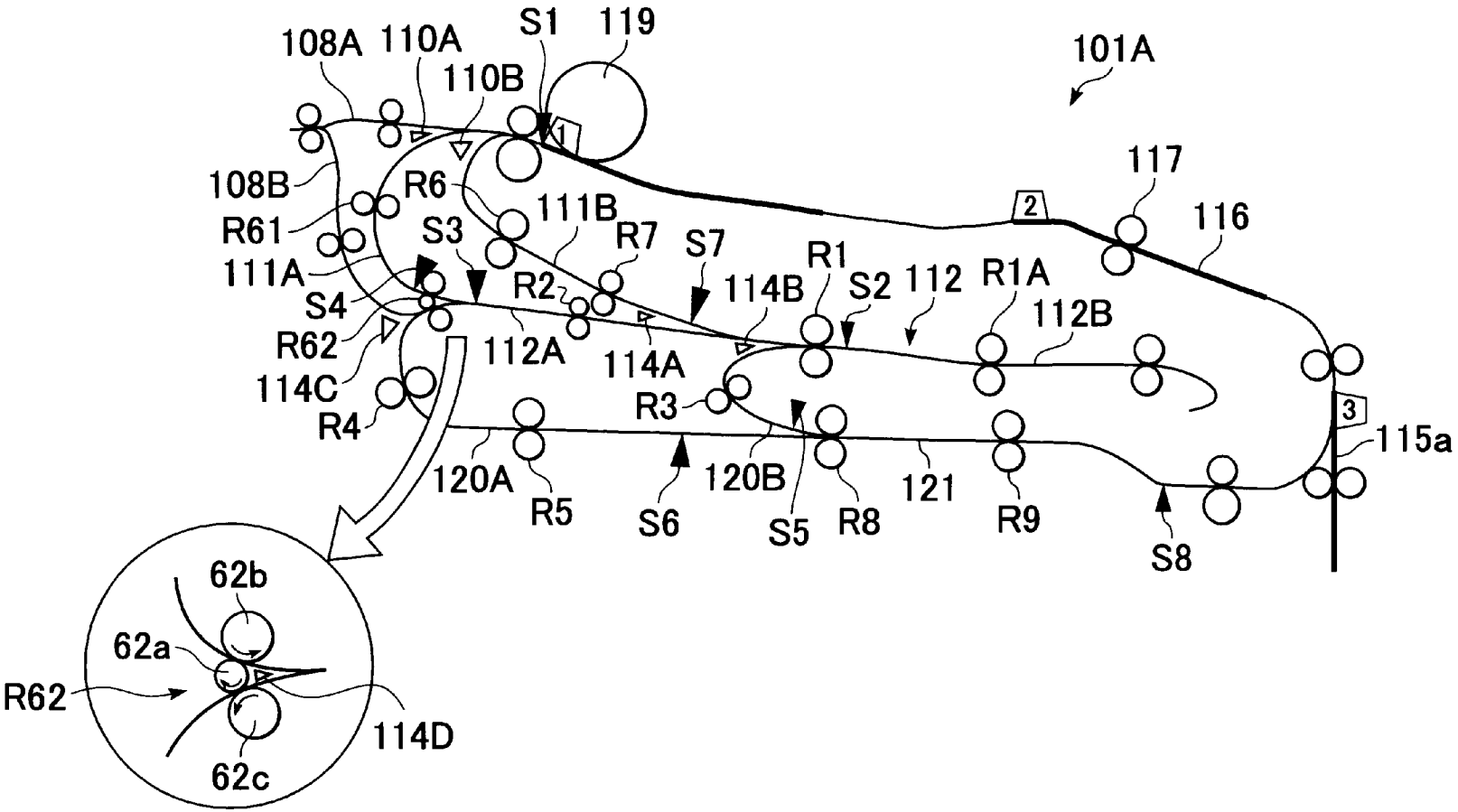
FIG. 2 illustrates a construction of a duplex feed mechanism in the copying machine.

FIG. 2 illustrates construction of the duplex feed mechanism 101A for reversing a sheet having an image formed on one side and transporting the reversed sheet again to the image forming section 105 in the duplex copying mode, for example. As shown in FIG. 2, the duplex feed mechanism 101A comprises the first reversing inlet path 111A which is branched from the sheet ejection path 108A and includes a roller pair R61 and a roller unit R62, the second reversing inlet path 111B which is branched from the sheet ejection path 108A and includes roller pairs R6, R7, and a duplex feed path 121, i.e., a re-feed path, including re-feed roller pairs R8, R9 for feeding a reversed sheet again to the image forming section 105.

The duplex feed mechanism 101A also comprises a reversing path 112 in which the first reversing inlet path 111A and the second reversing inlet path 111B merge with each other, and which reverses sheets having been transported from the first reversing inlet path 111A and the second reversing inlet path 111B, the reversing path 112 comprising a first reversing path 112A provided with a roller pair R2 and a second reversing inlet path 112B provided with roller pairs R1, R1A. Further, the duplex feed mechanism 101A comprises a first reversing outlet path 120A which is branched from the reversing path 112 and includes roller pairs R4, R5 for transporting a sheet to the duplex feed path 121, and a second reversing outlet path 120B which is branched from the reversing path 112 and includes a roller pair R3 for transporting a sheet to the duplex feed path 121. A set of the first reversing path 112A and the first reversing outlet path 120A and a set of the second reversing path 112B and the second reversing outlet path 120B constitute each reversing means in the present invention. In addition, the duplex feed mechanism 101A comprises a first flapper 114A and a second flapper 114B for selectively introducing a sheet from the second reversing path 112B to the second reversing outlet path 120B, and a third flapper 114C and a fourth flapper 114D for selectively introducing a sheet from the first reversing path 112A to the first reversing outlet path 120A or a (second) sheet reversing ejection path 108B.

The first reversing inlet path 111A and the second reversing inlet path 111B are each in the form of a U-shaped path, and connect the sheet ejection path 108A and the reversing path 112 which is arranged substantially parallel to the sheet ejection path 108A. Also, the first reversing outlet path 120A and the second reversing outlet path 120B are each in the form of a U-shaped path, and connect the reversing path 112 and the duplex feed path 121 which is arranged substantially parallel to the reversing path 112.

A fourth sensor S4 is disposed in the first reversing inlet path 11A, and a seventh sensor S7 is disposed in the second reversing inlet path 111B. An eighth sensor S8 is disposed in the duplex feed path 121, a sixth sensor S6 is disposed in the first reversing outlet path 120A, and a fifth sensor S5 is disposed in the second reversing outlet path 120B. A third sensor S3 is disposed in the first reversing path 112A, and a second sensor S2 is disposed in the second reversing path 112B. In this embodiment, those sensors are each a reflecting photosensor.

The roller unit R62 is of a three-roller structure capable of providing a transport force for advancing a sheet from the first reversing inlet path 111A to the first reversing path 112A and a transport force for advancing a sheet from the first reversing path 112A to the first reversing outlet path 120A at the same time. More specifically, the roller unit R62 comprises a driver roller 62*a* and driven rollers 62*b*, 62*c* which are in contact with the driver roller 62*a* and rotate in the directions of respective arrows when the driver roller 62*a* is rotated in the direction of an arrow. With that structure, the transport force for advancing a sheet from the first reversing inlet path 111A to the first reversing path 112A and the transport force for advancing a sheet from the first reversing path 112A to the first reversing outlet path 120A can be developed at the same time.

Under control of a controller 80 (shown in FIG. 1), the roller pairs R1–R9, R61 and R62 are driven to rotate forward and backward, and the first and second sheet ejection flappers 110A, 110B and the first to fourth flappers 114A–114D are driven to swing. Additionally, S1 denotes a first sensor for detecting that a sheet has passed the fusing roller 119.

A description is now made of the control operation of re-feeding a sheet having an image formed on one side to the image forming section 105 in an ordinary state by the controller 80 through the duplex feed mechanism 101A having the above-described construction.

Duplex Feed of Short-Sized Sheet

The duplex feed operation of reversing, e.g., a short-sized sheet having an image formed on one side and feeding it to the image forming section 105, will be first described.

In the case of the duplex sheet feed, when sheets are transported at predetermined intervals between them as shown in FIG. 2 and the first sensor S1 detects that the leading end of a first sheet 1, i.e., a lead sheet, having an image formed on one side has passed the fusing roller 119, the controller 80 switches over the first sheet ejection flapper 110A and the second sheet ejection flapper 110B, causing subsequent sheets, including the first sheet 1, to be selectively transported to the first reversing inlet path 111A and the second reversing inlet path 111B. In this embodiment, the first sheet ejection flapper 110A and the second sheet ejection flapper 110B are controlled such that the (2n+1)-th (n is an integer equal to or more than 0) sheet is transported to the second reversing inlet path 111B and the (2n+2)-th sheet is transported to the first reversing inlet path 111A.

Figure 3A:
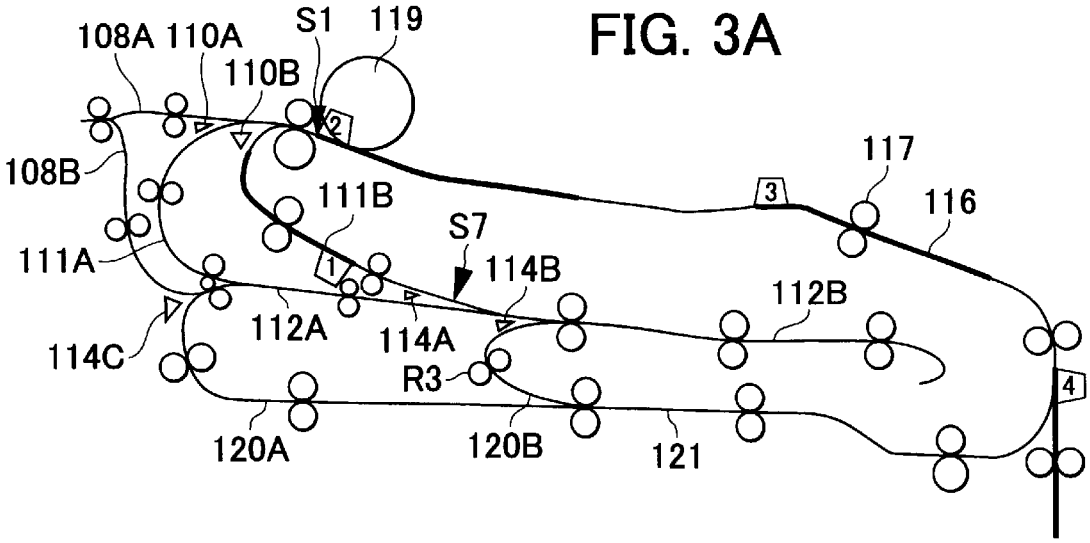
FIGS. 3A to 3C are a first set of illustrations for explaining a sheet flow when a sheet is re-fed to an image forming section using the duplex feed mechanism.

With that control, as shown in FIG. 3A, the first sheet 1 is transported to the second reversing inlet path 111B. Then, when the seventh sensor S7 detects the leading end of the first sheet 1, the controller 80 confirms whether a preceding sheet is present in the second reversing path 112B on the downstream side. Since no preceding sheet is present in this case, the first sheet 1 is continuously advanced toward the second reversing path 112B. After the first sheet 1 is transported to the second reversing path 112B, when the first sensor S1 detects that a second sheet 2, i.e., a succeeding sheet, has passed the fusing roller 119, the controller 80 switches over the first sheet ejection flapper 110A and the second sheet ejection flapper 110B, causing the second sheet 2 to be transported to the first reversing inlet path 111A. Subsequently, a third sheet 3 and a fourth sheet 4 are also transported in a similar way.

Figure 3B:
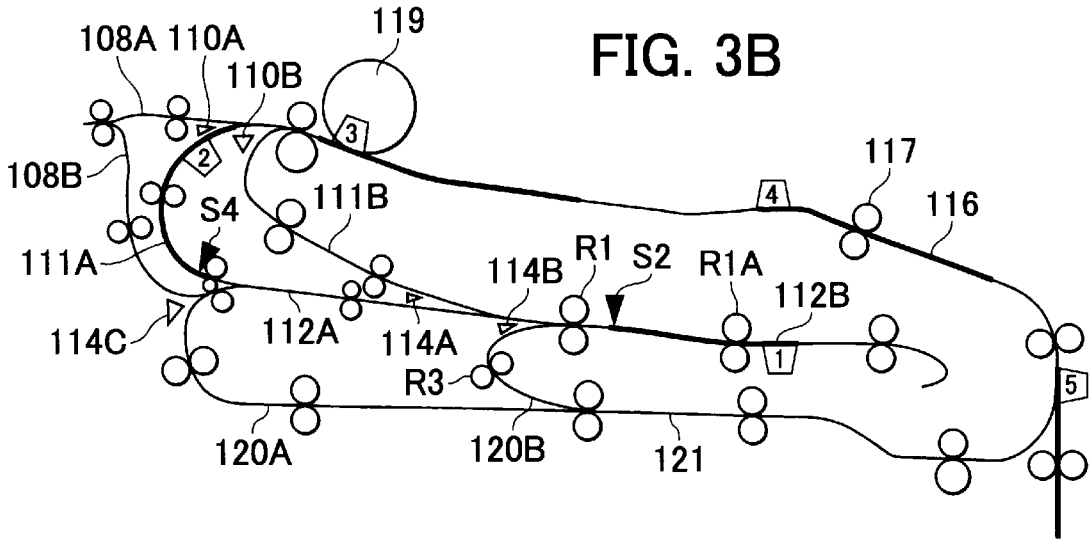

Then, as shown in FIG. 3B, when the first sheet 1 is transported to the second reversing path 112B and the second sensor S2 disposed in the second reversing path 112B detects the passage of the first sheet 1, the driving of the roller pairs R1, R1A in the forward (advance) direction is stopped to cease the transport of the first sheet 1. In this embodiment, a stepping motor is used as a roller driving source. In order to prevent of the stepping motor from being out of synchronism, a sheet is stopped for a predetermined time until specific vibrations of the motor are stabilized. Subsequently, after the lapse of the predetermined time, the roller pairs R1, R1A are driven to rotate in the backward direction to transport the first sheet 1. When the second sensor S2 detects again the first sheet 1 thereafter, the first flapper 114A and the second flapper 114B are controlled such that the first sheet 1 is transported to the second reversing outlet path 120B.

On the other hand, when the fourth sensor S4 detects the leading end of the second sheet 2 transported to the first reversing inlet path 111A, the controller 80 confirms whether a preceding sheet is present in the first reversing path 112A on the downstream side. Since no preceding sheet is present in this case, the second sheet 2 is continuously transported to the first reversing path 112A.

Figure 3C:
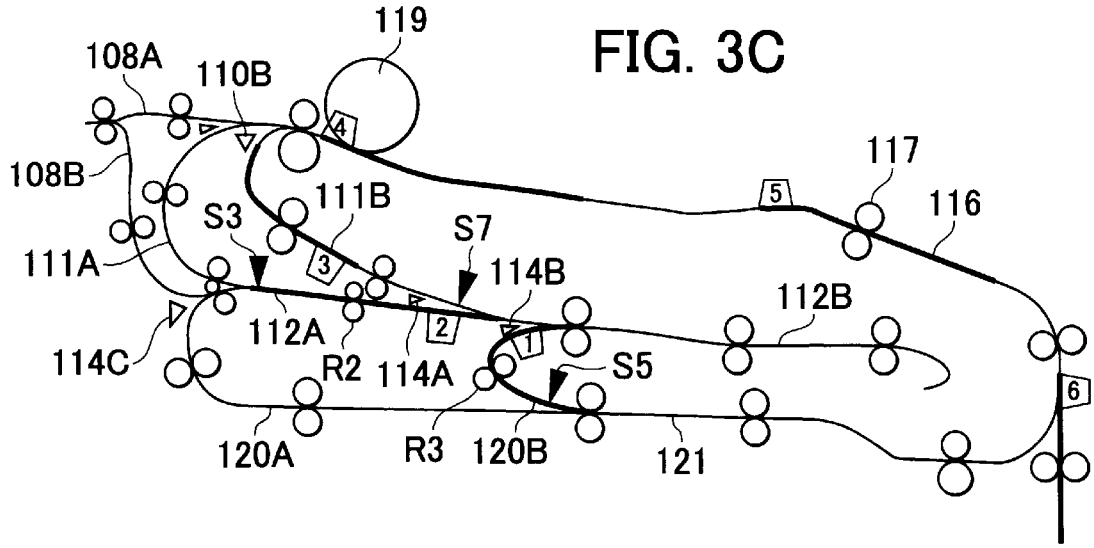

As a result, as shown in FIG. 3C, the first sheet 1 is transported to the second reversing outlet path 120B and the second sheet 2 is transported to the first reversing path 112A. Thereafter, when the fifth sensor S5 detects the first sheet 1, the roller pair R3 is stopped to temporarily cease transport of the first sheet 1. Then, the driving of the roller pair R3 is controlled so as to resume the transport of the first sheet 1 in step with the timing of re-feeding the first sheet 1 from the duplex feed path 121 after a seventh sheet (not shown), i.e., a sheet subsequent to a sixth sheet 6, which is supplied from one of the sheet supply cassettes 113A, 113B, 113C and 113D (see FIG. 1). Also, when the third sensor S3 detects the passage of the second sheet 2, the roller pair R2 is stopped and thereafter the roller pair R2 is driven to rotate backward, causing the second sheet 2 to be transported in the backward direction. Then, when the third sensor S3 detects again the passage of the second sheet 2, the third flapper 114C and the fourth flapper 114D are controlled such that the second sheet 2 is transported to the first reversing outlet path 120A.

In parallel to the above operation of transporting the first sheet 1 and the second sheet 2, the first sheet ejection flapper 110A and the second sheet ejection flapper 110B are controlled, causing the third sheet 3, i.e., the (2n+1)-th sheet, to be transported to the second reversing inlet path 111B. Then, when the seventh sensor S7 detects the leading end of the third sheet 3 transported to the second reversing inlet path 111B, the controller 80 confirms whether a preceding sheet is present in the second reversing path 112B. Since no preceding sheet is present in this case, the third sheet 3 is continuously transported to the second reversing path 112B. Subsequent sheets are also controlled in a similar way.

Figure 4A:
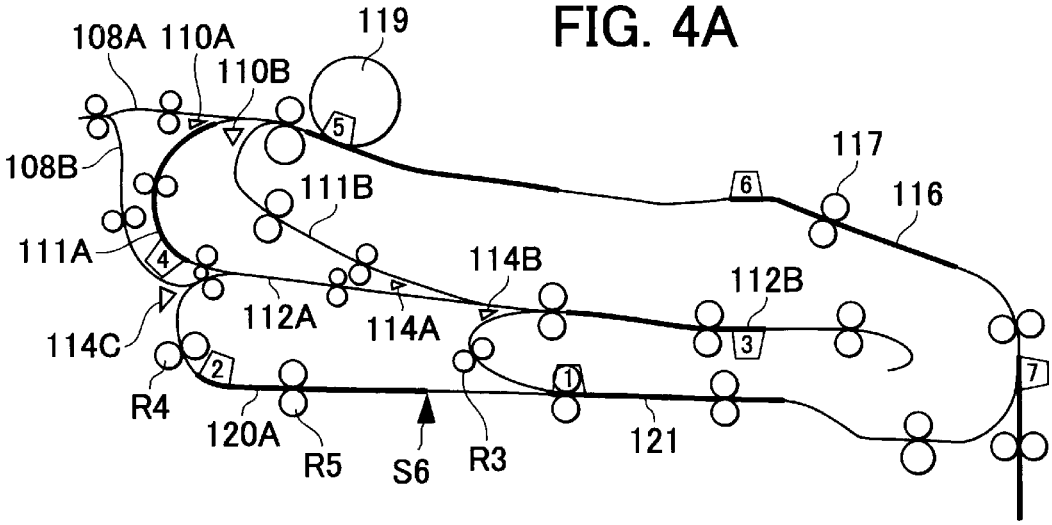
FIGS. 4A to 4C are a second set of illustrations for explaining a sheet flow when a sheet is re-fed to the image forming section using the duplex feed mechanism.

Next, as shown in FIG. 4A, the first sheet 1 having resumed its transport is transported to the duplex feed path 121. As mentioned above, the first sheet 1 is transported at the timing of re-feeding it from the duplex feed path 121 subsequent to a seventh sheet 7. In this embodiment, the number of sheets, which can be held on standby in the first reversing inlet path 111A, the second reversing inlet path 111B, the first reversing path 112A, the second reversing path 112B, the first reversing outlet path 120A, the second reversing outlet path 120B, and the duplex feed path 121, is five. Thus, as shown in FIG. 4C described later, at the time when the sixth sheet 6 is transported to the first reversing inlet path 111A, the first sheet 1 is transported through the feed path 115*a*.

When the first sheet 1 is transported through the feed path 115*a* in such a manner, an interval between the first sheet 1 and the sixth sheet 6 is too large. In this embodiment, therefore, the seventh sheet 7 is transported after the sixth sheet 6 and the first sheet 1 is transported after the seventh sheet 7. As a result, the sheets can be fed at a predetermined sheet interval without accelerating the motor. Subsequent sheets are fed likewise such that, for example, the second sheet 2 follows the eighth sheet, the third sheet 3 follows a ninth sheet, and so on.

When the sixth sensor S6 detects the second sheet 2 in the first reversing outlet path 120A, the driving of the roller pairs R4, R5 is temporarily stopped. Then, the driving of the roller pairs R4, R5 is controlled so as to resume the transport of the second sheet 2 in step with the timing of re-feeding the second sheet 2 after an eighth sheet (not shown) that is supplied after the first sheet 1 re-fed from the duplex feed path 121. Subsequent sheets are also controlled in a similar way.

Figure 4B:
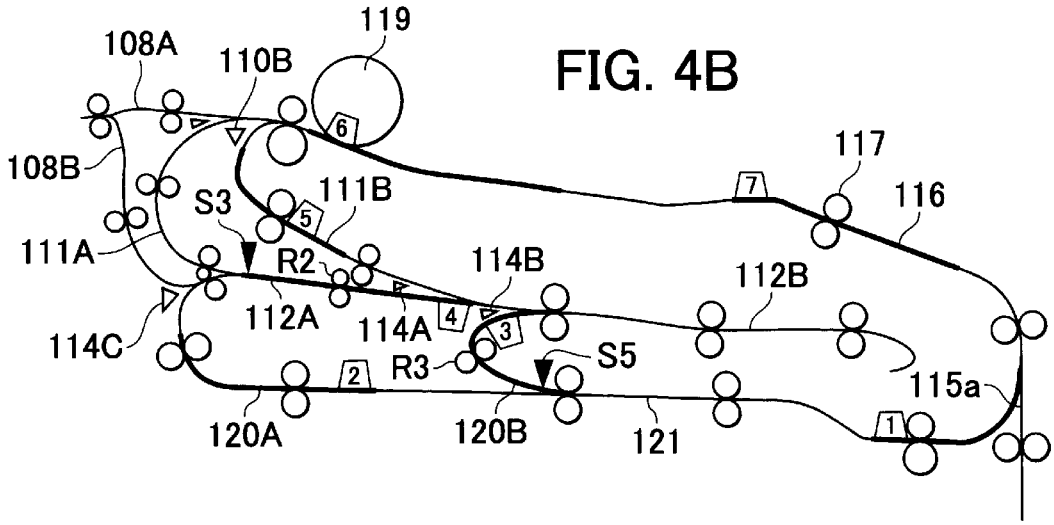
Figure 4C:
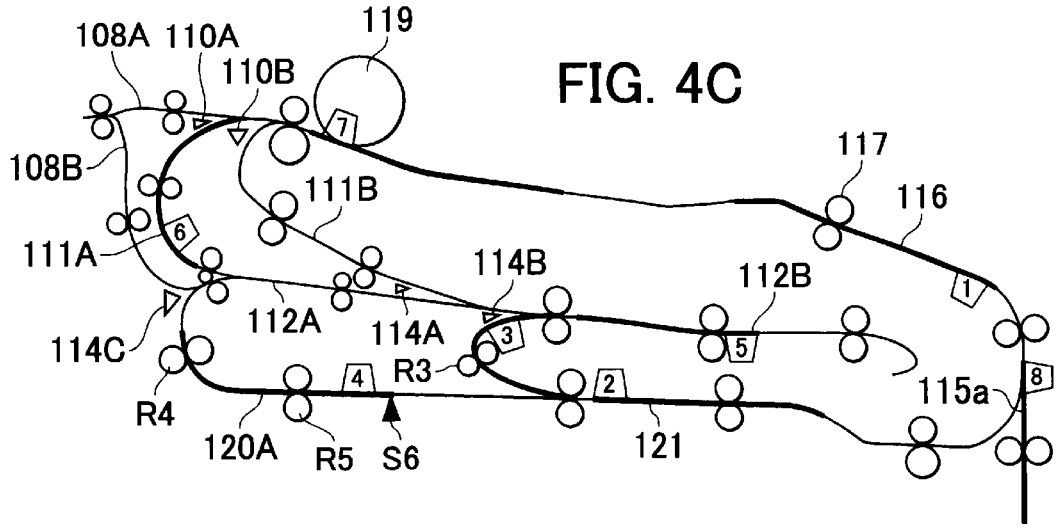

Then, as shown in FIG. 4B, the first sheet 1 is transported to the feed path 115*a* after the seventh sheet 7 that has been supplied from one of the sheet supply cassettes 113A, 113B, 113C and 113D. Note that, in FIG. 4B, the seventh sheet 7 is supplied from one of the sheet supply cassettes 113A, 113C and 113D. At this time, the eighth sheet is not yet supplied, and therefore the second sheet 2 is held stopped. The third sheet 3 is transported from the second reversing path 112B to the second reversing outlet path 120B with control of the first flapper 114A and the second flapper 114B. On this occasion, when the fifth sensor S5 detects the leading end of the third sheet 3, the driving of the roller pair R3 is temporarily stopped to hold the third sheet 3 on standby because the second sheet 2, i.e., the preceding sheet, is still held on standby in the first reversing outlet path 120A.

Also, the fourth sheet 4 is transported from the first reversing inlet path 111A and reaches the first reversing path 112A. On this occasion, when the third sensor S3 detects the tailing end of the fourth sheet 4, the third flapper 114C and the fourth flapper 114D are controlled so as to transport the fourth sheet 4 to the first reversing outlet path 120A. However, because the second sheet 2, i.e., the preceding sheet, is still held on standby in the first reversing outlet path 120A at this time, the driving of the roller pair R2 is temporarily stopped to hold the fourth sheet 4 on standby in the first reversing path 112A. Subsequent sheets are also controlled in a similar way.

Next, as shown in FIG. 4C, at the time when the first sheet 1 has already passed the register roller pair 117 in the in-register introducing section 116 and the eighth sheet 8, which should follow the first sheet 1, is transported to the feed path 115*a*, the second sheet 2 is already transported from the first reversing outlet path 120A to the duplex feed path 121 in step with the timing of re-feeding it to the feed path 115*a* after the eighth sheet 8 as mentioned above. Correspondingly, the fourth sheet 4 is transported to the first reversing outlet path 120A and its leading end is detected by the sixth sensor S6. However, because the third sheet 3, i.e., the preceding sheet, is still held on standby in the second reversing outlet path 120B at this time, the driving of the roller pairs R4, R5 is stopped to temporarily cease the transport of the fourth sheet 4. Likewise, the fifth sheet 5 is held on standby in the second reversing path 112B because the second reversing outlet path 120B on the downstream side is occupied. Subsequent sheets are also controlled in a similar way.

Figure 5A:
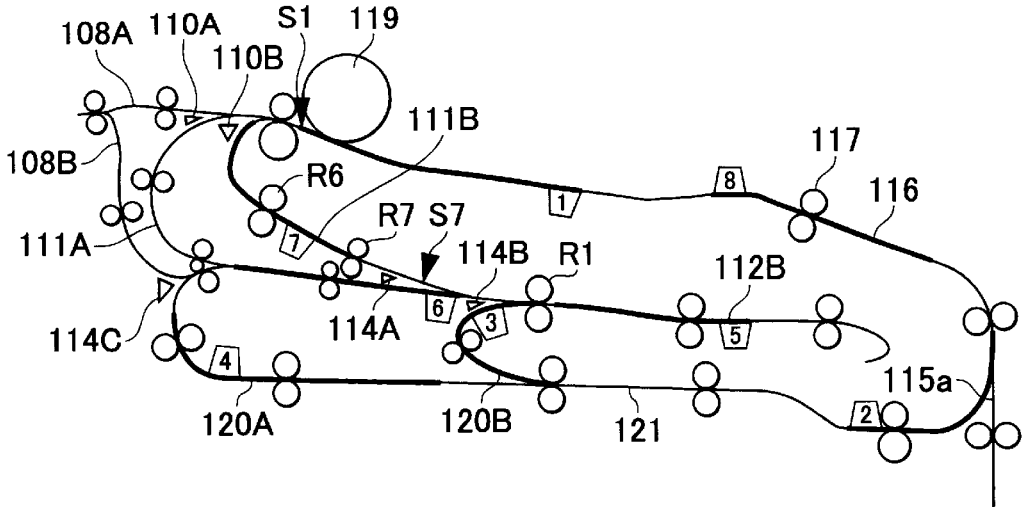
FIGS. 5A and 5B are a third set of illustrations for explaining a sheet flow when a sheet is re-fed to the image forming section using the duplex feed mechanism.

Subsequently, as shown in FIG. 5A, when the leading end of the first sheet 1 reaches the first sensor S1 after passing the fusing roller 119 and is detected by the first sensor S1, the first sheet ejection flapper 110A and the second sheet ejection flapper 110B are controlled, causing the first sheet 1 to be transported to the first sheet ejection path 108A. At this time, the second sheet 2 is transported to the feed path 115*a* after the eighth sheet 8 that has been supplied from one of the sheet supply cassettes 113A, 113B, 113C and 113D. The third sheet 3 is still held stopped, and the fourth sheet 4 is held on standby because the third sheet 3 is in the standby state in the second reversing outlet path 120B. Further, the fifth and sixth sheets 5, 6 are also held on standby because the respective preceding sheets remain in the downstream side.

On this occasion, the seventh sheet 7 is transported to the second reversing inlet path 111B. Upon the leading end of the seventh sheet 7 being detected by the seventh sensor S7, the driving of the roller pairs R6, R7 is stopped to temporarily cease the transport of the seventh sheet 7 when the preceding sheet is present in the second reversing path 112B or when the roller pair R1 is rotated in a direction opposed to the transport direction of the seventh sheet 7. Subsequent sheets are also controlled in a similar way.

Figure 5B:
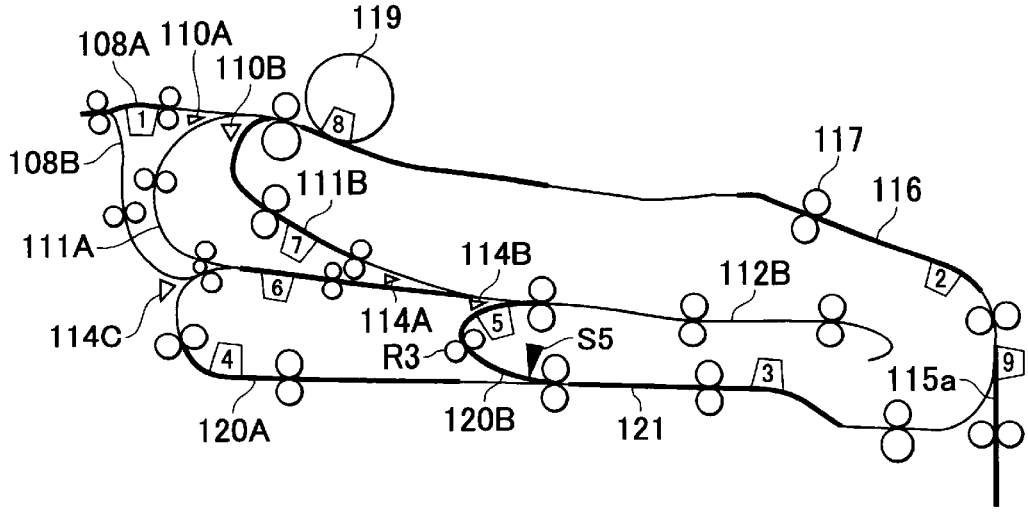

Thereafter, as shown in FIG. 5B, the first sheet 1 is transported to the sheet ejection path 108A and then ejected out of the copying machine. The second sheet 2 is transported similarly to the first sheet 1 as the preceding sheet, and the third sheet 3 is already transported from the second reversing outlet path 120B to the duplex feed path 121 in step with the timing of re-feeding it to the feed path 115*a* after a ninth sheet 9.

Correspondingly, the fifth sheet 5 is transported to the second reversing outlet path 120B. Upon the leading end of the fifth sheet 5 being detected by the fifth sensor S5, because the fourth sheet 4, i.e., the preceding sheet, is still held on standby in the first reversing outlet path 120A, the driving of the roller pair R3 is stopped to temporarily cease the transport of the fifth sheet 5. Subsequent sheets are also controlled in a similar way.

Figure 6A:
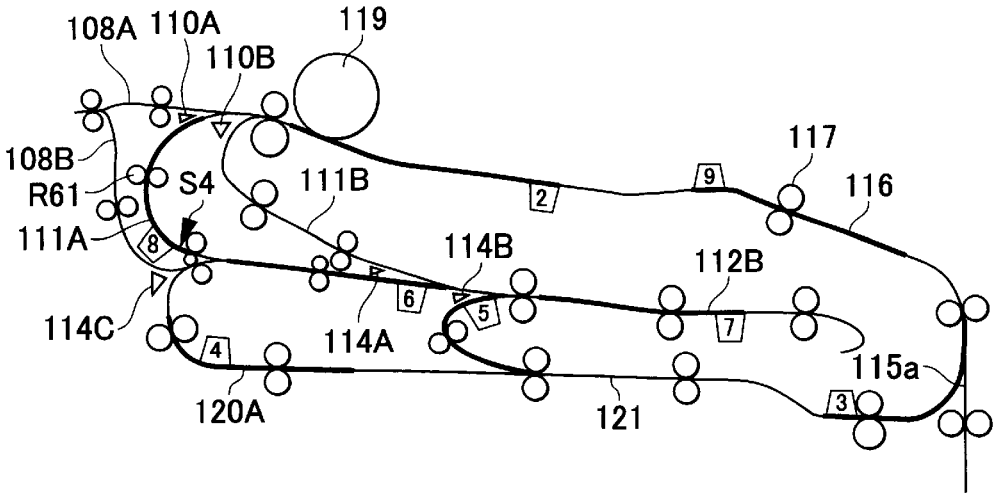
FIGS. 6A and 6B are a fourth set of illustrations for explaining a sheet flow when a sheet is re-fed to the image forming section using the duplex feed mechanism.

Then, as shown in FIG. 6A, the second sheet 2 passes the fusing roller 119. When the first sensor S1 detects the leading end of the second sheet 2, the first and second sheet ejection flappers 110A, 110B are controlled, causing the second sheet 2 to be transported to the first sheet ejection path 108A. Also, the third sheet 3 is transported to the feed path 115*a* after the ninth sheet 9 that has been supplied from one of the sheet supply cassettes 113A, 113B, 113C and 113D.

Further, when the fourth sensor S4 detects the eighth sheet 8, the driving of the roller pair R6 is stopped to temporarily cease the transport of the eighth sheet 8 because it is known that the sixth sheet 6 is still present in the first reversing path 112A on the downstream side. Subsequent sheets are also controlled in a similar way.

Figure 6B:
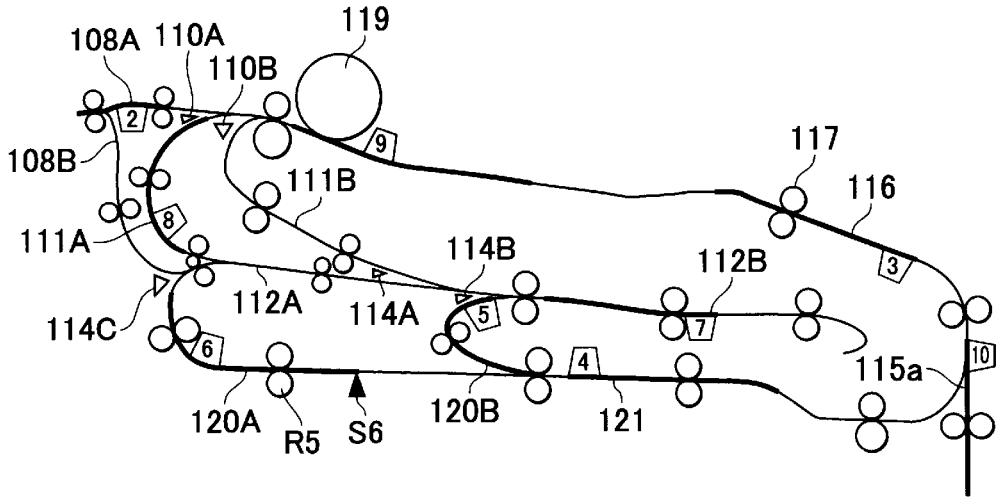

Thereafter, as shown in FIG. 6B, the second sheet 2 is transported to the sheet ejection path 108A and then ejected onto the sheet ejection tray 109 outside the copying machine. The third sheet 3 is transported similarly to the second sheet 2 as the preceding sheet, and the fourth sheet 4 is transported to the duplex feed path 121 in step with the timing of re-feeding it to the feed path 115*a* after a tenth sheet 10. Note that FIG. 6B shows a state in which the fourth sheet 4 has already been transported from the first reversing outlet path 120A to the duplex feed path 121. Correspondingly, the sixth sheet 6 is transported to the first reversing outlet path 120A. Upon the leading end of the sixth sheet 6 being detected by the sixth sensor S6, because the fifth sheet 5, i.e., the preceding sheet, is still held on standby in the second reversing outlet path 120B, the driving of the roller pair R5 is stopped to temporarily cease the transport of the sixth sheet 6. Subsequent sheets are also controlled in a similar way. The duplex feed sequence of the sheets after this point of time is executed by repeating the process shown in FIGS. 2 to 6.

Thus, by providing a pair of the first reversing inlet path 111A and the second reversing inlet path 111B and a pair of the first reversing outlet path 120A and the second reversing outlet path 120B with respect to the reversing path 112 (comprising the first reversing path 112A and the second reversing path 112B), a maximum of six points where sheets are held on standby can be ensured in feed of short-sized sheets.

By ensuring the maximum six standby points, sheets that have been successively transported to the first reversing inlet path 111A and the second reversing inlet path 111B can be successively held on standby in the first reversing inlet path 111A, the second reversing inlet path 111B, the first reversing outlet path 120A, the second reversing outlet path 120B, and the duplex feed path 121.

Then, by successively holding the sheets on standby in such a manner, the sheets can be successively re-fed from the sheet held on standby in the duplex feed path 121 in the same order as the one, in which they were transported to the in-register introducing section 116, at a predetermined timing, i.e., at a timing such that the interval between the sheets successively transported to the first reversing inlet path 111A and the second reversing inlet path 111B is equal to the interval between the sheets transported to the in-register introducing section 116. As a result, the sheets can be fed at a constant interval and images can be formed on both sides of each of the sheets at high speed.

Further, by feeding the reversed first sheet 1 after the seventh sheet 7, the reversed second sheet 2 after the eighth sheet 8, and so on, for example, as described above, maximum 13 sheets can be fed in a circulated manner without speeding up the motor until the seventh sheet 7 is reversed and transported to the in-register introducing section 116 (or the feed path 115*a*).

Consequently, it is possible to reduce the body size of the copying machine capable of forming images on both sides of a sheet at high speed, and to perform control with a sufficient allowance in driving of the motor because of a lack of need for high speed motor. Also, since the reversing process is distributed, the frequency of use of the motor for driving associated parts is reduced and the part life can be prolonged. Moreover, since all sheets from the first one to the last one can be fed at a predetermined interval in a circulated manner with respect to the in-register introducing section 116, it is possible to realize 100% of duplex feed performance.

The above description has been made in connection with the copying machine including each pair of reversing inlet paths, reversing paths and reversing outlet paths. However, the present invention is not limited to such an arrangement, but may also be applied to a copying machine including every three or more sets of reversing inlet paths, reversing paths and reversing outlet paths.

Control in Event of Trouble in One Reversing Outlet Path

While the image forming operation in the normal state operates as described above, a description will now be made of the case in which one of the reversing outlet paths is unusable because of a jam, a failure or any other reason.

Figure 7A:
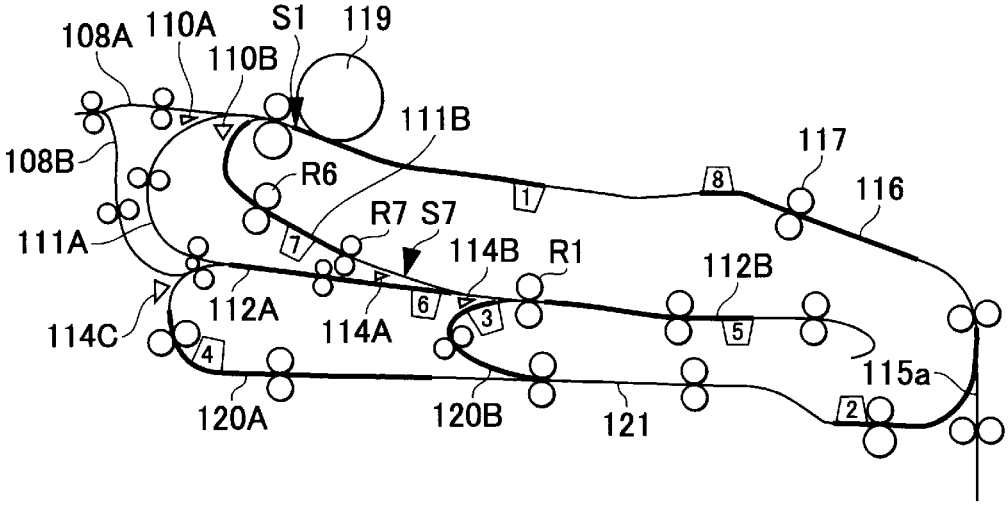
FIGS. 7A and 7B are a first set of illustrations for explaining a sheet flow when a sheet is re-fed to the image forming section in passing control using the duplex feed mechanism.

Here, with reference to FIGS. 7A and 7B, the process is described in connection with the duplex copying operation of 10 output sheets, in which the control is performed in sequence as shown in FIGS. 3A, 3B and 3C and FIGS. 4A and 4B, but when the fourth sheet 4 is transported to the first reversing outlet path 120A as shown in FIG. 4C, it does not reach the sixth sensor S6 within a predetermined time because of the so-called delay jam. Since the first reversing outlet path 120A in which the delay jam has occurred becomes unusable, the control of the other sheets is performed while the fourth sheet 4 is left as it is in the first reversing outlet path 120A. More specifically, as shown in FIG. 7A, when the first sheet 1 reaches the first sensor S1 after passing the fusing roller 119 and the first sensor S1 detects the leading end of the first sheet 1, the first and second sheet ejection flappers 110A, 110B are controlled, causing the first sheet 1 to be transported to the first sheet ejection path 108A. On the other hand, the second sheet 2 is transported to the feed path 115*a* after the eighth sheet 8 that has been supplied from one of the sheet supply cassettes 113A, 113B, 113C and 113D. The third sheet 3 is still held stopped, and the fourth sheet 4 remains in the same state because the first reversing outlet path 120A is unusable because of the jam. Further, the fifth and sixth sheets 5, 6 are held on standby because the respective preceding sheets remain in the downstream side.

On this occasion, the seventh sheet 7 is transported to the second reversing inlet path 111B. Upon the leading end of the seventh sheet 7 being detected by the seventh sensor S7, the driving of the roller pairs R6, R7 is stopped to temporarily cease the transport of the seventh sheet 7 when the preceding sheet is present in the second reversing path 112B or when the roller pair R1 is rotated in a direction opposed to the transport direction of the seventh sheet 7. Subsequent sheets are also controlled in a similar way.

Figure 7B:
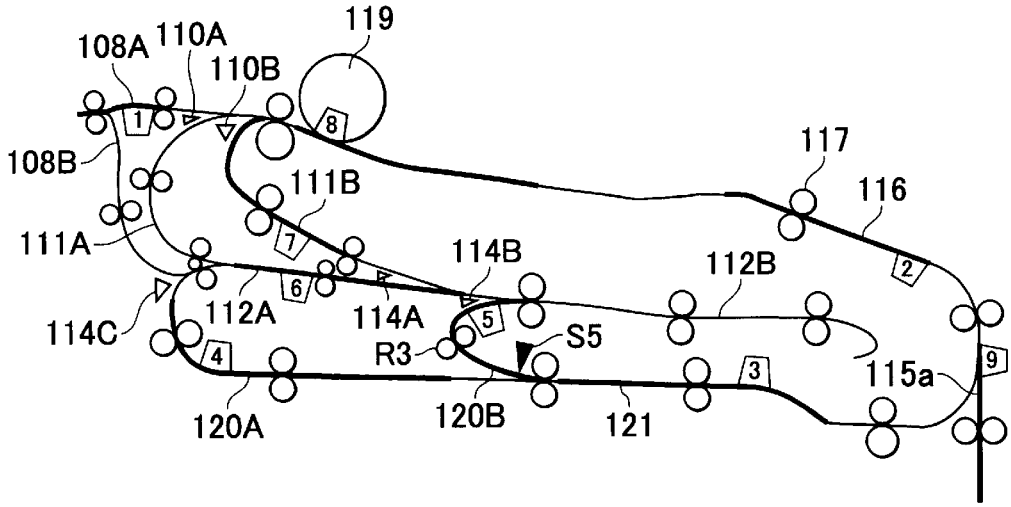

Thereafter, as shown in FIG. 7B, the first sheet 1 is transported to the sheet ejection path 108A and then ejected onto the sheet ejection tray 109 outside the copying machine. The second sheet 2 is transported similarly to the first sheet 1 as the preceding sheet, and the third sheet 3 is already transported from the second reversing outlet path 120B to the duplex feed path 121 in match with the timing of re-feeding it to the feed path 115*a* after the ninth sheet 9. Correspondingly, the fifth sheet 5 is transported to the second reversing outlet path 120B. Upon the leading end of the fifth sheet 5 being detected by the fifth sensor S5, because the third sheet 3 is held on standby in the duplex feed path 121, the driving of the roller pair R3 is stopped to temporarily cease the transport of the fifth sheet 5. Subsequent sheets are also controlled in a similar way.

Figure 8A:
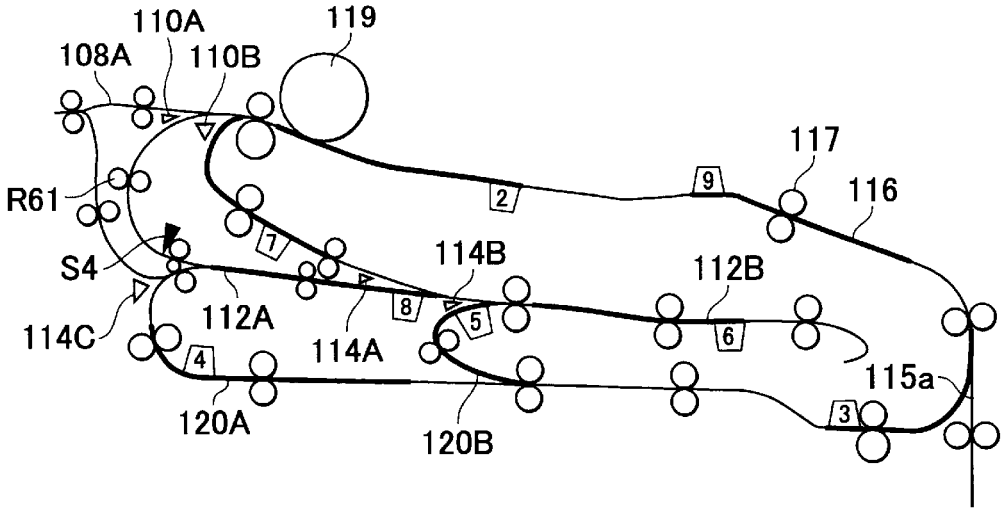
FIGS. 8A and 8B are a second set of illustrations for explaining a sheet flow when a sheet is re-fed to the image forming section in passing control using the duplex feed mechanism.

Then, as shown in FIG. 8A, the second sheet 2 passes the fusing roller 119. When the first sensor S1 detects the leading end of the second sheet 2, the first and second sheet ejection flappers 110A, 110B are controlled, causing the second sheet 2 to be transported to the first sheet ejection path 108A. Also, the third sheet 3 is transported to the feed path 115*a* after the ninth sheet 9 that has been supplied from one of the sheet supply cassettes 113A, 113B, 113C and 113D. Further, the sixth sheet 6 is transported to the second reversing path 112B with the driving of the roller pairs R2, R1 and R1A, and when the second sensor S2 detects the tailing end of the sixth sheet 6, the driving of the roller pairs R2, R1 and R1A is stopped. Additionally, when the fourth sensor S4 detects the eighth sheet 8, the roller pairs R6, R2 are driven to transport the eighth sheet 8 to the first reversing path 112A because it is known that the sixth sheet 6 is not present in the first reversing path 112A on the downstream side. The seventh sheet 7 is held on standby as it is because the sixth sheet 6 is present in the second reversing path 112B. Subsequent sheets are also controlled in a similar way.

Figure 8B:
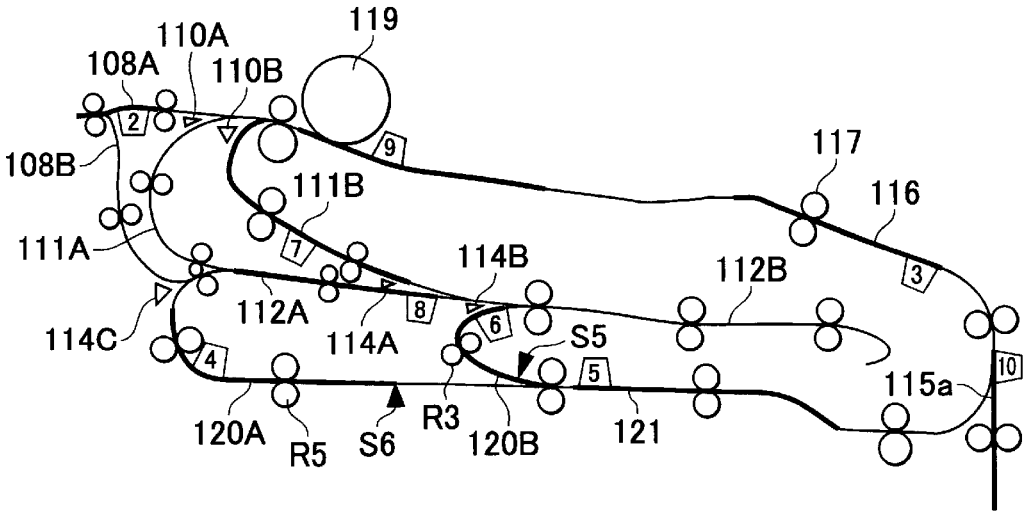

Thereafter, as shown in FIG. 8B, the second sheet 2 is transported to the sheet ejection path 108A and then ejected out of the copying machine. The third sheet 3 is transported in similarly to the second sheet 2 as the preceding sheet, and the fifth sheet 5 is transported to the duplex feed path 121 in match with the timing of re-feeding it to the feed path 115*a* after the tenth sheet 10. Note that FIG. 8B shows a state in which the fifth sheet 5 has already been transported from the second reversing outlet path 120B to the duplex feed path 121.

Correspondingly, the sixth sheet 6 is transported to the second reversing outlet path 120B and its leading end is detected by the fifth sensor S5. However, because the fifth sheet 5, i.e., the preceding sheet, is still held on standby in the duplex feed path 121, the driving of the roller pair R3 is stopped to temporarily cease the transport of the sixth sheet 6. The seventh sheet 7 and the eighth sheet 8 remain in the standby state as they are.

Figure 9A:
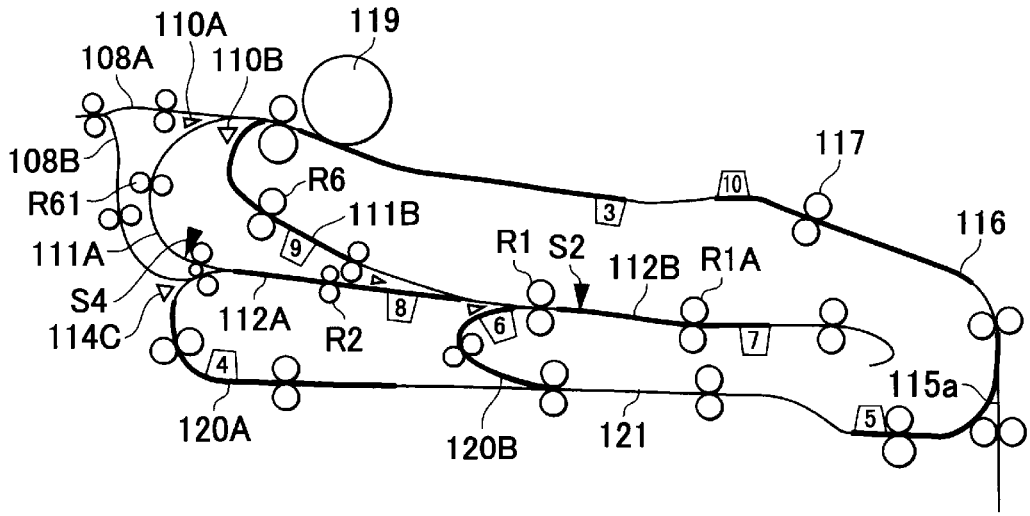
FIGS. 9A and 9B are a third set of illustrations for explaining a sheet flow when a sheet is re-fed to the image forming section in passing control using the duplex feed mechanism.

Then, as shown in FIG. 9A, the third sheet 3 passes the fusing roller 119. When the first sensor S1 detects the leading end of the third sheet 3, the first and second sheet ejection flappers 110A, 110B are controlled, causing the third sheet 3 to be transported to the first sheet ejection path 108A. Also, the fifth sheet 5 is transported to the feed path 115*a* after the tenth sheet 10 that has been supplied from one of the sheet supply cassettes 113A, 113B, 113C and 113D. Further, the seventh sheet 7 is transported to the second reversing path 112B with the driving of the roller pairs R2, R1 and R1A, and when the second sensor S2 detects the tailing end of the seventh sheet 7, the driving of the roller pairs R2, R1 and R1A is stopped, and at the same time the roller pair R6 is driven to transport the ninth sheet 9 to the second reversing inlet path 111B. Additionally, the sixth sheet 6 and the eighth sheet 8 are still held on standby.

Figure 9B:
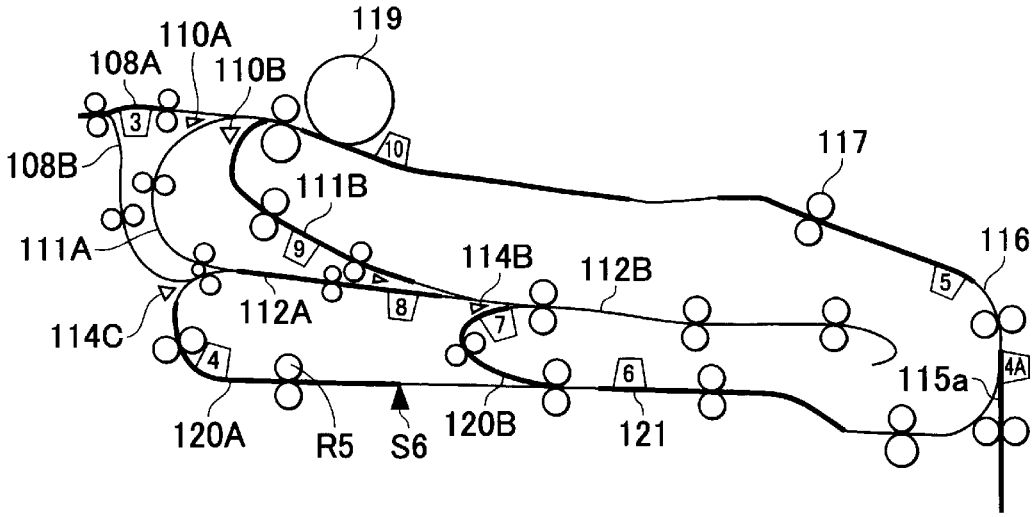

Thereafter, as shown in FIG. 9B, the third sheet 3 is transported to the sheet ejection path 108A and then ejected onto the sheet ejection tray 109 outside the copying machine. The fifth sheet 5 is transported similarly to the third sheet 3 as the preceding sheet. Then, since the tenth sheet 10, i.e., the last output sheet, has been fed into the copying machine, a fourth A sheet 4A, on which the image that should have been formed on the fourth sheet 4 is to be formed, is supplied from one of the sheet supply cassettes 113A, 113B, 113C and 113D and then transported to the feed path 115*a* instead of the fourth sheet 4 that is still left in the first reversing outlet path 120A because of the jam. At the same time, the sixth sheet 6 is transported to the duplex feed path 121. Note that FIG. 9B shows a state in which the sixth sheet 6 has already been transported from the second reversing outlet path 120B to the duplex feed path 121. Further, the seventh sheet 7 is transported to the second reversing outlet path 120B. Upon the leading end of the seventh sheet 7 being detected by the fifth sensor S5, because the sixth sheet 6, i.e., the preceding sheet, is still held on standby in the duplex feed path 121, the driving of the roller pair R3 is stopped to temporarily cease the transport of the seventh sheet 7. The eighth sheet 8 and the ninth sheet 9 remain in the standby state.

Figure 10A:
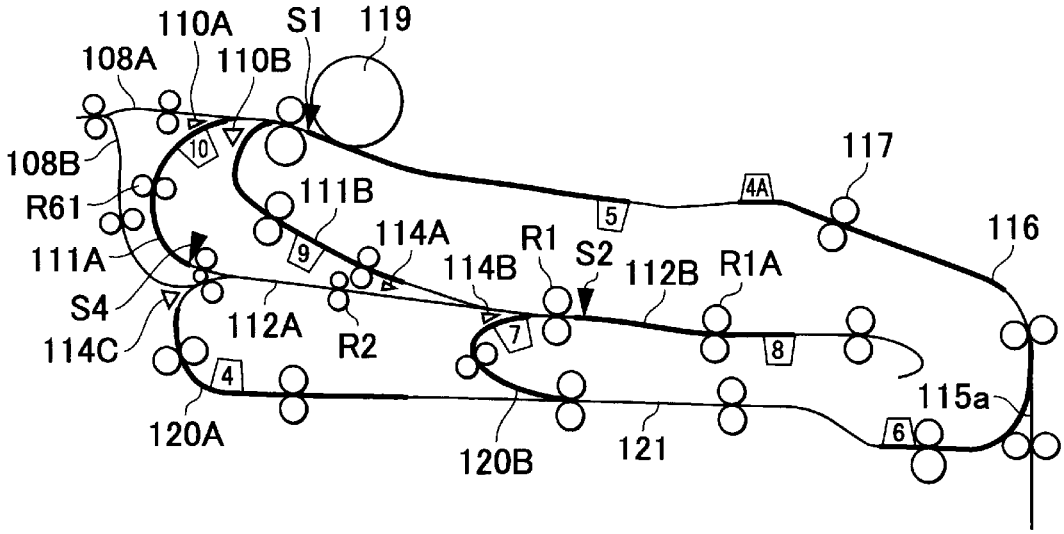
FIGS. 10A and 10B are a fourth set of illustrations for explaining a sheet flow when a sheet is re-fed to the image forming section in passing control using the duplex feed mechanism.

Then, as shown in FIG. 10A, the fifth sheet 5 passes the fusing roller 119. When the first sensor S1 detects the leading end of the fifth sheet 5, the first and second sheet ejection flappers 110A, 110B are controlled, causing the fifth sheet 5 to be transported to the first sheet ejection path 108A. Also, the sixth sheet 6 is transported to the feed path 115*a* after the fourth A sheet 4A that has been supplied from one of the sheet supply cassettes 113A, 113B, 113C and 113D. Further, the eighth sheet 8 is transported to the second reversing path 112B with the driving of the roller pairs R2, R1 and R1A, and when the second sensor S2 detects the tailing end of the eighth sheet 8, the driving of the roller pairs R2, R1 and R1A is stopped. Simultaneously, the roller pair R61 is driven to transport the tenth sheet 10 to the first reversing inlet path 111A. Further, the seventh sheet 7 is still held on standby.

Figure 10B:
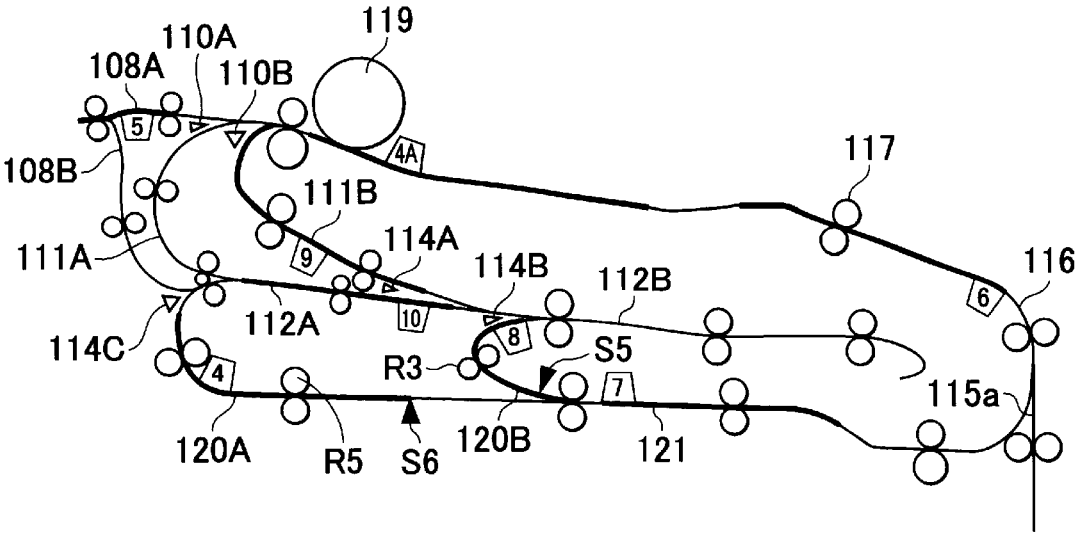

Thereafter, as shown in FIG. 10B, the fifth sheet 5 is transported to the sheet ejection path 108A and then ejected out of the copying machine. The fourth A sheet 4A is transported similarly to the fifth sheet 5 as the preceding sheet, and the seventh sheet 7 is transported to the duplex feed path 121. Note that FIG. 10B shows a state in which the seventh sheet 7 has already been transported from the second reversing outlet path 120B to the duplex feed path 121. Further, the eighth sheet 8 is transported to the second reversing outlet path 120B. Upon the leading end of the eighth sheet 8 being detected by the fifth sensor S5, because the seventh sheet 7, i.e., the preceding sheet, is still held on standby in the duplex feed path 121, the driving of the roller pair R3 is stopped to temporarily cease the transport of the eighth sheet 8. The ninth sheet 9 and the tenth sheet 10 remain in the standby state as they are.

Figure 11A:
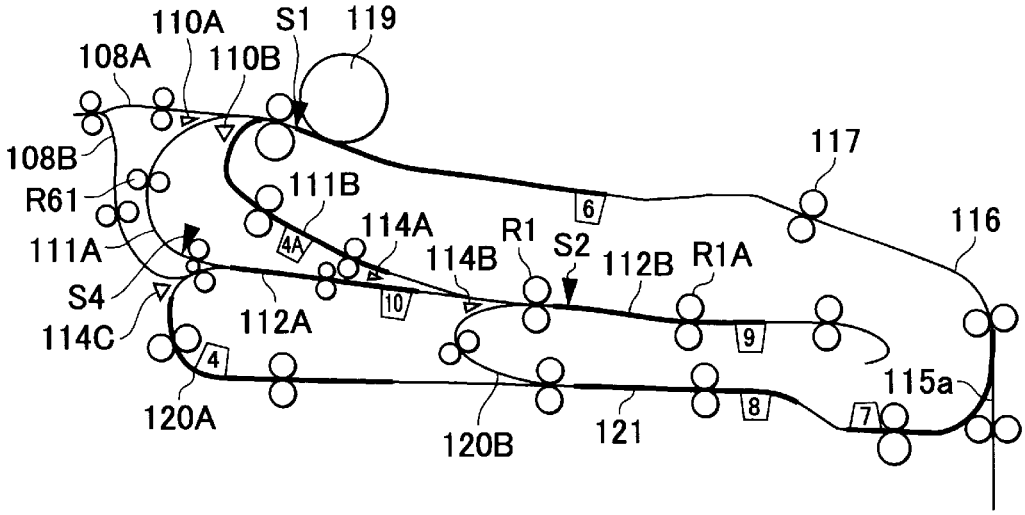
FIGS. 11A and 11B are a fifth set of illustrations for explaining a sheet flow when a sheet is re-fed to the image forming section in passing control using the duplex feed mechanism.

Then, as shown in FIG. 11A, the sixth sheet 6 passes the fusing roller 119. When the first sensor S1 detects the leading end of the sixth sheet 6, the first and second sheet ejection flappers 110A, 110B are controlled, causing the sixth sheet 6 to be transported to the first sheet ejection path 108A. Also, the seventh sheet 7 is transported to the feed path 115*a*, and the eighth sheet 8 is transported to the duplex feed path 121. Note that FIG. 11A shows a state in which the eighth sheet 8 has already been transported from the second reversing outlet path 120B to the duplex feed path 121. Further, the ninth sheet 9 is transported to the second reversing path 112B with the driving of the roller pairs R2, R1 and R1A, and when the second sensor S2 detects the tailing end of the ninth sheet 9, the driving of the roller pairs R2, R1 and R1A is stopped. Simultaneously, the roller pair R6 is driven to transport the fourth A sheet 4A to the second reversing inlet path 111B. The tenth sheet 10 is still held on standby.

Figure 11B:
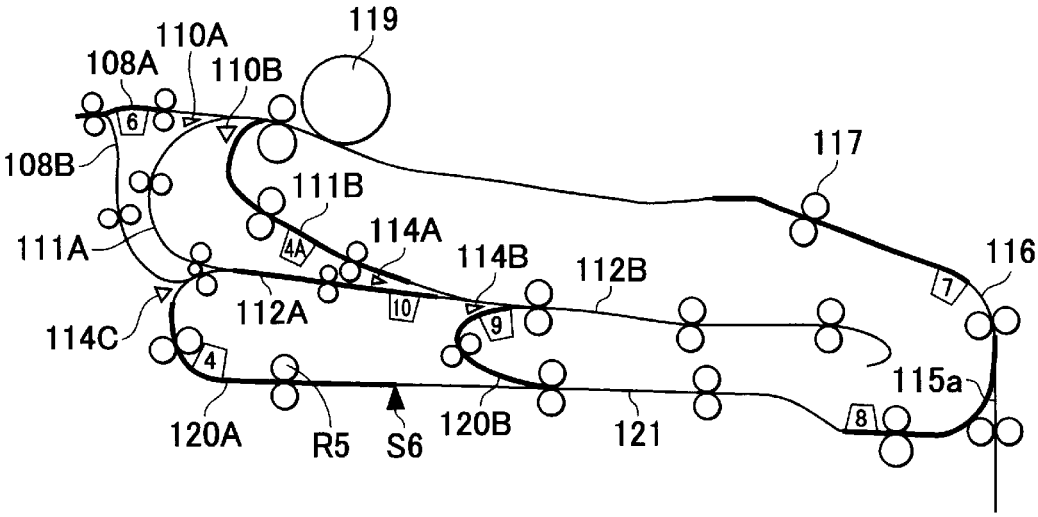

Thereafter, as shown in FIG. 11B, the sixth sheet 6 is transported to the sheet ejection path 108A and then ejected out of the copying machine. The seventh sheet 7 is transported similarly to the sixth sheet 6 as the preceding sheet, and the eighth sheet 8 is transported to the feed path 115*a*. Further, the ninth sheet 9 is transported to the second reversing outlet path 120B. The tenth sheet 10 and the fourth A sheet 4A remain in the standby state as they are.

Figure 12A:
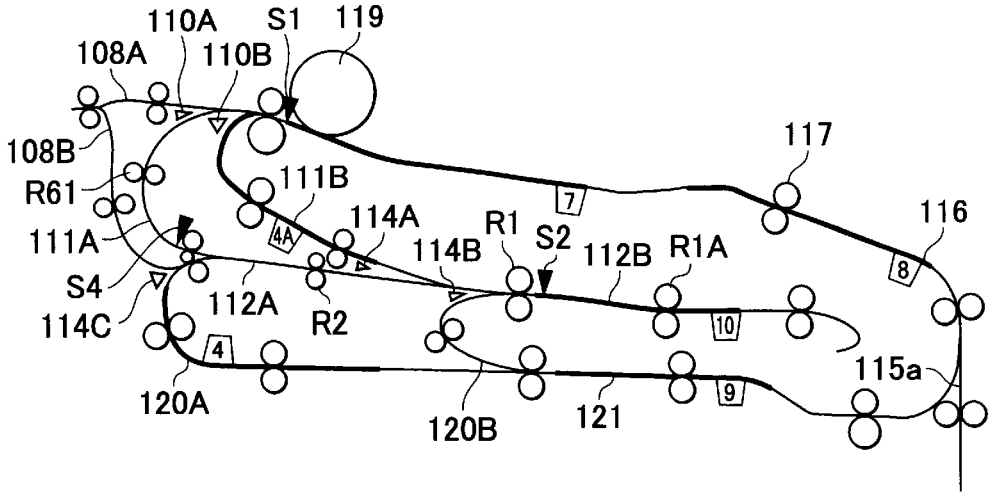
FIGS. 12A and 12B are a sixth set of illustrations for explaining a sheet flow when a sheet is re-fed to the image forming section in passing control using the duplex feed mechanism.
Figure 12B:
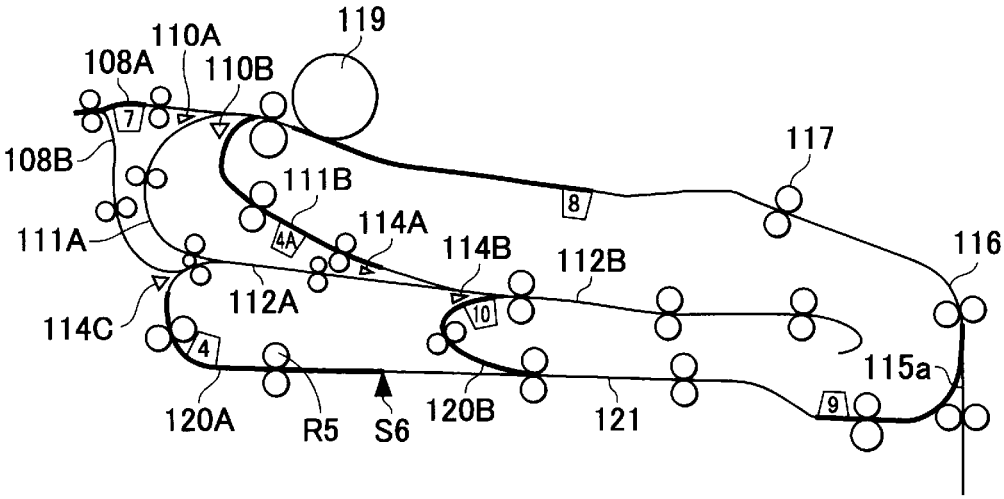

Then, as shown in FIG. 12A, the seventh sheet 7 passes the fusing roller 119. When the first sensor S1 detects the leading end of the seventh sheet 7, the first and second sheet ejection flappers 110A, 110B are controlled, causing the seventh sheet 7 to be transported to the first sheet ejection path 108A. Also, the eighth sheet 8 is transported in a manner similar to the seventh sheet 7 as the preceding sheet, and the ninth sheet 9 is transported to the duplex feed path 121. Note that FIG. 12A shows a state in which the ninth sheet 9 has already been transported from the second reversing outlet path 120B to the duplex feed path 121. Further, the tenth sheet 10 is transported to the second reversing path 112B with the driving of the roller pairs R2, R1 and R1A, and when the second sensor S2 detects the tailing end of the tenth sheet 10, the driving of the roller pairs R2, R1 and R1A is stopped. The fourth A sheet 4A is still held on standby. Thereafter, as shown in FIG. 12B, the seventh sheet 7 is transported to the sheet ejection path 108A and then ejected onto the sheet ejection tray 109 outside the copying machine. The eighth sheet 8 is transported similarly to the seventh sheet 7 as the preceding sheet, and the ninth sheet 9 is transported to the feed path 115*a*. Further, the tenth sheet 10 is transported to the second reversing outlet path 120B. The fourth A sheet 4A remains in the standby state as it is.

Figure 13A:
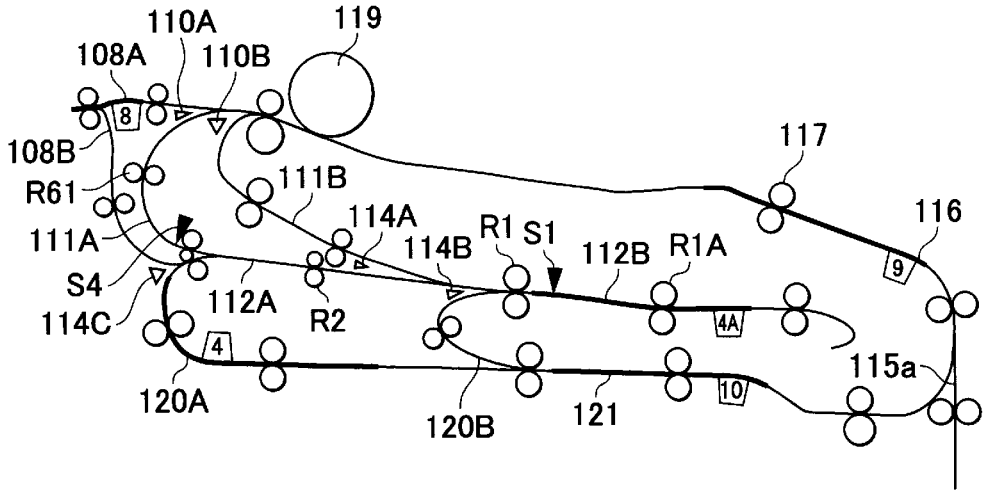
FIGS. 13A and 13B are a seventh set of illustrations for explaining a sheet flow when a sheet is re-fed to the image forming section in passing control using the duplex feed mechanism.

Next, as shown in FIG. 13A, the eighth sheet 8 is transported to the sheet ejection path 108A and then ejected out of the copying machine. The ninth sheet 9 is transported similarly to the eighth sheet 8 as the preceding sheet. Further, the tenth sheet 10 is transported to the duplex feed path 121. Note that FIG. 13A shows a state in which the tenth sheet 10 has already been transported from the second reversing outlet path 120B to the duplex feed path 121. The fourth A sheet 4A is transported to the second reversing path 112B with the driving of the roller pairs R2, R1 and R1A, and when the second sensor S2 detects the tailing end of the fourth A sheet 4A, the driving of the roller pairs R2, R1 and R1A is stopped.

Figure 13B:
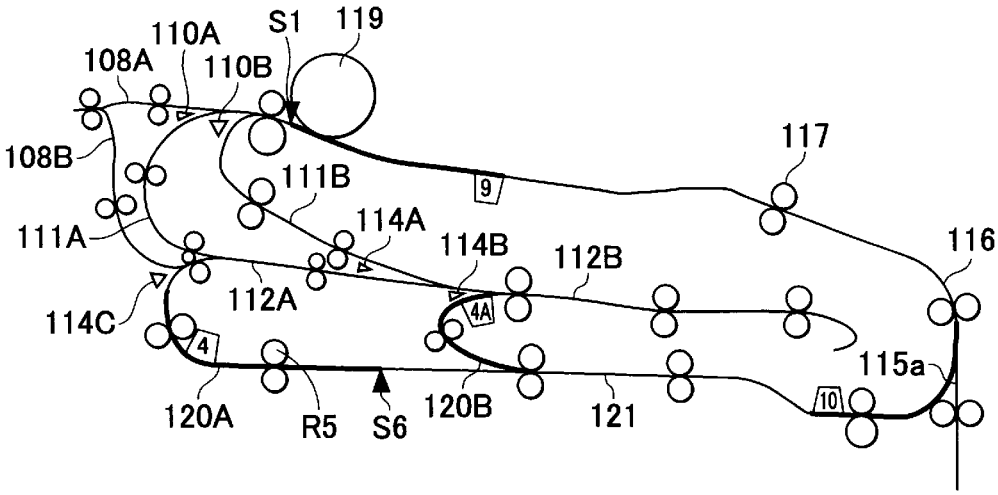

Thereafter, as shown in FIG. 13B, the ninth sheet 9 passes the fusing roller 119. When the first sensor S1 detects the leading end of the ninth sheet 9, the first and second sheet ejection flappers 110A, 110B are controlled, causing the ninth sheet 9 to be transported to the first sheet ejection path 108A. Also, the tenth sheet 10 is transported to the feed path 115*a*, and the fourth A sheet 4A is transported to the second reversing outlet path 120B. Then, the sheet feed is controlled such that the ninth sheet 9, the tenth sheet 10 and the fourth A sheet 4A are output in sequence, whereby the output operation is completed. Furthermore, the image forming operation is completed by inserting the fourth A sheet 4A in a proper position. After the completion of the output operation, an indication prompting the user to remove the fourth sheet 4 jammed in the first reversing outlet path 120A is displayed on, e.g., a display unit. The copying machine is restored to the standby state after confirming that the jammed sheet has been removed.

As described above, even when one of a plurality of reversing outlet paths is unusable because of a jam or other failure, the output operation can be continued until the completion of required output operation without stopping the machine, and hence a copying machine free from the downtime can be provided.

While the fourth A sheet 4A is transported to the second reversing inlet path 111B in the above embodiment, it may be transported to the first reversing inlet path 111A without problems. Also, in the above embodiment, the sheets are fed while leaving a vacant distance between the sixth and seventh sheets 6, 7 and between the eighth and ninth sheets 8, 9. However, the succeeding sheet may be sped up during the feed to shorten the interval between the two sheets without problems.

While the above first embodiment has been described in connection with the case in which the first reversing outlet path 120A is unusable, the present invention is also applicable to the case in which the second reversing outlet path 120B is unusable. Also, while the above first embodiment has been described in connection with the case in which the first reversing outlet path 120A is unusable, the present invention is also applicable to the case in which the first reversing inlet path 111A is unusable. Further, while the above first embodiment has been described in connection with the case in which the first reversing outlet path 120A is unusable, the present invention is also applicable to the case in which the second reversing inlet path 111B is unusable.

Figure 14:
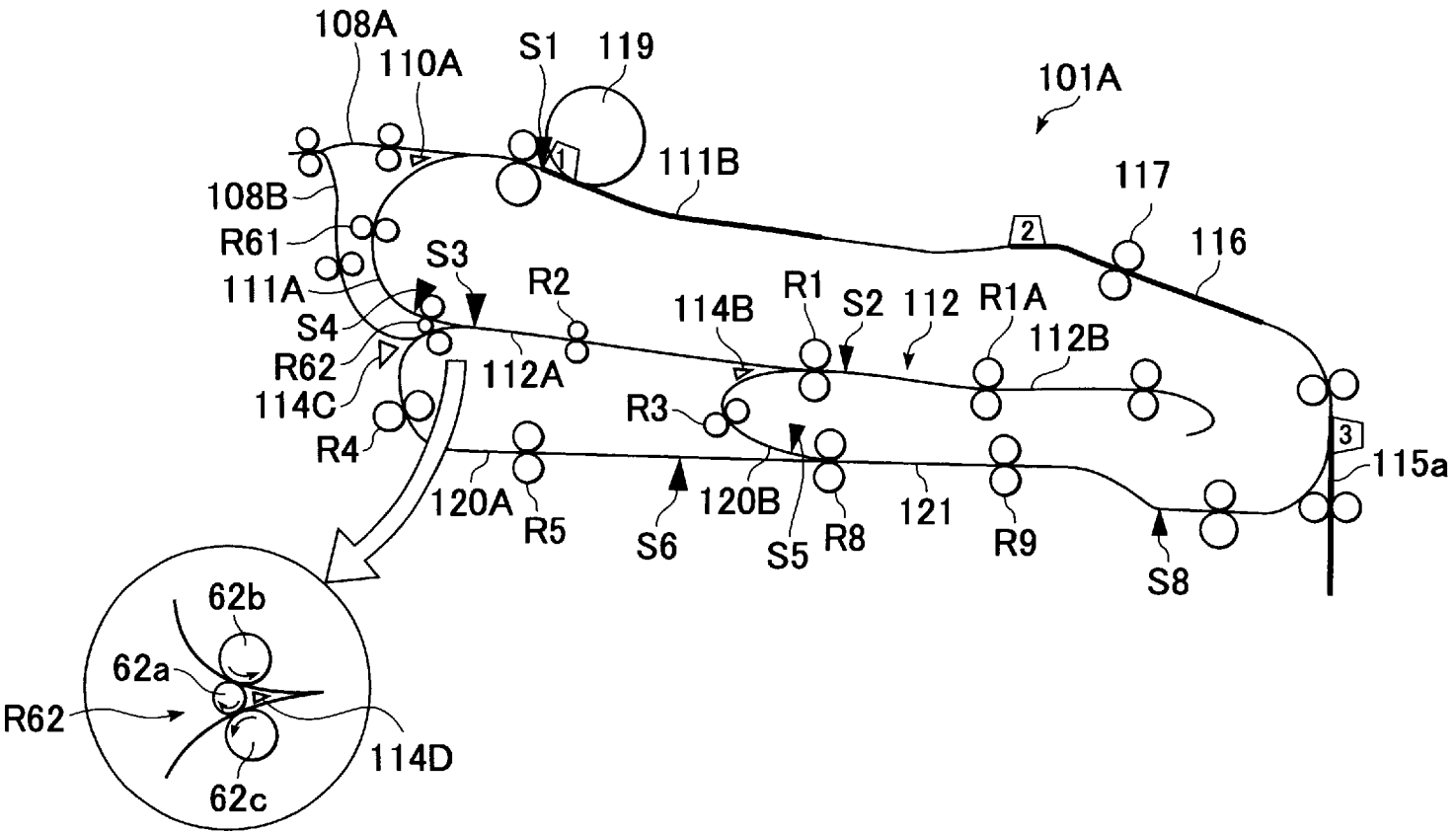
FIG. 14 illustrates a unit having one reverse inlet path and a plurality of reversing paths and reversing outlet paths.
Figure 15:
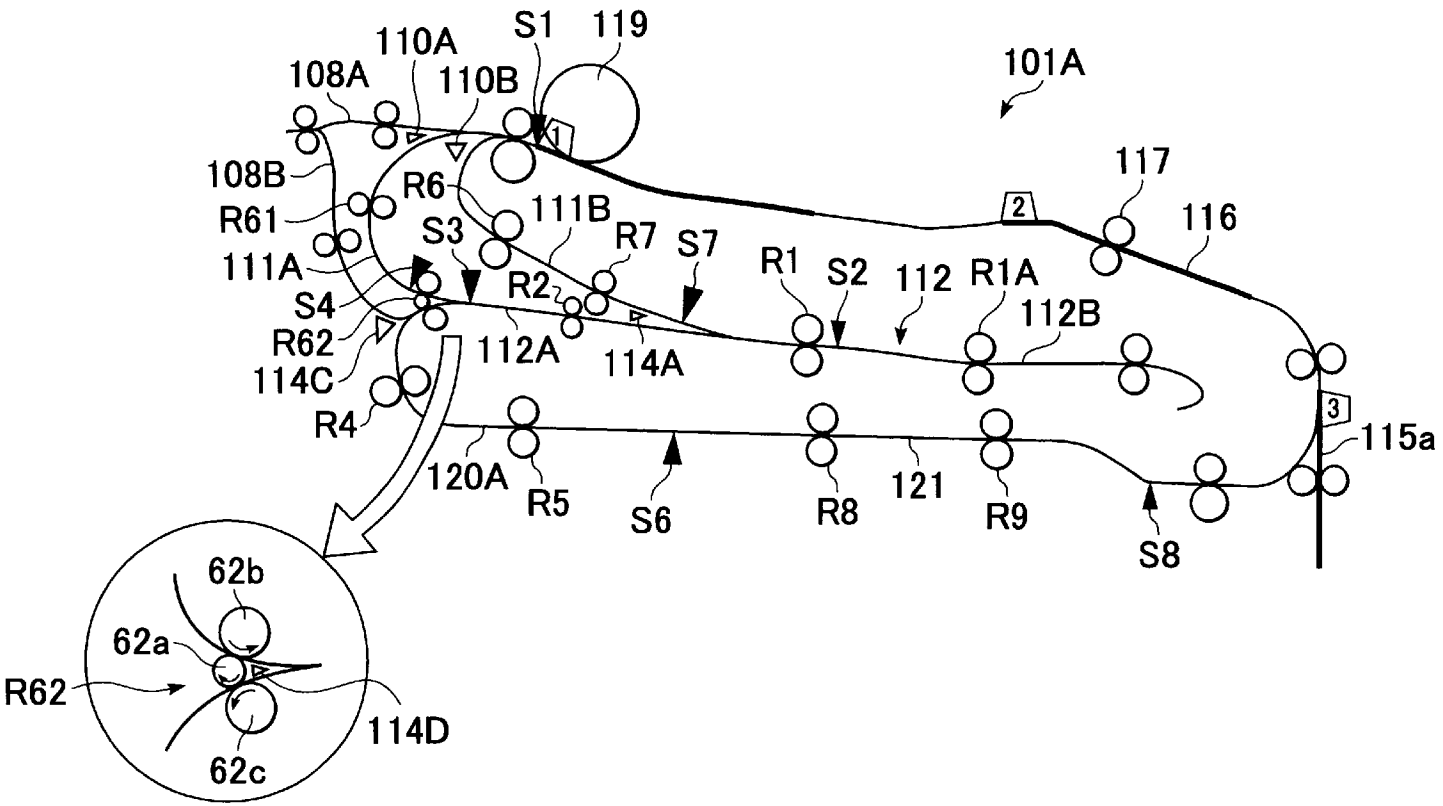
FIG. 15 illustrates a unit having one reversing inlet path and a plurality of reversing paths and reversing outlet paths.

While the above description has been made in connection with the copying machine including each pair of reversing inlet paths, reversing paths and reversing outlet paths, the present invention is not limited to such an arrangement, but can be applied to a copying machine including every three or more sets of reversing inlet paths, reversing paths and reversing outlet paths. Also, while the above description has been made in connection with the copying machine including each pair of reversing inlet paths, reversing paths and reversing outlet paths, the present invention is not limited to such an arrangement, but can be applied to a copying machine including one reversing inlet path, plural reversing paths and plural reversing outlet paths as shown in FIG. 14. Further, while the above description has been made in connection with the copying machine including each pair of reversing inlet paths, reversing paths and reversing outlet paths, the present invention is not limited to such an arrangement, but can be applied to a copying machine including one reversing outlet path, plural reversing inlet paths and plural reversing paths as shown in FIG. 15. Additionally, while a stepping motor is employed as the driving source for the sheet feed in the above description, a clutch may be used instead.

Second Embodiment

A second embodiment will be described below. In the second embodiment, a description is made of a method for putting output sheets in proper page order in the first embodiment. When the passing control is performed in the first embodiment, the output operation is continued with a sheet left in the unusable feed path, and hence the sequence of output sheets is disordered. The second embodiment is therefore intended for a method for putting output sheets in proper page order when the passing control is performed. The method for putting output sheets in proper page order is realized by employing and controlling two sheet ejection trays, i.e., a first sheet ejection tray 109A and a second sheet ejection tray 109B, as shown in FIG. 16.

Figure 16:
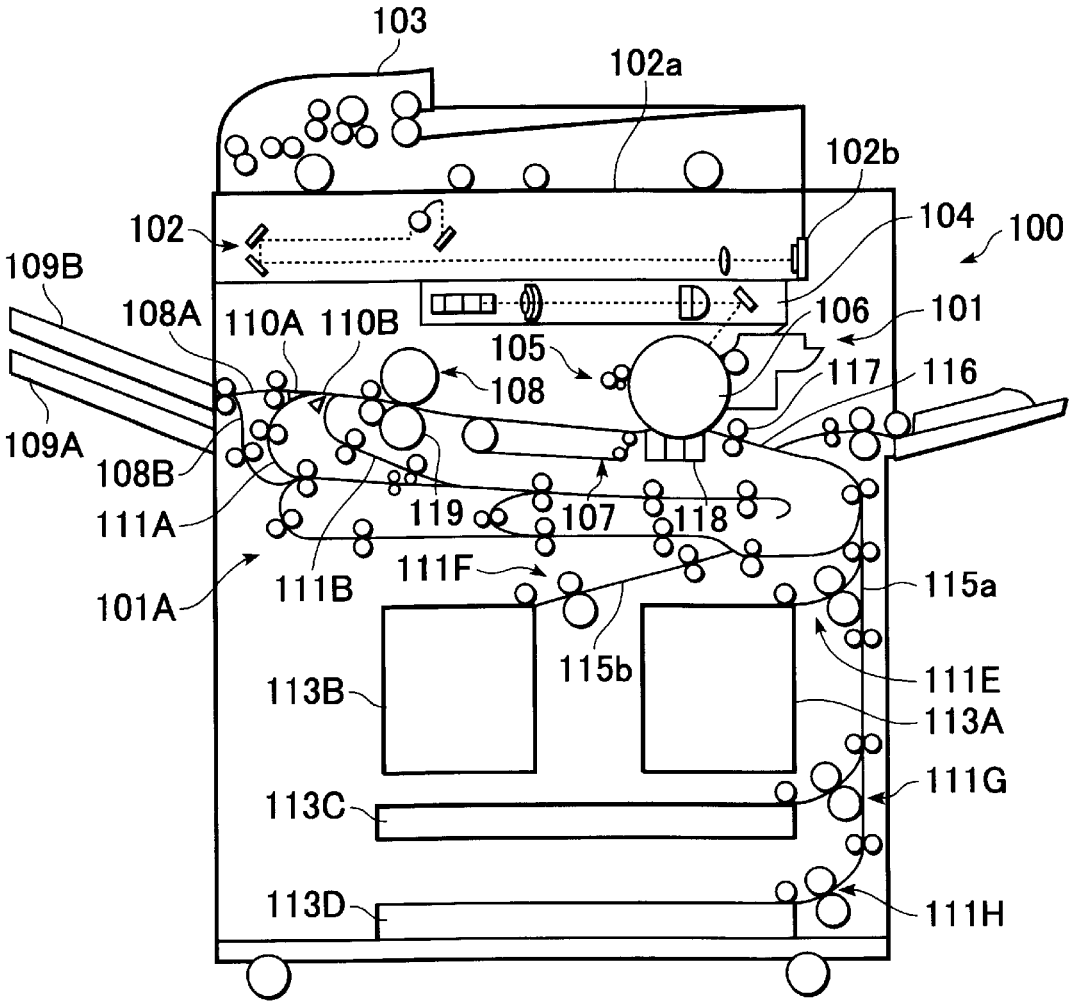
FIG. 16 is a schematic overall view of an image forming apparatus provided with a plurality of sheet ejection trays according to a second embodiment of the present invention.
Figure 20A:
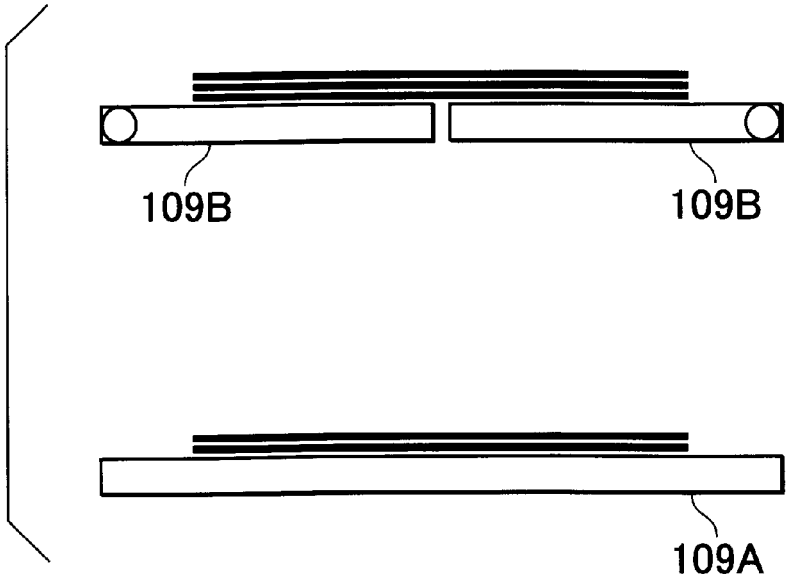
FIGS. 20A and 20B are illustrations showing the operation of the ejecting trays serving as properly combining means.
Figure 20B:
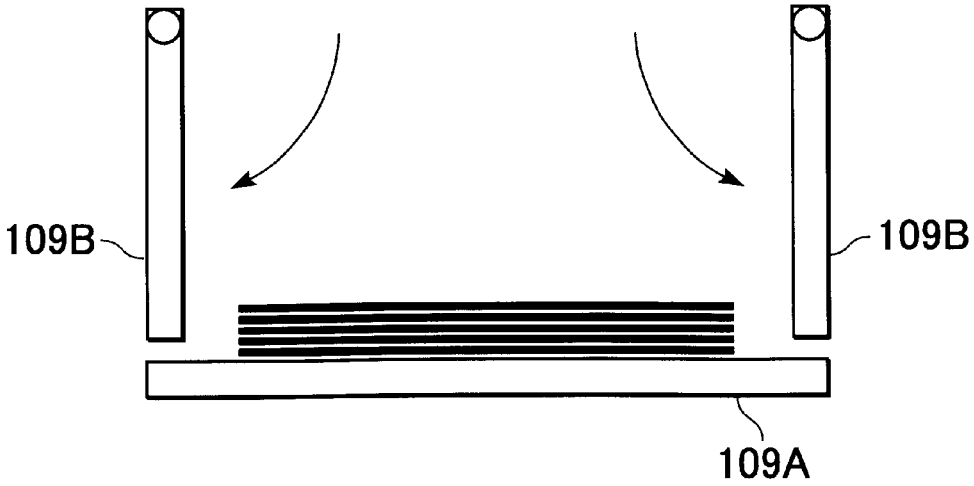

Referring to FIG. 16, the first sheet ejection tray 109A and the second sheet ejection tray 109B are each vertically movable by a motor (not shown) and are able to selectively stack thereon sheets transported through a (first) sheet ejection path 108A or a (second) sheet reversing ejection path 108B. Also, as shown in FIGS. 20A and 20B, the second sheet ejection tray 109B is of a structure allowing the tray to open and close with two leafs from the center by a motor (not shown). By stacking sheets on the second sheet ejection tray 109B as shown in FIG. 20A and then opening, from the state of FIG. 20A, the tray 109B with the two leafs rotated downward from the center as shown in FIG. 20B, the sheets stacked on the tray 109B are dropped so as to stack on the first sheet ejection tray 109A.

In the second embodiment, as with the first embodiment, a description is made of sheet ejection tray control in the case in which one of the reversing outlet paths is unusable because of a jam, a failure or any other reason. Here, the process is described in connection with the duplex copying operation of 10 output sheets, in which the control is performed in sequence as shown in FIGS. 3A, 3B and 3C and FIGS. 4A and 4B, but when the fourth sheet 4 is transported to the first reversing outlet path 120A as shown in FIG. 4C, it does not reach the sixth sensor S6 within a predetermined time because of the so-called delay jam, and the first reversing outlet path 120A becomes unusable. However, since the sheet feed operation is the same as that in the first embodiment, a description of the sheet feed operation is omitted here and the sheet ejection tray control will be described below with reference to a flowchart of FIG. 17.

First, it is determined in step S1701 whether the first reversing outlet path 120A is usable. If usable, it is determined in step S1702 whether the second reversing outlet path 120B is usable. If it is determined in step S1702 that the second reversing outlet path 120B is usable, the ordinary sheet feed operation is performed and output sheets are output to the first sheet ejection tray 109A in output order (step S1704). Then, it is determined in step S1705 whether the last sheet in the relevant job has been output. In this case, it is determined whether the tenth output sheet has been output. If the last sheet has been output, the output operation is completed (step S1706).

Next, if it is determined in step S1701 that the first reversing outlet path 120A is unusable, the passing control is performed (step S1707). The sheet feed operation in the passing control has been described in the first embodiment and hence the description is not repeated here. Also, if it is determined in step S1701 that the first reversing outlet path 120A is usable, it is determined in step S1702 whether the second reversing outlet path 120B is usable. If it is determined that the second reversing outlet path 120B is unusable, the passing control is performed (step S1707). Then, it is determined in step S1708 whether a sheet output to the sheet ejection tray is one prior to the jammed sheet (fourth sheet 4 in this case). If the sheet output to the sheet ejection tray is one (one of the first sheet 1, the second sheet 2 and the third sheet 3 in this case) prior to the jammed sheet (fourth sheet 4 in this case), the output sheet is output to the first sheet ejection tray 109A (step S1709). On the other hand, if the sheet output to the sheet ejection tray is one (one of the fifth to tenth sheets 5 to 10 in this case) subsequent to the jammed sheet (fourth sheet 4 in this case), the output sheet is output to the second sheet ejection tray 109B (step S1710).

Then, it is determined in step S1711 whether the sheet output to the sheet ejection tray is a substituted one (fourth A sheet 4A in this case) for the jammed sheet (fourth sheet 4 in this case). If the output sheet is the substituted one, it is output to the first sheet ejection tray 109A (step S1712). Thereafter, as shown in FIG. 20B, the second sheet ejection tray 109B is opened, whereby the sheets stacked on the second sheet ejection tray 109B are combined with the sheets stacked on the first sheet ejection tray 109A so that all the sheets are put in proper page order (step S1713). The output operation is thus completed (step S1706).

Figure 17:
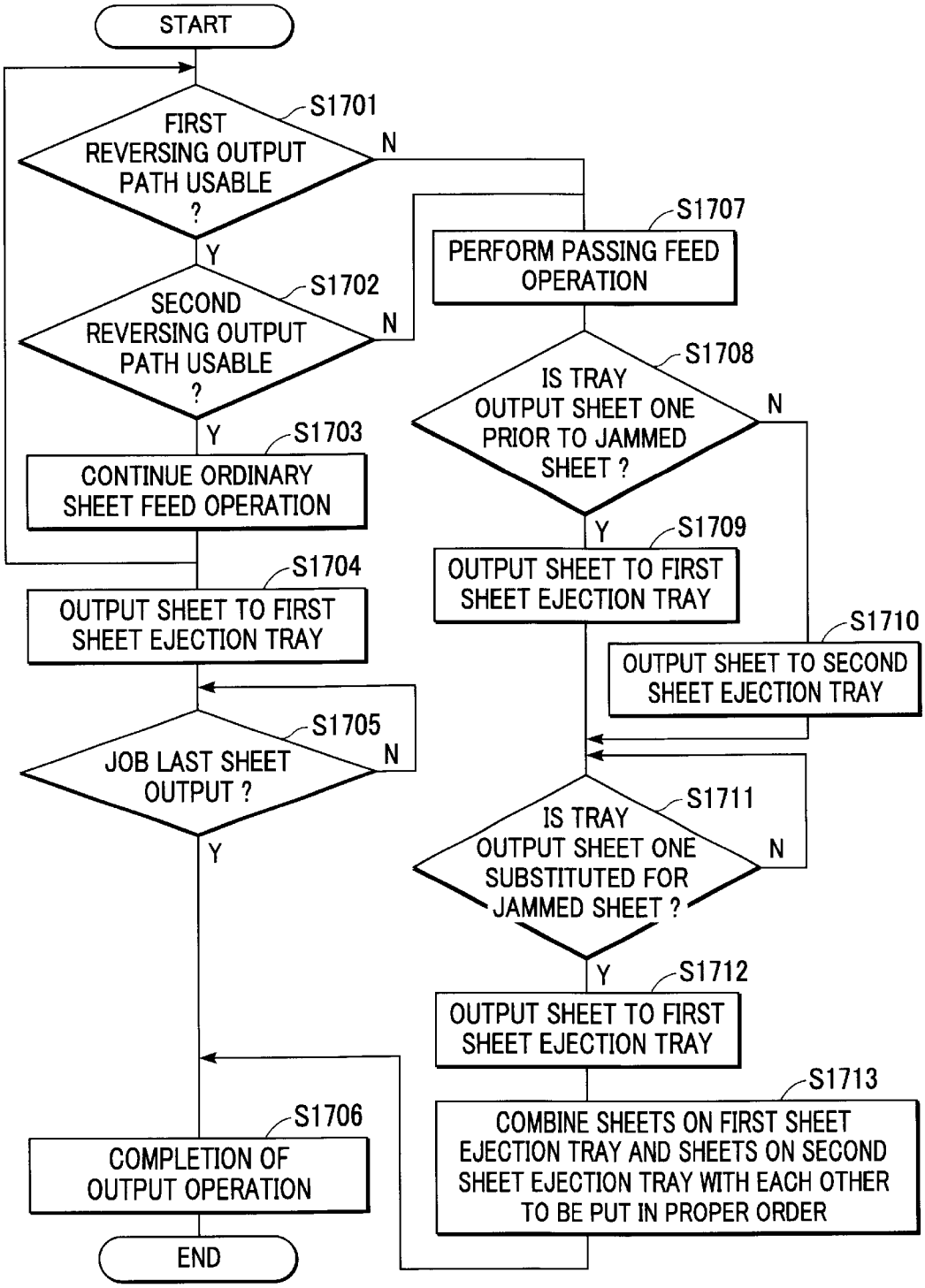
FIG. 17 is a flowchart for control executed in the second embodiment.
Figure 18:
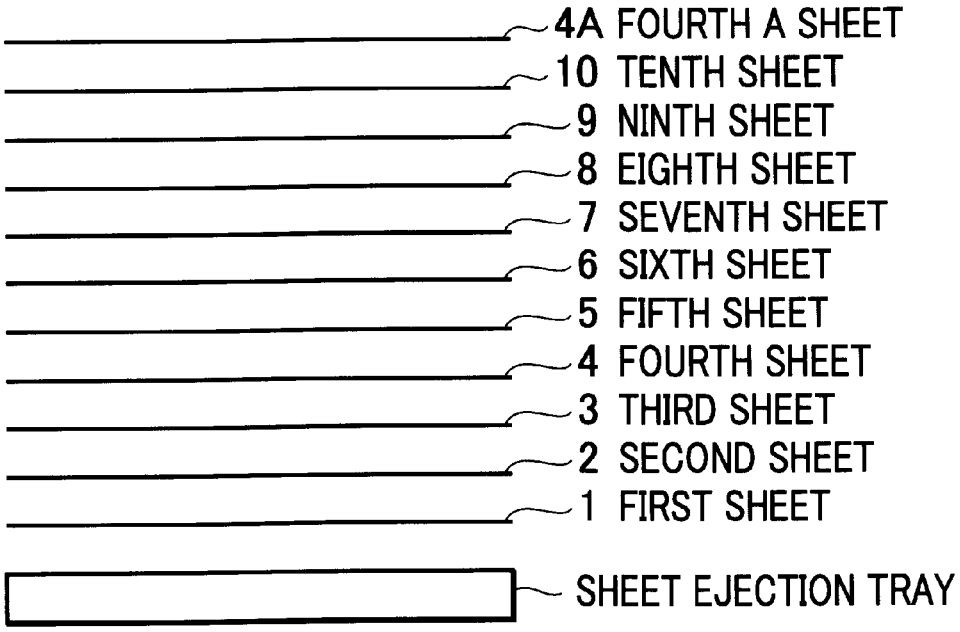
FIG. 18 is an illustration showing the order of output sheets in the first embodiment.
Figure 19:
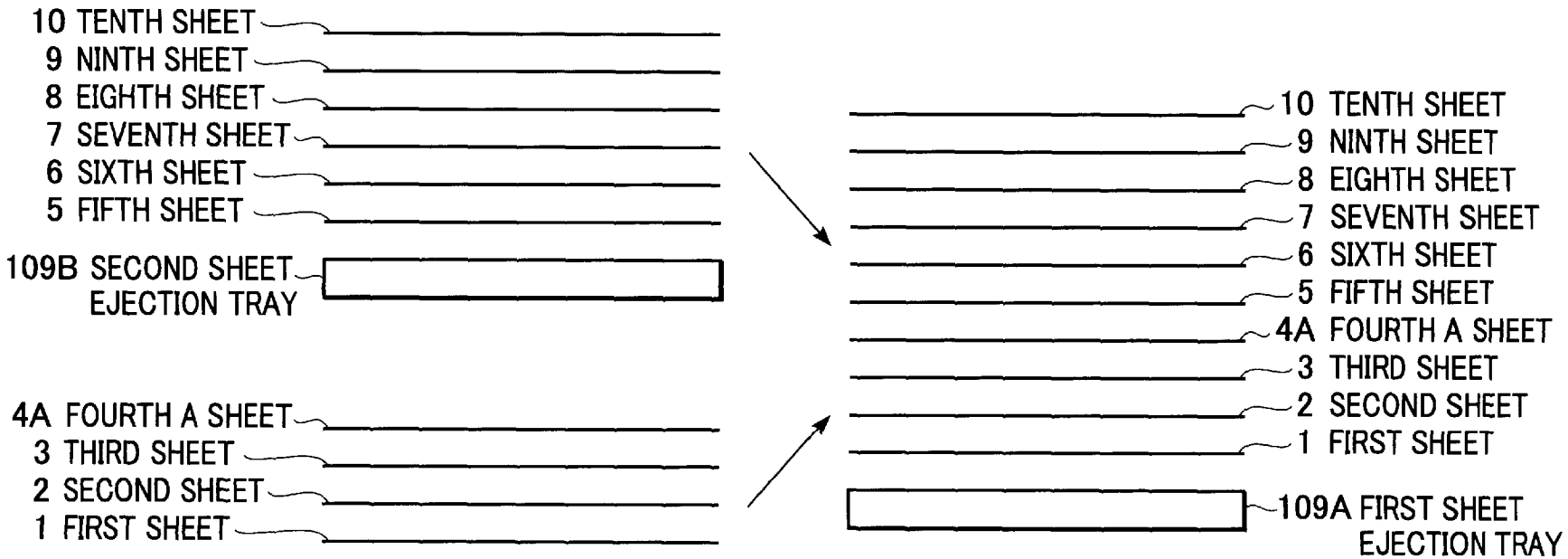
FIG. 19 is an illustration showing the order of output sheets in the second embodiment.

Subsequently, though not shown in the flowchart of FIG. 17, the machine body operates such that, after the completion of the output operation, an indication prompting the user to remove the fourth sheet 4 jammed in the first reversing outlet path 120A is displayed on, e.g., a display unit, and the copying machine is restored to the standby state after confirming that the jammed sheet has been removed. FIG. 18 shows the order of output sheets in the first embodiment, and FIG. 19 shows the order of output sheets in the second embodiment. As easily understood from those drawings, the output sheets are put in proper page order in the second embodiment in spite of the passing control. As described above, even when one of a plurality of reversing outlet paths is unusable because of a jam, a failure or any other trouble, the output operation can be achieved while the output sheets are put in proper page order, by continuing the output operation without stopping the machine and by controlling a plurality of sheet ejection trays. Hence, a copying machine free from the downtime can be provided.

In the above-described second embodiment, the second sheet ejection tray 109B is of the structure capable of opening and closing it with two leaves for combining the output sheets stacked on the first sheet ejection tray 109A and the output sheets stacked on the second sheet ejection tray 109B with each other so that all the output sheets are put in proper page order. Alternatively, an indication may be displayed after the job on a display unit of a control panel, for example, to prompt the user to manually combine the sheets stacked on the first sheet ejection tray 109A and the sheets stacked on the second sheet ejection tray 109B with each other so that all the sheets are put in proper page order.

While the above second embodiment has been described in connection with the case in which the first reversing outlet path 120A is unusable, the present invention is of course applicable to the case in which the second reversing outlet path 120B is unusable. Also, while the above second embodiment has been described in connection with the case in which the first reversing outlet path 120A is unusable, the present invention is of course applicable to the case in which the first reversing inlet path 111A is unusable. Further, while the above second embodiment has been described in connection with the case in which the first reversing outlet path 120A is unusable, the present invention is of course applicable to the case in which the second reversing inlet path 111B is unusable.

While the above description has been made in connection with the copying machine including each pair of reversing inlet paths, reversing paths and reversing outlet paths, the present invention is not limited to such an arrangement, but can be applied to a copying machine including every three or more sets of reversing inlet paths, reversing paths and reversing outlet paths. Also, while the above description has been made in connection with the copying machine including each pair of reversing inlet paths, reversing paths and reversing outlet paths, the present invention is not limited to such an arrangement, but can be applied to a copying machine including one reversing inlet path, plural reversing paths and plural reversing outlet paths as shown in FIG. 14. Further, while the above description has been made in connection with the copying machine including each pair of reversing inlet paths, reversing paths and reversing outlet paths, the present invention is not limited to such an arrangement, but can be applied to a copying machine including one reversing outlet path, plural reversing inlet paths and plural reversing paths as shown in FIG. 15. Additionally, while a stepping motor is employed as the driving source for the sheet feed in the above description, a clutch may be used instead.

Third Embodiment

Figure 21:
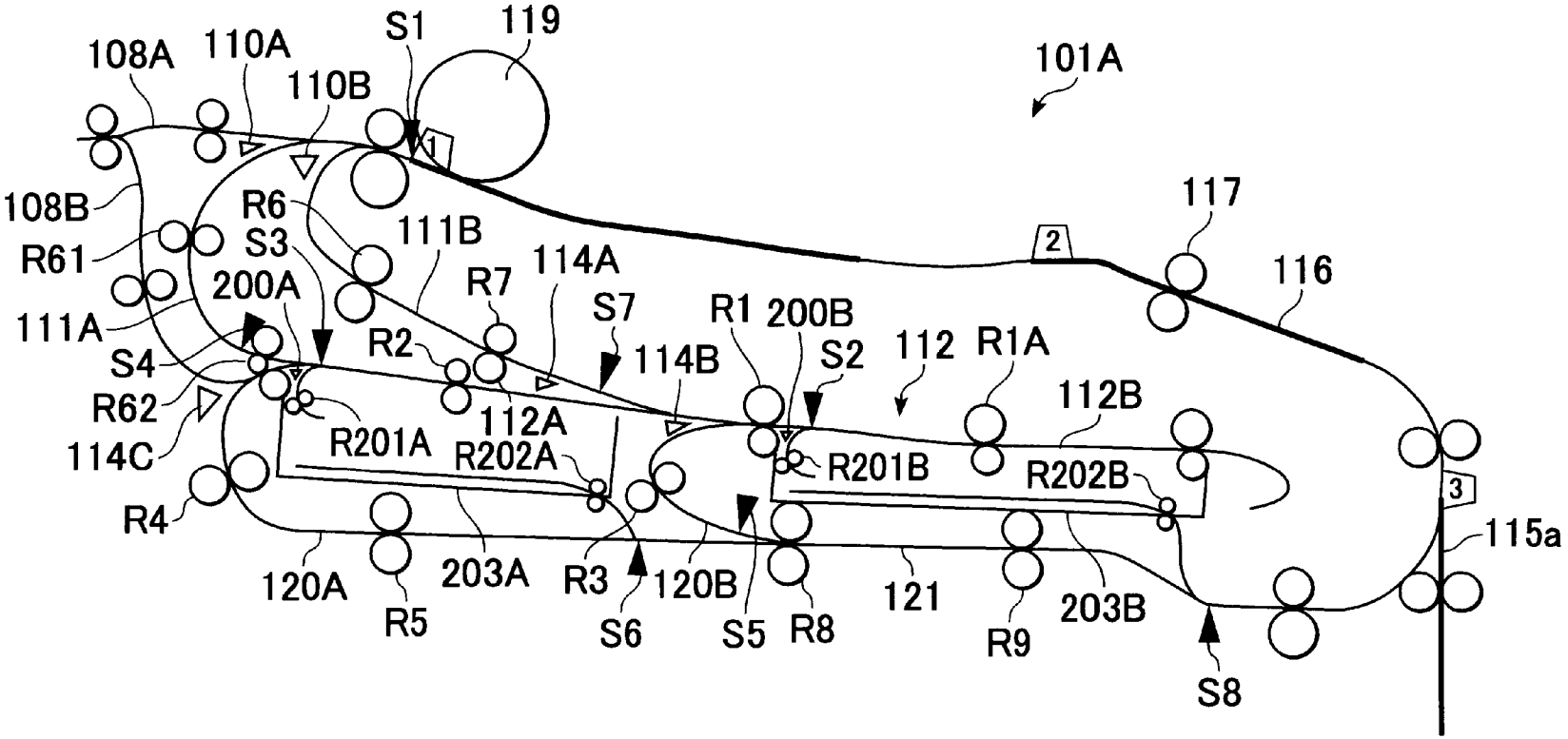
FIG. 21 illustrates a construction of a duplex feed mechanism provided with intermediate trays according to a third embodiment of the present invention.

A third embodiment will be described below. In the third embodiment, a description is made of a method for putting output sheets in proper page order in a different way from the second embodiment. As described above, when the passing control is performed in the first embodiment, the output operation is continued with a sheet left in the unusable feed path, and hence the sequence of output sheets is disordered. In the second embodiment, therefore, output sheets are put in proper page order by controlling a plurality of sheet ejection trays. In the third embodiment, the method for putting output sheets in proper page order is realized by employing and controlling two intermediate stack trays, i.e., a first intermediate tray 203A and a second intermediate tray 203B, as shown in FIG. 21. Since FIG. 21 is the same as FIG. 2 except for a construction regarding the intermediate trays, the following description is made of only a portion regarding control of the intermediate trays.

Referring to FIG. 21, numeral 203A denotes a first intermediate tray and 203B denotes a second intermediate tray. When a sheet transported from the first reversing path 112A is placed in the first intermediate tray 203A, this operation is performed by controlling a first intermediate tray flapper 200A and driving a first-intermediate-tray inlet roller pair R201A. Also, when transporting a sheet from the first intermediate tray 203A to the duplex feed path 121, this operation is performed by driving a first-intermediate-tray outlet roller pair R202A. Likewise, when a sheet transported from the second reversing path 112B is placed in the second intermediate tray 203B, this operation is performed by controlling a second intermediate tray flapper 200B and driving a second-intermediate-tray inlet roller pair R201B. Also, when transporting a sheet from the second intermediate tray 203B to the duplex feed path 121, this operation is performed by driving a second-intermediate-tray outlet roller pair R202B.

In the third embodiment, as with the first and second embodiments, a description is made of sheet ejection tray control in the case in which one of the reversing outlet paths is unusable because of a jam, a failure or any other reason. Here, the process is described in connection with the duplex copying operation of 10 output sheets, in which the control is performed in sequence as shown in FIGS. 3A, 3B and 3C and FIGS. 4A and 4B, but when the fourth sheet 4 is transported to the first reversing outlet path 120A as shown in FIG. 4C, it does not reach the sixth sensor S6 within a predetermined time because of the so-called delay jam, and the first reversing outlet path 120A becomes unusable. However, since the sheet feed operation is the same as that in the first and second embodiments, a description of the sheet feed operation is omitted here and the sheet ejection tray control will be described below with reference to a flowchart of FIG. 22.

First, it is determined in step S2101 whether the first reversing outlet path 120A is usable. If usable, it is determined in step S2102 whether the second reversing outlet path 120B is usable. If it is determined in step S2102 that the second reversing outlet path 120B is usable, the ordinary sheet feed operation is performed and output sheets are output to the sheet ejection tray in output order (step S2104). Then, it is determined in step S2105 whether the last sheet in the relevant job has been output. In this case, it is determined whether the tenth output sheet has been output. If the last sheet has been output, the output operation is completed (step S2106).

Next, if it is determined in step S2101 that the first reversing outlet path 120A is unusable, the passing control is performed (step S2107). The sheet feed operation in the passing control has been described in the first embodiment and hence the description is not repeated here. Thereafter, it is determined in step S2108 whether a sheet transported to the second reversing path 112B is one (one of the fifth to tenth sheets 5 to 10 in this case) subsequent to the jammed sheet (fourth sheet 4 in this case). If it is determined in step S2108 that the sheet transported to the second reversing path 112B is one (one of the fifth to tenth sheets 5 to 10 in this case) subsequent to the jammed sheet (fourth sheet 4 in this case), all of the sheets (fifth to tenth sheets 5 to 10 in this case) subsequent to the jammed sheet are placed in the second intermediate tray 203B (step S2109). Then, it is determined in step S2110 whether the last sheet in the relevant job (tenth sheet 10 in this case) has been placed in the second intermediate tray 203B. If it is determined in step S2110 that the last sheet (tenth sheet 10 in this case) in the relevant job has been placed in the second intermediate tray 203B, it is determined in step S2111 whether a sheet (fourth A sheet 4A in this case) substituted for the jammed sheet has been transported to the feed path 115*a*.

The substituted sheet (fourth A sheet 4A in this case) for the jammed sheet is transported from the second reversing path 112B to the second reversing outlet path 120B without being placed in the intermediate tray, and then transported to the feed path 115*a* through the duplex feed path 121. If it is determined in step S2111 that the substituted sheet (fourth A sheet 4A in this case) for the jammed sheet has been transported to the feed path 115*a*, the sheets placed in the second intermediate tray 203B are transported from it to the duplex feed path 121 in the same order as the one in which they were placed (step S2112). Thereafter, the sheets are output to the sheet ejection tray in accordance with the ordinary feed sequence (step S2104). Then, it is determined in step S2105 whether the last sheet (tenth sheet 10 in this case) in the relevant job has been output. If it is determined that the last sheet (tenth sheet 10 in this case) in the relevant job has been output, the output operation is completed (step S2106).

Further, if it is determined in step S2101 that the first reversing outlet path 120A is usable, it is then determined in step S2102 whether the second reversing outlet path 120B is usable. If it is determined that the second reversing outlet path 120B is unusable, the passing control is performed (step S2113). Thereafter, it is determined in step S2114 whether a sheet transported to the first reversing path 112A is one subsequent to the jammed sheet. If it is determined in step S2114 that the sheet transported to the first reversing path 112A is one subsequent to the jammed sheet, all of the sheets subsequent to the jammed sheet are placed in the first intermediate tray 203A (step S2115). Then, it is determined in step S2116 whether the last sheet in the relevant job (tenth sheet 10 in this case) has been placed in the first intermediate tray 203A. If it is determined in step S2116 that the last sheet in the relevant job has been placed in the first intermediate tray 203A, it is determined in step S2117 whether a sheet substituted for the jammed sheet has been transported to the feed path 115*a*.

The sheet substituted for the jammed sheet is transported from the first reversing path 112A to the first reversing outlet path 120A without being placed in the intermediate tray, and then transported to the feed path 115*a* through the duplex feed path 121. If it is determined in step S2117 that the sheet substituted for the jammed sheet has been transported to the feed path 115*a*, the sheets placed in the first intermediate tray 203A are transported from it to the duplex feed path 121 in the same order as the one in which they were placed (step S2118). Thereafter, the sheets are output to the sheet ejection tray in accordance with the ordinary feed sequence (step S2104). Then, it is determined in step S2105 whether the last sheet in the relevant job has been output. If it is determined that the last sheet in the relevant job has been output, the output operation is completed (step S2106).

Figures 22, 22A:
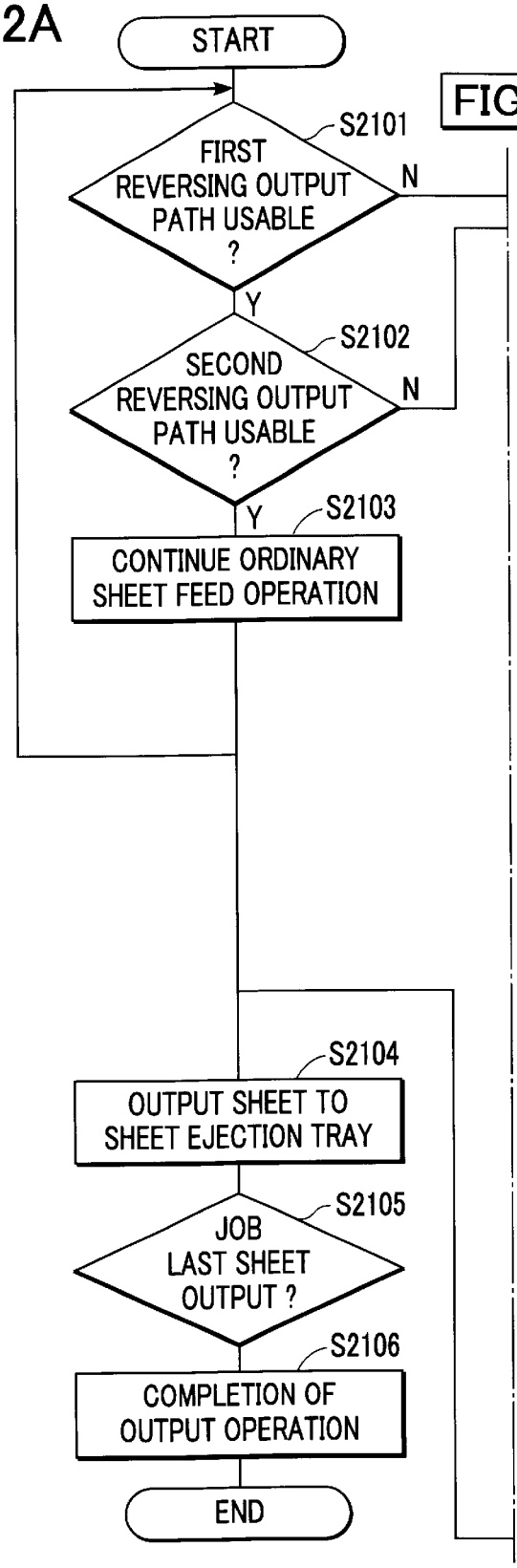
FIG. 22 is a flowchart for control executed in the third embodiment.
Figure 22B:
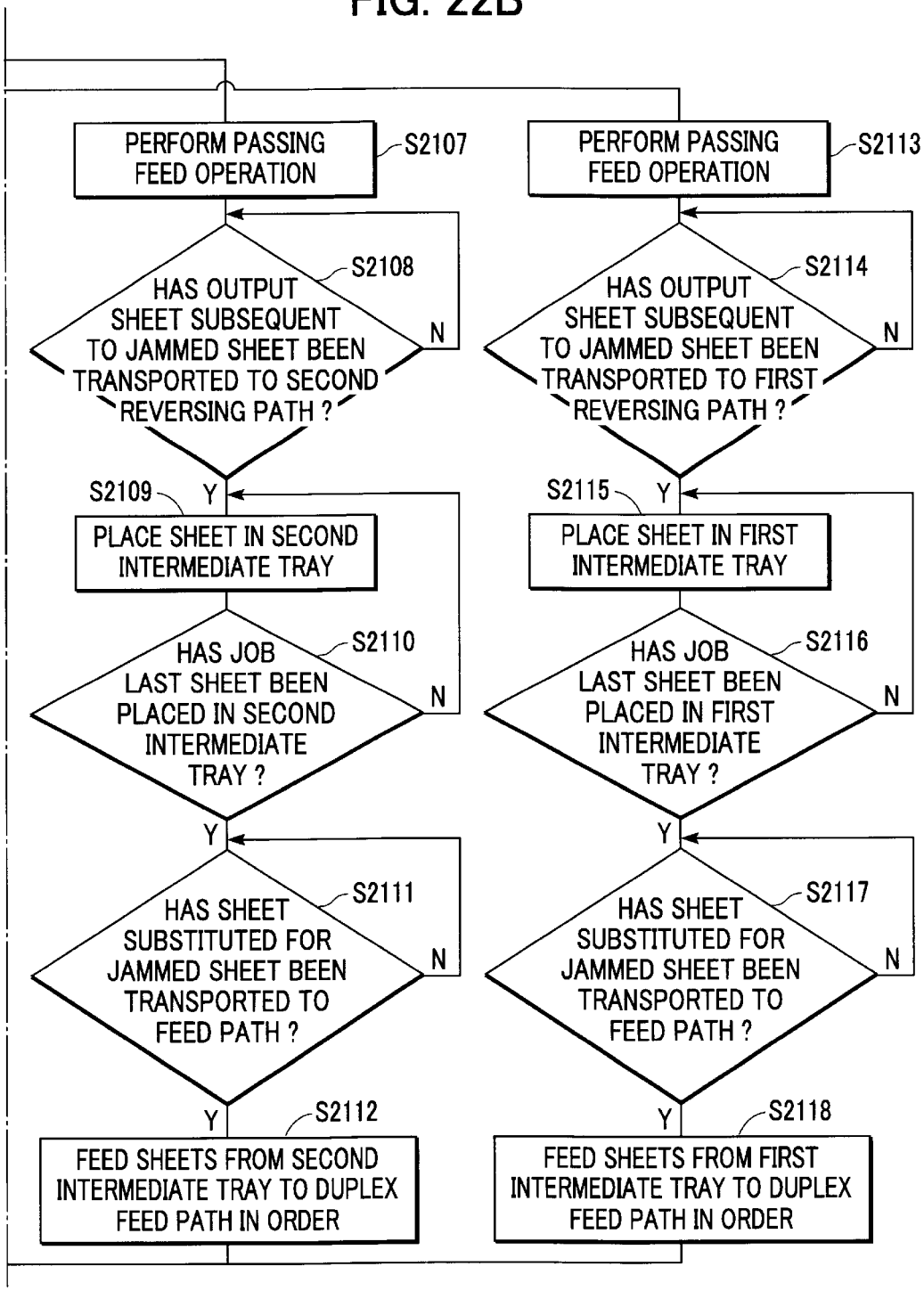
Figure 23:
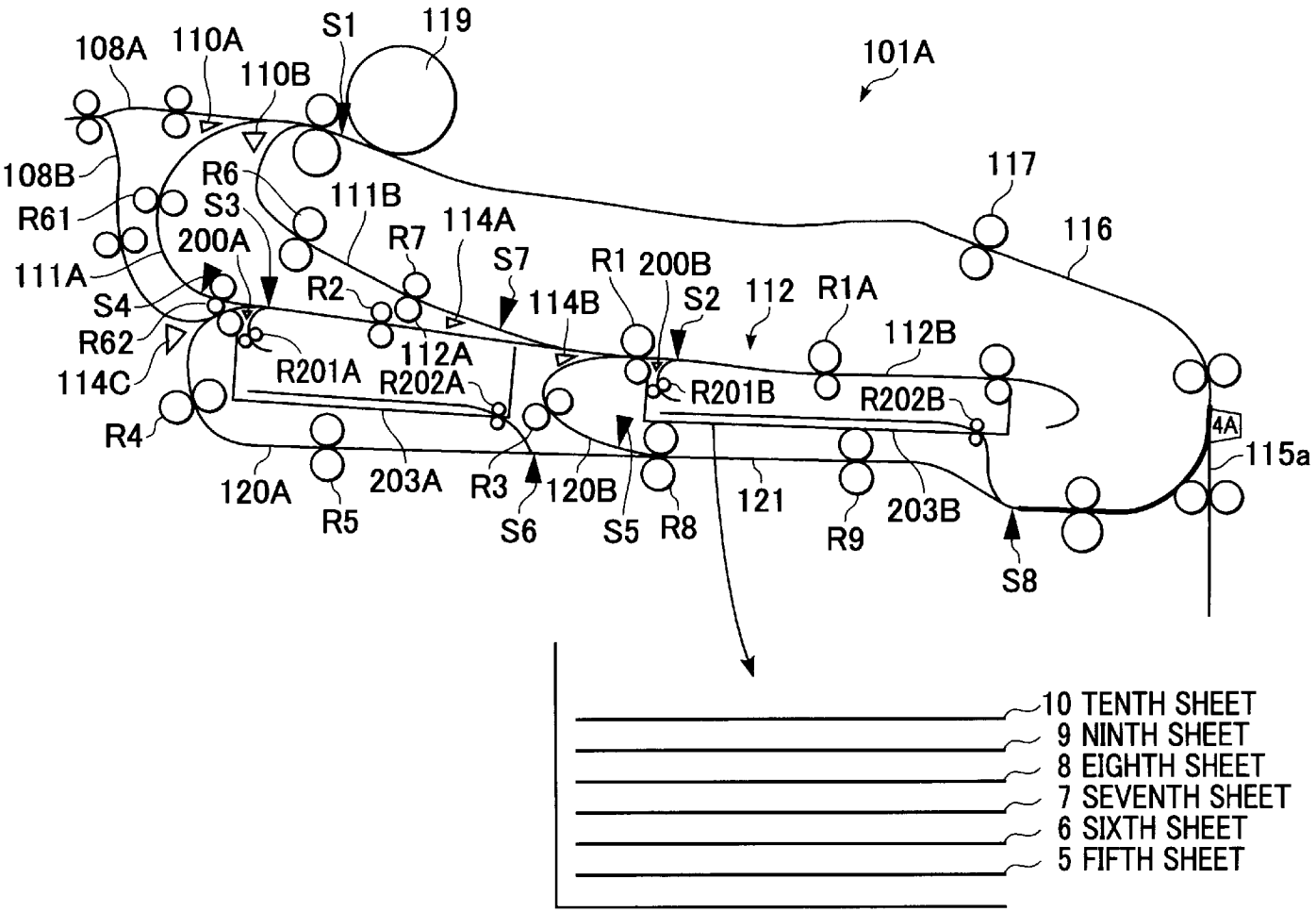
FIG. 23 is an illustration showing the order of sheets stored in the intermediate tray in the third embodiment.

Subsequently, though not shown in the flowchart of FIG. 22, the machine body operates such that, after the completion of the output operation, an indication prompting the user to remove the fourth sheet 4 jammed in the second reversing outlet path 120B is displayed on, e.g., a display unit, and the copying machine is restored to the standby state after confirming that the jammed sheet has been removed. FIG. 23 shows the order of sheets placed in the intermediate tray and the feed of the substituted sheet for the jammed sheet in the third embodiment. As seen from FIG. 23, six sheets from the fifth sheet 5 to the tenth sheet 10 are placed in the intermediate tray in order. Then, after the fourth A sheet 4A substituted for the jammed sheet has been transported to the feed path 115*a* through the second reversing path 112B, the second reversing outlet path 120B and the duplex feed path 121, the sheets placed in the second intermediate tray 203B are transported to the feed path 115*a* in sequence from the fifth sheet 5 subsequent to the fourth A sheet 4A, and are ejected onto the sheet ejection tray in sequence.

Thus, it is easily understood that all of the output sheets are put in proper page order in the third embodiment in spite of the passing control. As described above, even when one of a plurality of reversing outlet paths is unusable because of a jam, a failure or any other trouble, the output operation can be achieved while the output sheets are put in proper page order, by continuing the output operation without stopping the machine and by controlling a plurality of intermediate trays. Hence, a copying machine free from the downtime can be provided.

While the above third embodiment has been described in connection with the case in which the first or second reversing outlet path 120A, 120B is unusable, the present invention is applicable to the case in which one of the first and second reversing inlet paths 111A, 111B is unusable. While the above description has been made in connection with the copying machine including each pair of reversing inlet paths, reversing paths and reversing outlet paths, the present invention is not limited to such an arrangement, but can be applied to a copying machine including every three or more sets of reversing inlet paths, reversing paths and reversing outlet paths. Also, while the above description has been made in connection with the copying machine including each pair of reversing inlet paths, reversing paths and reversing outlet paths, the present invention is not limited to such an arrangement, but can be applied to a copying machine including one reversing inlet path, plural reversing paths and plural reversing outlet paths as shown in FIG. 14. Additionally, while a stepping motor is employed as the driving source for the sheet feed in the above description, a clutch may be used instead.

Fourth Embodiment

A fourth embodiment of the present invention will be described below with reference to FIGS. 24 and 25.

Figure 24:
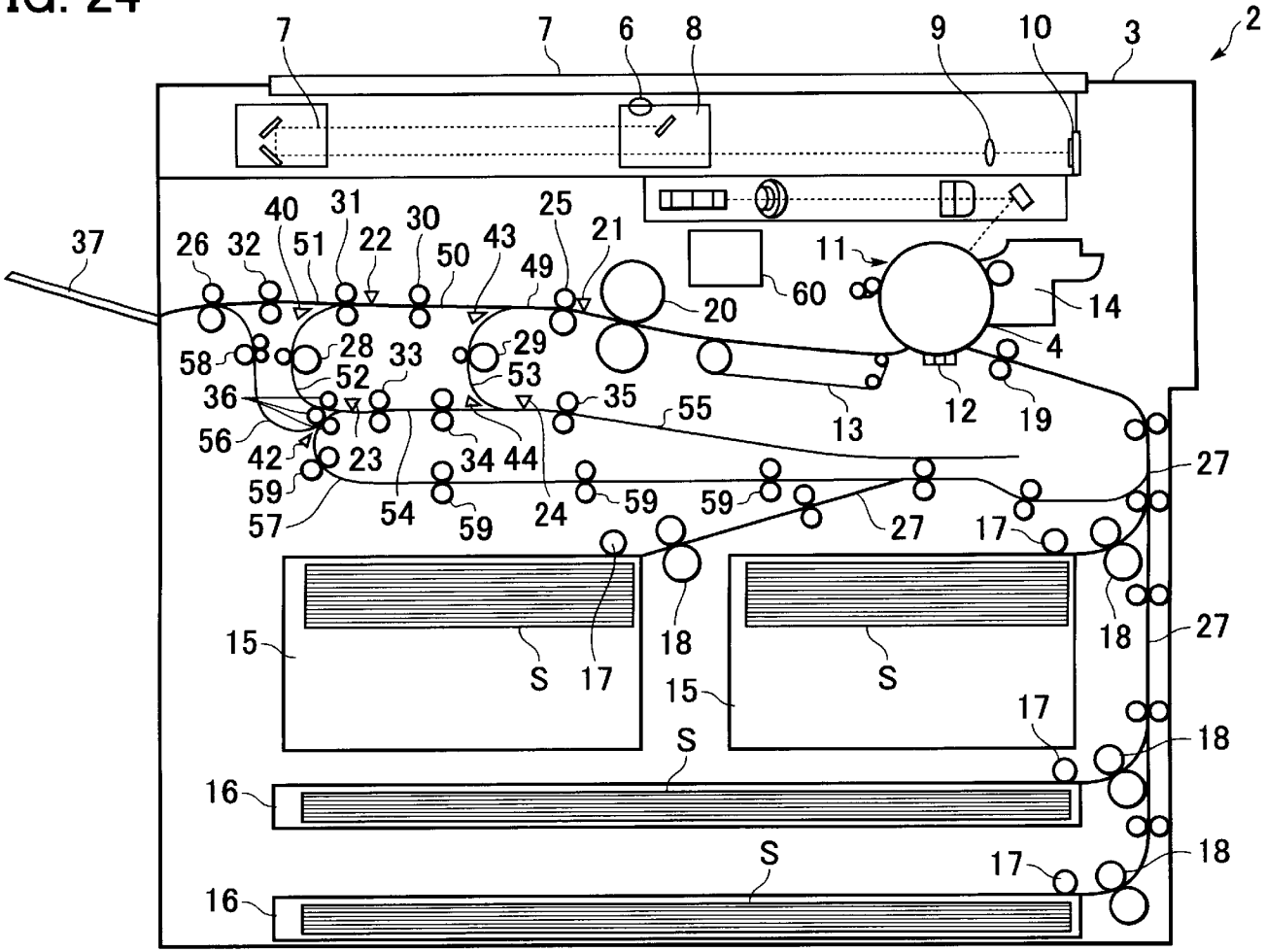
FIG. 24 is a schematic front sectional view of an image forming apparatus according to a fourth embodiment of the present invention.
Figure 25:
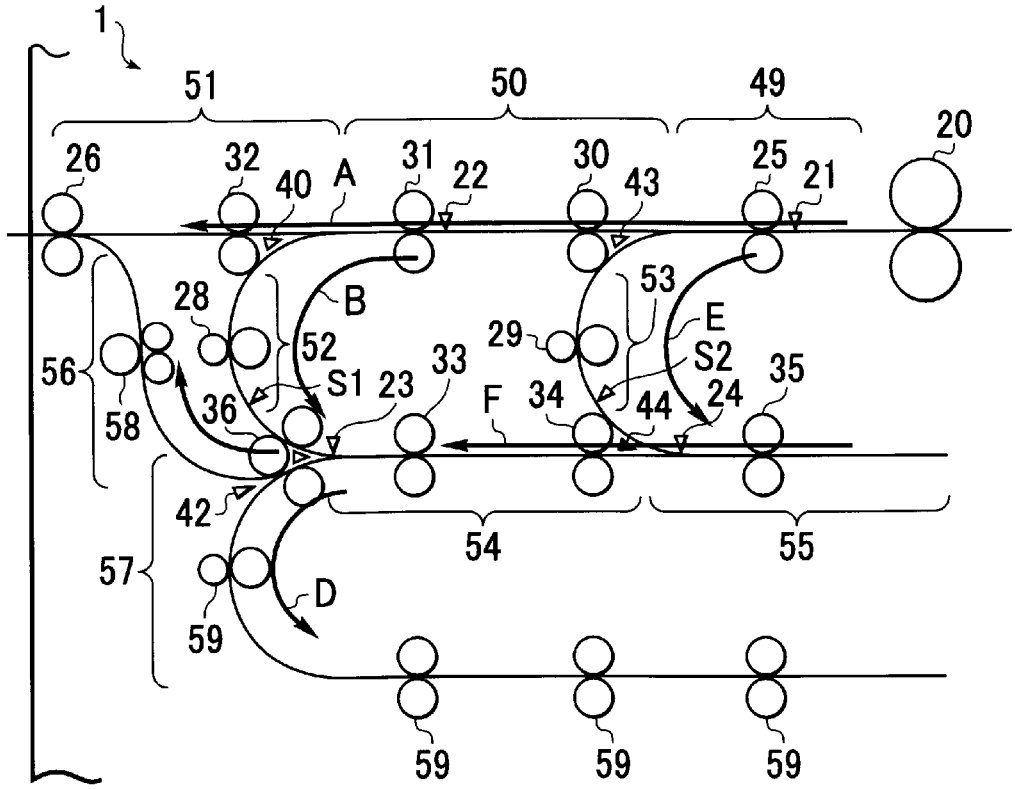
FIG. 25 is a detailed view of a main sheet feed section shown in FIG. 24.

In a copying machine 2, shown in FIG. 24, as one example of an image forming apparatus, a machine body 3 includes a plurality of sheet supply decks 15 and a sheet supply cassettes 16. Sheet S of different sizes are stacked in the sheet supply decks 15 and the sheet supply cassettes 16, and are selectively supplied to an image forming unit 11. The body 3 of the copying machine serves also as a body for a sheet feed mechanism 1 shown in FIG. 25.

The sheets S stacked in the sheet supply decks 15 and the sheet supply cassettes 16 are each fed out to a sheet feed path 27 by a let-out roller 17 in sequence from a top sheet, and then guided to the image forming unit 11 (described later) along the sheet feed path 27.

The sheets S let out by the let-out roller 17 are separated one by one by a separation roller pair 18 comprising a feed roller and a retard roller, and then fed to a register roller pair 19 through the sheet feed path 27. When the leading end of the fed sheet S abuts against a nip of the register roller pair 19, the sheet forms a predetermined loop so that its skewed state is corrected.

The sheet S, of which its skewed state has been corrected, is transported to a gap between a photoconductive drum 4 and a transfer charger 12 in the image forming unit 11 by the register roller pair 19 that starts rotation at the timing such that the sheet is aligned with the position of a toner image on the rotating photoconductive drum 4. In that gap, the toner image on the photoconductive drum 4 is transferred onto the sheet S by the transfer charger 12.

In the copying machine 2, an image of a document set on a platen glass 5 is read by a CCD 10 through an optical system comprising an illumination lamp 6, reflecting mirrors 7, 8, a zoom lens 9, and so on. A laser beam is irradiated to the photoconductive drum 4 using a laser scanner after desired image processing. An electrostatic latent image is thereby formed on the photoconductive drum 4, and the latent image is visualized into a toner image with a black toner supplied from a developing device 14. The sheet S, onto which the toner image has been transferred in the image forming unit 11, is transported to a fusing unit 20 by a feed belt 13, and the toner image is fused on the sheet S by the fusing unit 20.

A construction of the sheet feed mechanism 1 in this fourth embodiment will now be described with reference to FIG. 25.

Downstream of the fusing unit 20, an inner sheet straight feed path 49, a sheet straight feed path 50, and an ejection path 51 are disposed in a linearly continuous arrangement. An inner sheet ejection roller pair 25 is disposed in the inner sheet straight feed path 49, sheet ejection roller pairs 30, 31 are disposed in the sheet straight feed path 50, and a sheet ejection roller pair 32 and an outer sheet ejection roller pair 26 are disposed in the ejection path 51. The ejection path 51 is open to the outside of the copying machine 2 and guides the transported sheet S to be ejected onto a sheet ejection tray 37. The inner sheet straight feed path 49, the sheet straight feed path 50, the ejection path 51, the inner sheet ejection roller pair 25, the sheet ejection roller pairs 30, 31, the sheet ejection roller pair 32, and the outer sheet ejection roller pair 26 constitute main feed means in the present invention.

A first reversing inlet path 52 is branched from the downstream side of the sheet straight feed path 50, and a flapper 40 is disposed at a branch point so that the sheet S can be selectively transported to one of the ejection path 51 and the first reversing inlet path 52. Also, a second reversing inlet path 53 is branched from the downstream side of the inner sheet straight feed path 49, and a flapper 43 is disposed at a branch point so that the sheet S can be selectively transported to one of the sheet straight feed path 50 and the second reversing inlet path 53.

The first reversing inlet path 52 is connected to a first reversing path 54, the second reversing inlet path 53 is connected to a second reversing path 55, and the first reversing path 54 and the second reversing path 55 are linearly connected to each other. The sheet S transported from the first reversing inlet path 52 to the first reversing path 54 and the sheet S transported from the second reversing inlet path 53 to the second reversing path 55 are each reversed from a face-up to a face-down state. A continuous feed path constituted by the inner sheet straight feed path 49, the sheet straight feed path 50 and the ejection path 51 is arranged substantially parallel to a continuous feed path constituted by the first reversing path 54 and the second reversing path 55. The first reversing inlet path 52 and the first reversing path 54 may serve as first sheet backward feed means in the present invention, and the second reversing inlet path 53 and the second reversing path 55 may serve as second sheet backward feed means in the present invention.

At a junction point of the first reversing path 54 and the first reversing inlet path 52, a sheet reversing ejection path 56 as reversed sheet feed means and a duplex feed path 57 as sheet duplex feed means in the present invention join with each other. The sheet S is transported from the first reversing path 54 to a junction point of the sheet reversing ejection path 56 and the duplex feed path 57 through a three-roller unit 36. A flapper 42 is disposed at the junction point of the sheet reversing ejection path 56 and the duplex feed path 57 so that the sheet S is selectively transported to one of the sheet reversing ejection path 56 and the duplex feed path 57.

The sheet reversing ejection path 56 joins with the ejection path 51 at a point upstream of the outer sheet ejection roller pair 26 for returning the sheet S, which is transported from the first reversing inlet path 52 or the second reversing inlet path 53, to the ejection path 51, whereby the sheet S is ejected after being reversed from a face-up to face-down state. A curl removing roller unit 58 comprising three rollers is disposed in the sheet reversing ejection path 56 for giving the sheet S a curl in an opposed direction to that given to it through the first reversing inlet path 52 or the second reversing inlet path 53, whereby the sheet S can be ejected in a flat condition.

The duplex feed path 57 joins with the sheet feed path 27 (shown in FIG. 24) and serves to re-feed the sheet S having an image formed on the front side to the image forming unit 11 so that an image is formed on the rear side for the so-called duplex copying. A plurality of return roller pairs 59 for re-feeding the sheet are disposed along the duplex feed path 57.

Sheet detecting sensors for detecting the sheet S are disposed midway the above-mentioned feed paths. More specifically, a first inner sheet ejection sensor 21 is disposed upstream of the inner sheet ejection roller pair 25, and a second inner sheet ejection sensor 22 is disposed upstream of the sheet ejection roller pair 31. A first reversal sensor 23 is disposed upstream of the three-roller unit 36, and a second reversal sensor 24 is disposed downstream of the re-feed roller pair 35.

The above-mentioned rollers and flappers are controlled by a CPU (which may serve as control means) 60, shown in FIG. 24, in accordance with sheet detection information obtained from the above-mentioned sensors. The operation of the copying machine thus constructed will be described below.

Face-up Sheet Ejection Mode in Single-Sided Copying

In the case of face-up sheet ejection mode in single-sided copying, the flappers 43 and 40 disposed at the respective branch points are switched over so as to transport the sheet S in a direction A. Then, as shown in FIG. 25, the sheet S, which has been subjected to the fusing of the toner image, is transported on the inner sheet straight feed path 49, the sheet straight feed path 50 and the ejection path 51 by the inner sheet ejection roller pair 25 and the sheet ejection roller pairs 30, 31, 32 until reaching the outer sheet ejection roller pair 26. Following this, the sheet S is ejected onto the sheet ejection tray 37 outside the copying machine body by the outer sheet ejection roller pair 26 in a state in which the image formed surface (front side) of the sheet faces up (face-up sheet ejection).

Duplex Copying Mode

In the case of duplex (double-sided) copying mode, the CPU 60 switches over the flapper 43 so as to transport the sheet S in the direction A, whereupon the sheet S having an image formed on the front side and transported from the inner sheet ejection roller pair 25 is introduced to the sheet straight feed path 50 and passes the sheet ejection roller pairs 30, 31. Further, the CPU 60 switches over the flapper 40 so as to transport the sheet S in a direction B, whereupon the sheet S is transported to the first reversing inlet path 52 and then advanced in the direction B by the re-feed roller pairs 33, 34 and 35.

At the time when the tailing end of the sheet S having entered the first reversing path 54 has passed the three-roller unit 36, the flapper 42 is switched over so as to transport the sheet S in a direction D, and the re-feed roller pairs 33, 34 and 35 are rotated backward, whereby the sheet S is transported to the duplex feed path (sheet re-feed path) 57 in a state in which the image formed surface of the sheet faces up. Then, the sheet S is re-fed by the return roller pairs 59 in the duplex feed path 57 to the image forming unit 11 in which an image formed on the rear wide of the sheet.

Thereafter, the toner image on the sheet S is fused by the fusing unit 20, and the sheet S is ejected onto the sheet ejection tray 37 through the inner sheet straight feed path 49, the sheet straight feed path 50 and the ejection path 51.

In the duplex copying mode, the sheet may be reversed using only the first reversing inlet path 52 and then transported to the duplex feed path 57. As an alternative, the sheet may be reversed using the first reversing inlet path 52 and the second reversing inlet path 53 alternately and then transported to the duplex feed path 57. In the latter case, the sheet S is introduced to the second reversing inlet path 53 by the flapper 43, and at the time when the tailing end of the sheet S has passed the flapper 44, the flapper 44 is switched over so as to transport the sheet S in a direction F. Then, the re-feed roller pairs 33, 34 and 35 are rotated backward to transport the sheet S toward the three-roller unit 36. Thereafter, the sheet S is re-fed to the image forming unit 11 through the duplex feed path 57.

By transporting the sheet to the duplex feed path 57 while reversing it using the first reversing inlet path 52 and the second reversing inlet path 53 alternately, productivity can be improved. In other words, because speed-up control, which has been performed in reversing the sheet in the past, is no longer required and a speed-up rate is suppressed to a small value, an increase of the motor cost can be held down. Additionally, the productivity can be further improved by employing the so-called alternate sheet supply scheme in which the sheet having an image formed on the front side is re-fed to the image forming unit 11 in an alternate relation to a sheet having no image formed thereon and supplied from the sheet supply deck 15 or the sheet supply cassette 16.

Face-down Sheet Ejection Mode in Single-Sided Copying

In the case of face-down sheet ejection mode in single-sided copying, the sheets S each having an image formed on the front side and successively transported from the inner sheet ejection roller pair 25 are advanced as follows. The CPU 60 switches over the flapper 43 so as to transport a preceding sheet in the direction A, whereupon the preceding sheet is introduced to the sheet straight feed path 50. Further, the CPU 60 switches over the flapper 40 so as to transport the sheet in the direction B, whereupon the preceding sheet is transported to the first reversing inlet path 52. Then, the CPU 60 switches over the flapper 43 so as to transport a succeeding sheet in a direction E, whereupon the succeeding sheet is transported to the second reversing inlet path 53.

Thereafter, the flapper 42 is switched over so as to transport the sheet in a direction C, and at the time when the tailing end of the preceding sheet has passed the three-roller unit 36, the re-feed roller pairs 33, 34 are rotated backward, whereby the preceding sheet is transported to the outer sheet ejection roller pair 26. Also, at the time when the tailing end of the succeeding sheet has passed the flapper 44, the flapper 44 is switched over so as to transport the sheet in the direction F. Then, the re-feed roller pairs 33, 34 and 35 are rotated backward, whereby the succeeding sheet is transported to the outer sheet ejection roller pair 26 after the preceding sheet. Accordingly, the preceding sheet and the succeeding sheet are successively ejected onto the sheet ejection tray 37 outside the copying machine body by the outer sheet ejection roller pair 26 in a state in which the image-formed (front) side of each sheet faces down.

Thus, sheets are alternately transported to the first reversing inlet path 52 and the second reversing inlet path 53 one by one so that the sheets having imaged formed thereon are successively ejected while the image formed surface of each sheet faces down. As a result, the productivity of the copying machine 2 can be improved without reducing the sheet interval.

The control operation executed by the CPU 60 in the face-up sheet ejection mode in single-sided copying, the duplex copying mode, and the face-down sheet ejection mode in single-sided copying will be described below with reference to flowcharts of FIGS. 26 to 29.

Face-up Sheet Ejection Mode in Single-Sided Copying

Figure 26:
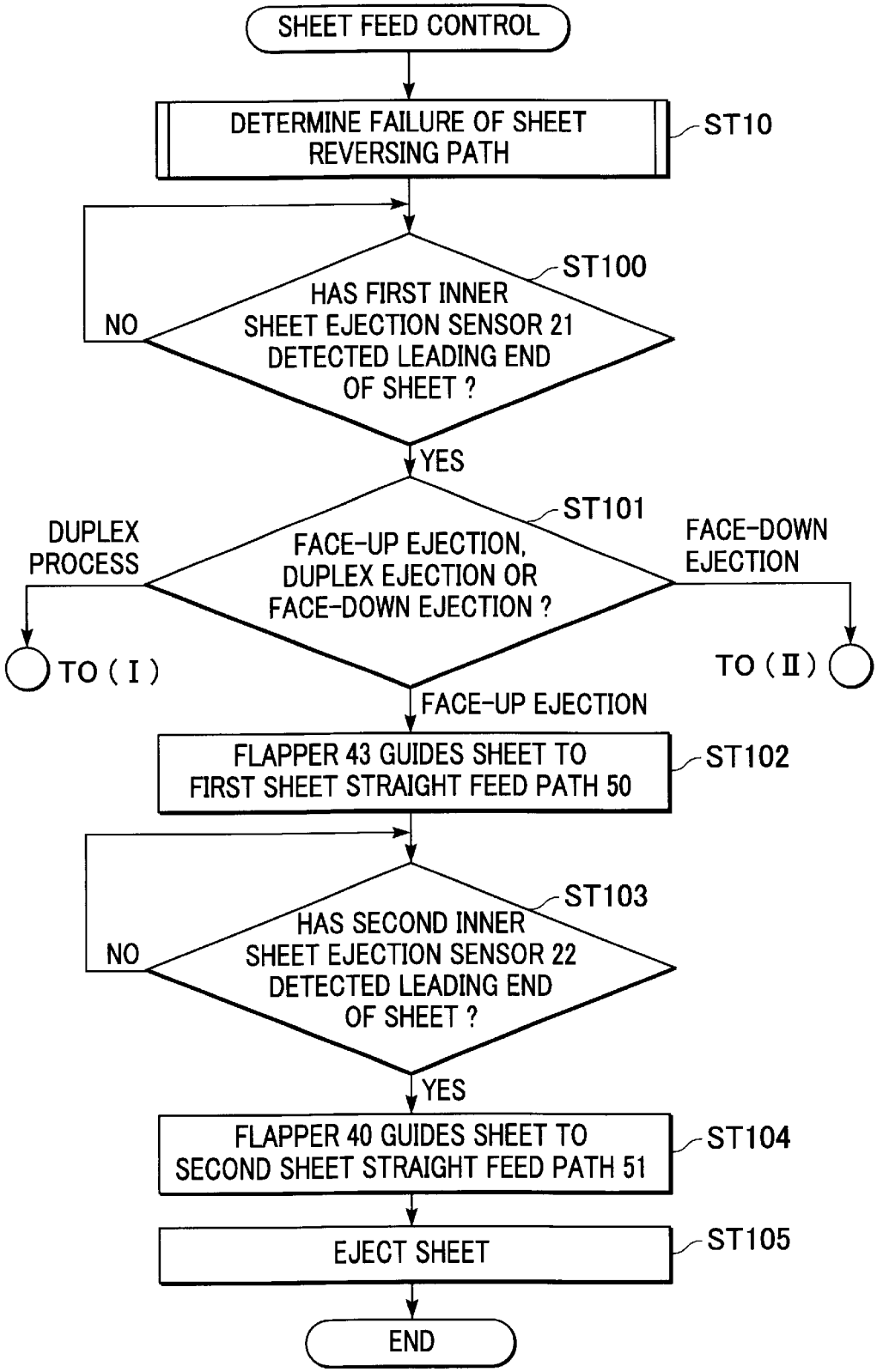
FIG. 26 is a flowchart for sheet feed control in the face-up sheet ejection mode in the image forming apparatus of FIG. 24.

The operation in the face-up sheet ejection mode in single-sided copying is described with reference to FIG. 26. Sheet feed control is common to the face-up sheet ejection mode, the duplex copying mode, and the face-down sheet ejection mode. First, whether there is a failure in the sheet reversing path is determined (step 10; hereinafter "step" is abbreviated to "ST"). The process of determining a failure in the sheet reversing path is described later with reference to FIG. 29.

Figure 28A:
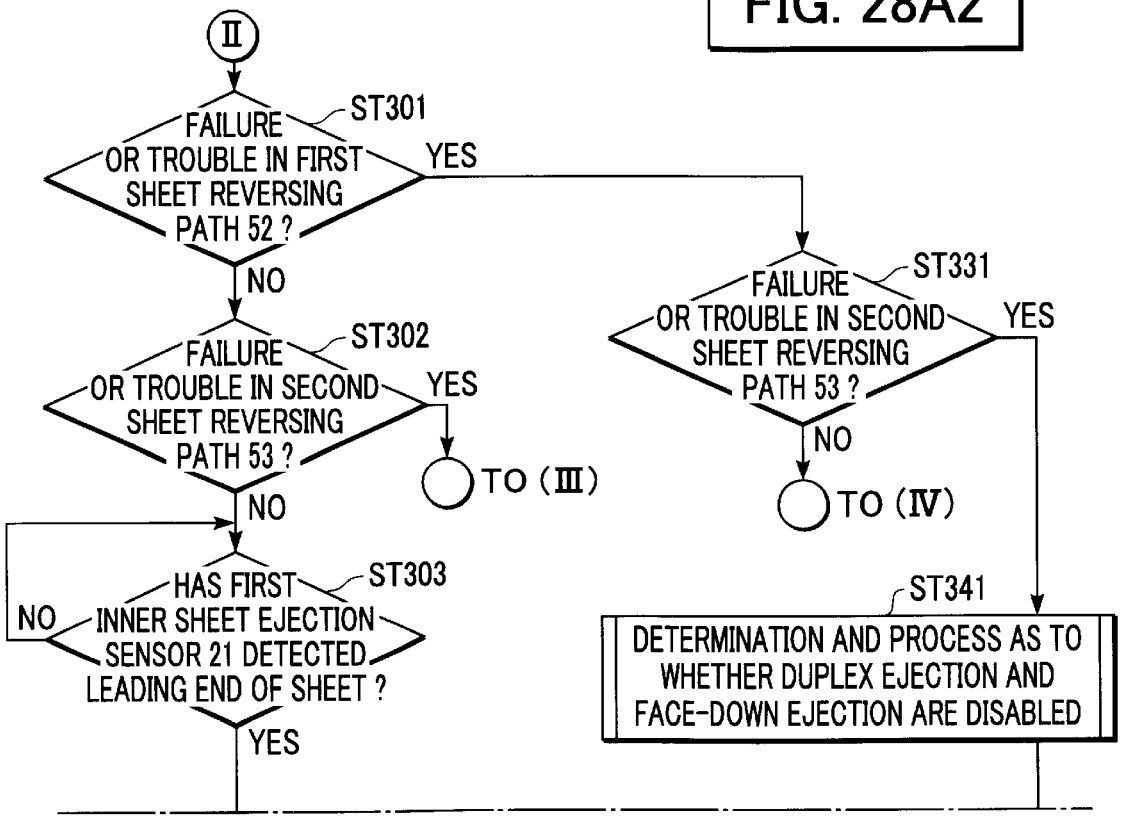
FIGS. 28A to 28C are flowcharts, continued from FIG. 26, showing the face-down sheet ejection mode in the image forming apparatus of FIG. 24.

The leading end of the sheet S, which has been subjected to the fusing of the toner image by the fusing unit 20, is detected by the first inner sheet ejection sensor 21 (ST100). Then, a signal for carrying out the single-sided copying on a sheet, whose size is known in advance, is input to the copying machine (ST101). Note that the control flow proceeds to (I: FIG. 27) if the duplex copying (ejection) is determined in ST101, and proceeds to (II: FIG. 28A) if the face-down ejection is determined in ST101.

The CPU 60 switches over the flapper 43 so as to transport the sheet in the direction A, whereupon the sheet is guided to the sheet straight feed path 50 (ST102). Then, the leading end of the sheet is detected by the second inner sheet ejection sensor 22 (ST103). The CPU 60 switches over the flapper 40 so as to transport the sheet in the direction A, whereupon the sheet is guided to the outer sheet ejection roller pair 26 (ST104). Subsequently, the sheet is ejected onto the sheet ejection tray 37 outside the copying machine body by the outer sheet ejection roller pair 26 in a state in which the image formed surface of the sheet faces up (ST105).

Duplex Copying Mode

The operation in the duplex copying mode will be described below with reference to FIG. 27. When a signal for carrying out the duplex copying on a sheet, whose size is known in advance, is input to the copying machine, the CPU 60 executes a step of determining a failure in the sheet reversing path (ST10, see FIG. 26). Note that the timing of executing the failure determination is not limited to a period during the image forming operation.

Following the determination in ST10, it is first confirmed whether there is neither failure nor trouble in the first reversing inlet path 52 (ST201). If it is confirmed that there is neither failure nor trouble in the first reversing inlet path 52, the CPU 60 switches over the flapper 43 so as to transport the sheet in the direction A, whereupon the sheet is guided to the sheet straight feed path 50 (ST202). On the other hand, if it is confirmed that there is a failure or trouble in the first reversing inlet path 52, it is confirmed whether there is neither failure nor trouble in the second reversing inlet path 53 (ST211).

After the sheet has been guided to the sheet straight feed path 50 in ST202, the leading end of the sheet is detected by the second inner sheet ejection sensor 22 (ST203). The CPU 60 switches over the flapper 40 so as to transport the sheet in the direction B, whereupon the sheet is guided to the first reversing inlet path 52 (ST204).

After the lapse of a predetermined time, the CPU 60 starts forward rotation of a stepping motor (not shown) for driving the re-feed roller pair 33 (including the re-feed roller pair 34 depending on the sheet size) (ST205). The three-roller unit 36 is already rotated at this time, and the sheet is guided to the first reversing path 54 (ST206). Substantially at the same time as when the first reversal sensor 23 detects the tailing end of the sheet (ST207), the CPU 60 starts backward rotation of the stepping motor (not shown) for driving the re-feed roller pair 33 (including the re-feed roller pair 34 depending on the sheet size) (ST208). Further, at the same time, the CPU 60 switches over the flapper 42 so as to transport the sheet in the direction D, whereupon the sheet is transported to the duplex feed path 57 (ST231).

The three-roller unit 36 includes a not-shown elastic member (e.g., a PET sheet) that serves as a valve for always guiding the direction of the sheet, which has been transported to the first reversing path 54, toward the junction point of the sheet reversing ejection path 56 and the duplex feed path 57 while preventing the sheet from being returned to the first reversing inlet path 52.

Further, in ST211 of confirming whether there is neither failure nor trouble in the second reversing inlet path 53, if it is confirmed that there is neither failure nor trouble in the second reversing inlet path 53, the CPU 60 switches over the flapper 43 so as to transport the sheet in the direction E, whereupon the sheet is guided to the second reversing inlet path 53 (ST212). On the other hand, if it is confirmed that there is a failure or trouble in the second reversing inlet path 53, it is concluded that a failure or trouble occurs in both the first reversing inlet path 52 and the second reversing inlet path 53, whereupon the image forming process is suspended based on the determination that the duplex copying and the face-down ejection are disabled (ST221).

After the sheet has been guided to the second reversing inlet path 53 in ST212, the leading end of the sheet is detected by the second reversal sensor 24 (ST213). Then, after the lapse of a predetermined time, the CPU 60 starts forward rotation of a stepping motor (not shown) for driving the re-feed roller pair 35 (ST214), causing the sheet to be guided to the second reversing path 55 (ST215). When the second reversal sensor 24 detects the tailing end of the sheet (ST216), the CPU 60 switches over the flapper 44 so as to transport the sheet in the direction F (ST217), and substantially at the same time the CPU 60 starts backward rotation of the stepping motors (not shown) for driving the re-feed roller pairs 33, 34 and 35 (ST218). Further, at the same time, the CPU 60 switches over the flapper 42 so as to transport the sheet in the direction D, whereupon the sheet is transported to the duplex feed path 57 (ST231). At this time, the three-roller unit 36 has already rotated.

Face-down Sheet Ejection Mode in Single-Sided Copying

The operation in the face-down sheet ejection mode in single-sided copying will be described below with reference to FIG. 28. When a signal for carrying out the single-sided copying on a sheet, whose size is known in advance, is input to the copying machine, the CPU 60 executes a step of determining a failure in the sheet reversing path (ST10, see FIG. 26). Note that the timing of executing the failure determination is not limited to a period during the image forming operation.

Following the determination in ST10, it is first confirmed whether there is neither failure nor trouble in the first reversing inlet path 52 (ST301). If it is confirmed in ST301 that there is neither failure nor trouble in the first reversing inlet path 52, it is then confirmed whether there is neither failure nor trouble in the second reversing inlet path 53 (ST302). Also, if it is confirmed in ST301 that there is a failure or trouble in the first reversing inlet path 52, it is likewise confirmed whether there is neither failure nor trouble in the second reversing inlet path 53 (ST331).

Figure 28B:
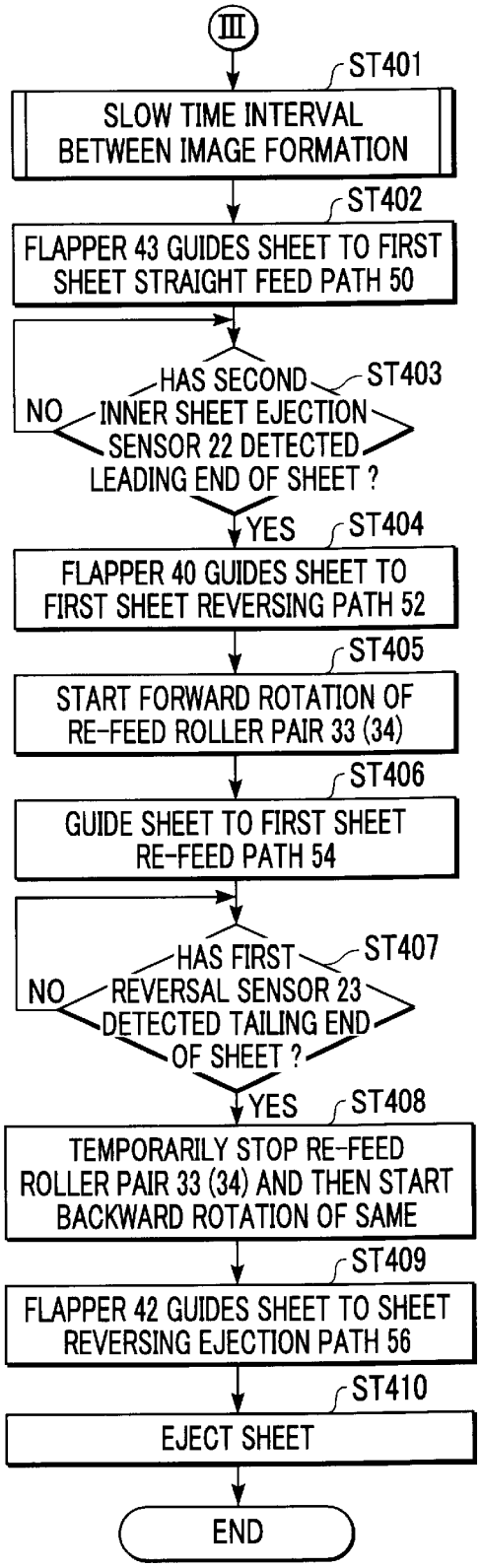
Figure 28C:
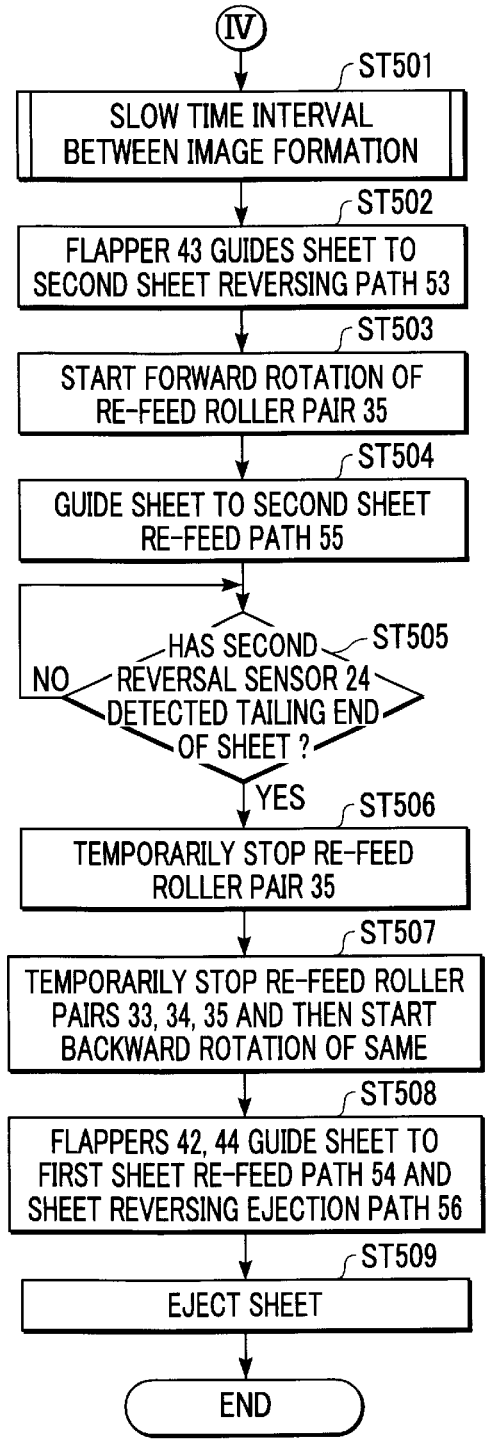

If it is confirmed in ST302 that there is neither failure nor trouble in the second reversing inlet path 53, this is interpreted to mean that there is neither failure nor trouble in both the first reversing inlet path 52 and the second reversing inlet path 53. Then, the control flow proceeds to ST303 to continue the face-down ejection. If it is confirmed in ST302 that there is a failure or trouble in the second reversing inlet path 53, this is interpreted to mean that there is neither failure nor trouble only in the first reversing inlet path 52. Then, the control flow proceeds to (III: FIG. 28B) to continue the face-down ejection from ST401. If it is confirmed in ST331 that there is neither failure nor trouble in the second reversing inlet path 53, this is interpreted to mean that there is neither failure nor trouble only in the second reversing inlet path 53. Then, the control flow proceeds to (IV: FIG. 28C) to continue the face-down ejection from ST501. If it is confirmed in ST331 that there is a failure or trouble in the second reversing inlet path 53, this is interpreted to mean that there is a failure or trouble in both the first reversing inlet path 52 and the second reversing inlet path 53. Then, the image forming process is suspended based on the determination that the duplex copying and the face-down ejection are disabled (ST341).

When the leading end of the sheet is detected by the first inner sheet ejection sensor 21 in ST303, the CPU 60 determines whether the relevant sheet is one at an odd-number page in the successively transported sheets (head sheet is an odd sheet) (ST304). If the relevant sheet is an odd one, the CPU 60 switches over the flapper 43 so as to transport the sheet in the direction A at once, whereupon the sheet is guided to the sheet straight feed path 50 (ST305). When the leading end of the odd sheet is detected by the second inner sheet ejection sensor 22 (ST306), the CPU 60 switches over the flapper 40 so as to transport the sheet in the direction B, whereupon the odd sheet is guided to the first reversing inlet path 52 (ST307). On the other hand, if it is determined in ST304 that the relevant sheet is an even one, the CPU 60 switches over the flapper 43 so as to transport the sheet in the direction E at once, whereupon the even sheet is guided to the second reversing inlet path 53 (ST321).

After the lapse of a predetermined time, the CPU 60 starts forward rotation of the stepping motor (not shown) for driving the re-feed roller pair 33 (including the re-feed roller pair 34 depending on the sheet size) (ST308). The three-roller unit 36 is already rotated at this time, and the odd sheet is guided to the first reversing path 54 (ST309). For the even sheet, the CPU 60 starts forward rotation of the stepping motor (not shown) for driving the re-feed roller pair 35 (ST322), whereby the even sheet is guided to the second reversing path 55 (ST323).

Substantially at the same time as when the first reversal sensor 23 detects the tailing end of the odd sheet (ST310), the CPU 60 starts backward rotation of the stepping motor (not shown) for driving the re-feed roller pair 33 (including the re-feed roller pair 34 depending on the sheet size) (ST311). Further, at the same time, the CPU 60 switches over the flapper 42 so as to transport the sheet in the direction C, whereupon the odd sheet is transported to the sheet reversing ejection path 56 (ST312). The elastic member provided in the three-roller unit 36 guides the sheet to be directed toward one of the sheet reversing ejection path 56 and the duplex feed path 57. For the even sheet, when the second reversal sensor 24 detects the tailing end of the even sheet (ST324), the CPU 60 temporarily stops the stepping motor (not shown) for driving the re-feed roller pair 35 (ST325).

Subsequently, it is determined whether the even sheet has hit the odd sheet (ST326). At the same time, the CPU 60 starts backward rotation of the stepping motors (not shown) for driving the re-feed roller pairs 34, 35 (ST327), and switches over the flapper 44 so as to transport the sheet in the direction F (ST328). Since the flapper 42 is already switched over for the odd sheet so as to transport the sheet in the direction C, the even sheet is transported to the sheet reversing ejection path 56 through the first reversing path 54. Thereafter, each sheet is ejected onto the sheet ejection tray 37 outside the copying machine body by the outer sheet ejection roller pair 26 in a state in which the image formed surface of the sheet faces up (ST313). Thus, the sheets successively transported in the face-down sheet ejection mode are ejected in sequence while passing the first reversing inlet path 52 and the second reversing inlet path 53 alternately in accordance with the flowchart described above.

If it is confirmed in ST302 that there is a failure or trouble in the second reversing inlet path 53, this is interpreted to mean that there is neither failure nor trouble only in the first reversing inlet path 52. In ST401, therefore, the productivity of the image formation is reduced to slow an interval time between the image formations and to increase the sheet interval (FIG. 28B). Subsequently, the CPU 60 switches over the flapper 43 so as to transport the sheet in the direction A, whereupon the sheet is guided to the sheet straight feed path 50 (ST402). When the leading end of the sheet is detected by the second inner sheet ejection sensor 22 (ST403), the CPU 60 switches over the flapper 40 so as to transport the sheet in the direction B, whereupon the sheet is guided to the first reversing inlet path 52 (ST404).

After the lapse of a predetermined time, the CPU 60 starts forward rotation of the stepping motor (not shown) for driving the re-feed roller pair 33 (including the re-feed roller pair 34 depending on the sheet size) (ST405). The three-roller unit 36 is already rotated at this time, and the sheet is guided to the first reversing path 54 (ST406).

Substantially at the same time as when the first reversal sensor 23 detects the tailing end of the sheet (ST407), the CPU 60 starts backward rotation of the stepping motor (not shown) for driving the re-feed roller pair 33 (including the re-feed roller pair 34 depending on the sheet size) (ST408). Further, at the same time, the CPU 60 switches over the flapper 42 so as to transport the sheet in the direction C, whereupon the sheet is transported to the sheet reversing ejection path 56 (ST409). The elastic member provided in the three-roller unit 36 guides the sheet to be directed toward one of the sheet reversing ejection path 56 and the duplex feed path 57. Thereafter, the sheet is ejected onto the sheet ejection tray 37 outside the copying machine body by the outer sheet ejection roller pair 26 in a state in which the image formed surface of the sheet faces down (ST410).

If it is confirmed in ST331 that there is neither failure nor trouble in the second reversing inlet path 53, this is interpreted to mean that there is neither failure nor trouble only in the second reversing inlet path 53. In ST501, therefore, the productivity of the image formation is reduced to slow an interval time between the image formations and to increase the sheet interval (FIG. 28C). Subsequently, the CPU 60 switches over the flapper 43 so as to transport the sheet in the direction E (ST502). After the lapse of a predetermined time, the CPU 60 starts forward rotation of the stepping motor (not shown) for driving the re-feed roller pair 35 (ST503), whereupon the sheet is guided to the second reversing path 55 (ST504).

Then, when the second reversal sensor 24 detects the tailing end of the sheet (ST505), the CPU 60 temporarily stops the stepping motor (not shown) for driving the re-feed roller pair 35 (ST506). Subsequently, the CPU 60 starts backward rotation of the stepping motors (not shown) for driving the re-feed roller pairs 33, 34 and 35 (ST507), and switches over the flapper 44 so as to transport the sheet in the direction F and the flapper 42 so as to transport the sheet in the direction C. Hence, the sheet is transported in a reversed state to the sheet reversing ejection path 56 through the first reversing path 54 (ST508). Thereafter, the sheet is ejected onto the sheet ejection tray 37 outside the copying machine body by the outer sheet ejection roller pair 26 in a state in which the image formed surface of the sheet faces down (ST509).

Failure Determination on Sheet Reversing Path)

Figure 29:
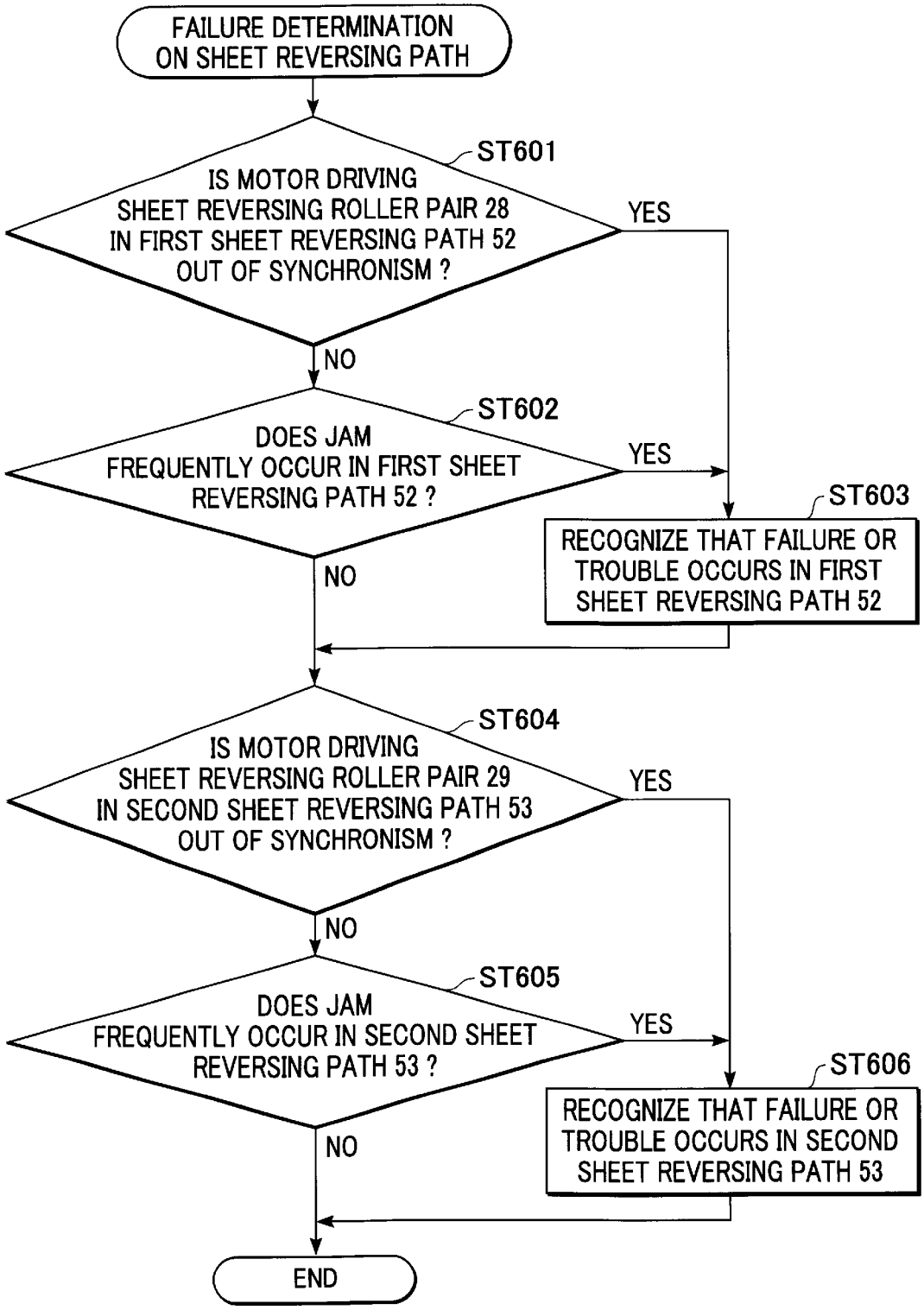
FIG. 29 is a flowchart, continued from FIG. 26, showing failure determination on a sheet reversing path in the image forming apparatus of FIG. 24.

The failure determination on the sheet reversing path will be described below with reference to FIG. 29. Note that the timing of executing the failure determination is not limited to a period during the image forming operation.

Upon the start of control for the failure determination on the sheet reversing path, it is first determined whether a motor driving the sheet reversing roller pair 28 in the first reversing inlet path 52 is out of synchronism (ST601). This determination can be made by memorizing the occurrence of out-of-synchronism based on the image forming operation in the past. As an alternative, the motor may be actually driven to make determination on out-of-synchronism. If it is determined in ST601 that the motor is out of synchronism, the control flow proceeds to ST603 to recognize that a failure or trouble occurs in the first reversing inlet path 52. If it is determined in ST601 that the motor is not out of synchronism, it is determined in ST602 whether a jam frequently occurs in the first reversing inlet path 52. If so, the control flow also proceeds to ST603 to confirm that a failure or trouble occurs in the first reversing inlet path 52. The determination on the frequent occurrence of a jam can be made based on the fact that the number of jams has exceeded a preset limit value. As an alternative, the determination may be made based on a rate of jam frequency within a certain period.

The failure determination on the second reversing inlet path 53 is likewise performed by confirming the out-of-synchronism of the associated motor and the frequent occurrence of a jam (ST604, ST605). Then, based on the determination result, the occurrence of a failure or trouble is recognized (ST606).

A series of control flow in the face-down sheet ejection mode when there is neither failure nor trouble in both the first reversing inlet path 52 and the second reversing inlet path 53, will be described below with reference to schematic operational views of FIGS. 30A to 30G.

Figure 30A:
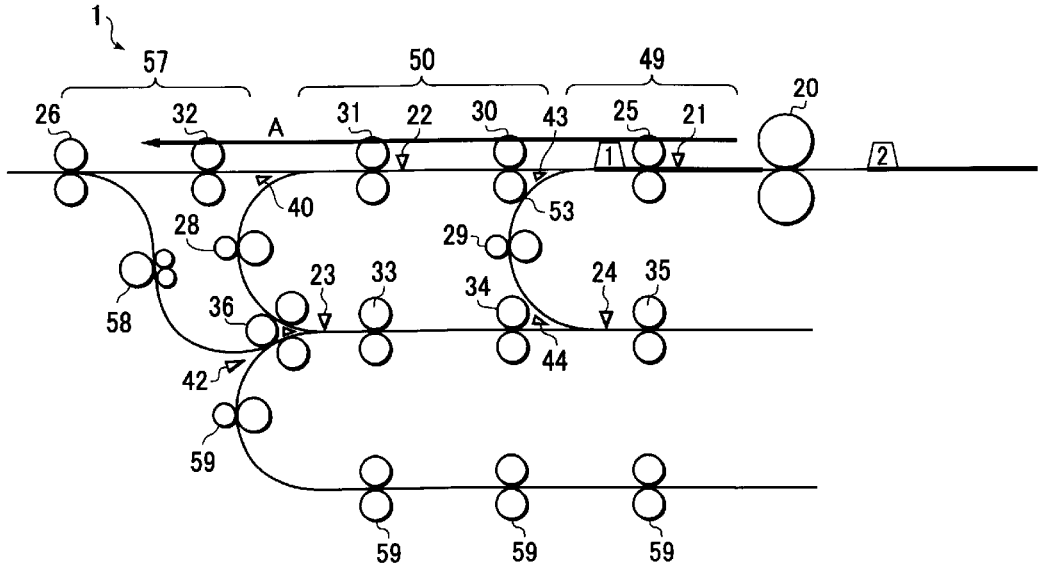
FIGS. 30A to 30G are schematic views showing a series of process flow for sheet feed control in the face-down sheet ejection mode in the image forming apparatus of FIG. 24 when the apparatus is free from failures and troubles.

First, as shown in FIG. 30A, sheets, each of which is subjected to the fusing of the toner image by the fusing unit 20, are successively transported at a predetermined sheet interval. When the leading end of a sheet 1 at an odd page in total sheet order, i.e., a head sheet, is detected by the first inner sheet ejection sensor 21, the CPU 60 switches over the flapper 43 so as to transport the sheet in the direction A because the sheet 1 is an odd one, whereupon the sheet 1 is guided to the sheet straight feed path 50. A sheet 2 at an even page in total sheet order is transported after the sheet 1 at the predetermined sheet interval.

Figure 30B:
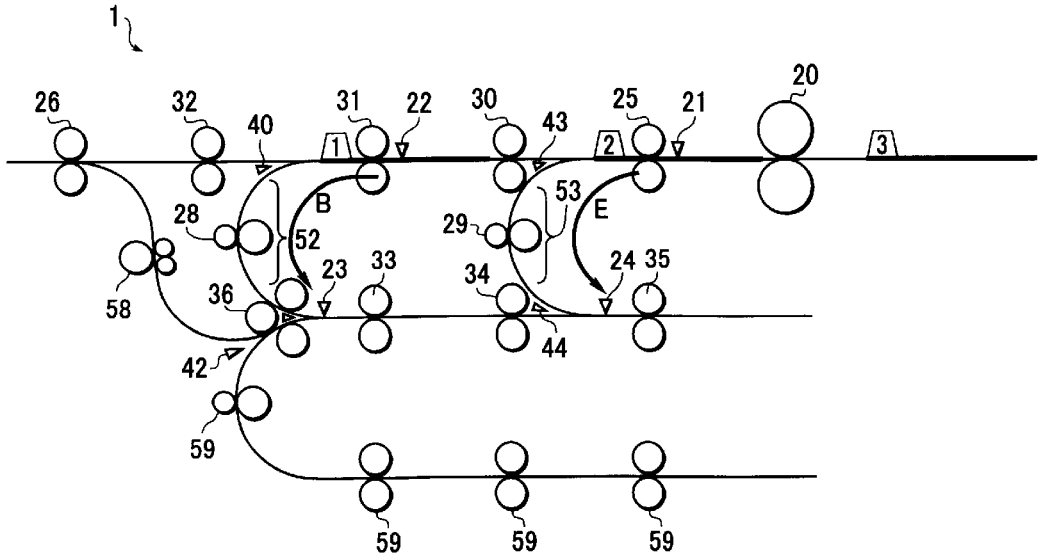

Then, as shown in FIG. 30B, when the leading end of the sheet 1 is detected by the second inner sheet ejection sensor 22, the CPU 60 switches over the flapper 40 so as to transport the sheet in the direction B, whereupon the sheet 1 is guided to the first reversing inlet path 52. Also, when the leading end of the even sheet 2 is detected by the first inner sheet ejection sensor 21, the CPU 60 switches over the flapper 43 so as to transport the sheet in the direction E because the sheet 2 is an even one, whereupon the sheet 2 is guided to the second reversing inlet path 53. A sheet 3 is transported after the sheet 2 at the predetermined sheet interval. Thus, of subsequent sheets, an odd sheet is guided to the first reversing inlet path 52 as with the sheet 1 and an even sheet is guided to the second reversing inlet path 53 as with the sheet 2 in sequence.

Figure 30C:
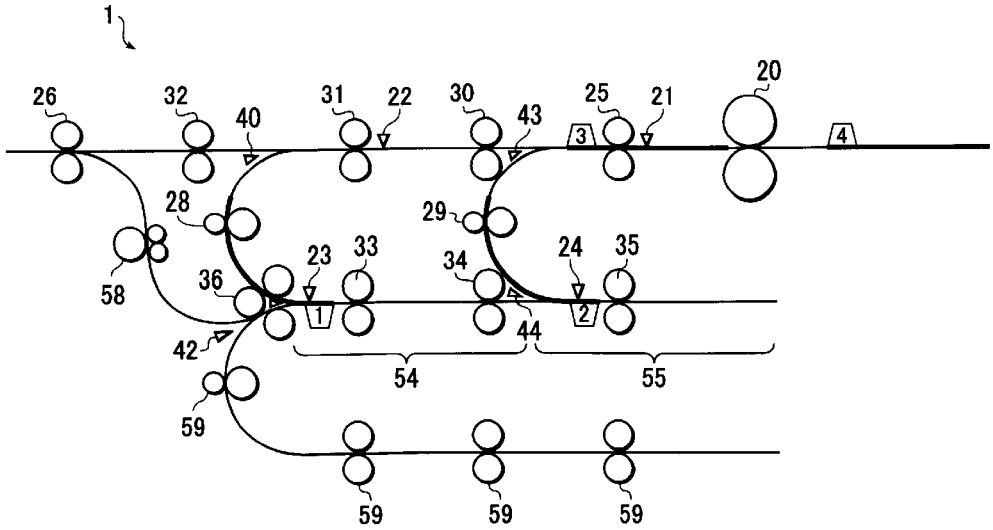

Then, as shown in FIG. 30C, after the lapse of a predetermined time, the CPU 60 starts forward rotation of the stepping motors (not shown) for driving the re-feed roller pairs 33, 35 to be ready for guiding the sheet 1 to the first reversing path (first sheet re-feed path) 54. At this time, the three-roller unit 36 is already rotated.

Figure 30D:
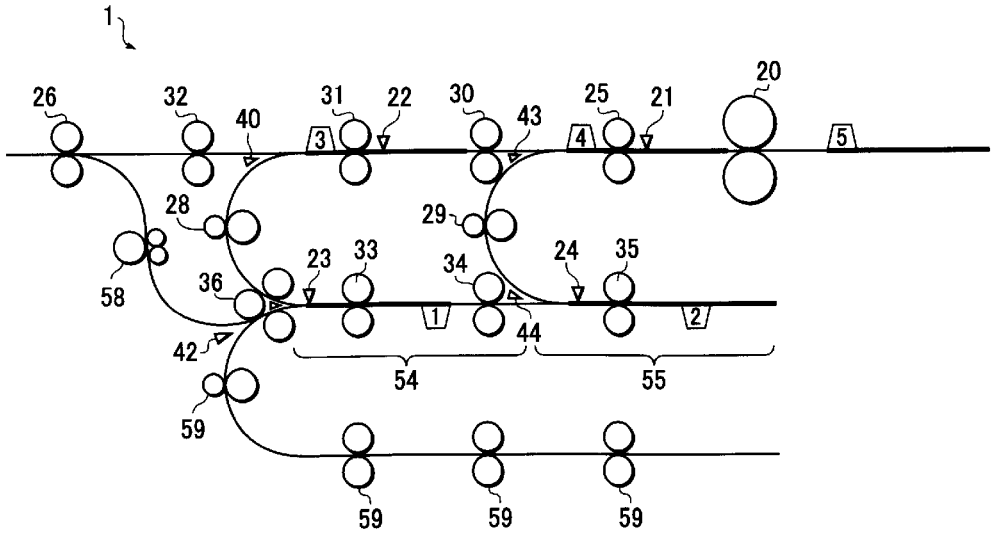

Thereafter, as shown in FIG. 30D, when the first reversal sensor 23 detects the tailing end of the sheet 1, the CPU 60 temporarily stops the stepping motor for driving the re-feed roller pair 33 so that the sheet 1 is stopped in the first reversing path 54. Likewise, when the second reversal sensor 24 detects the tailing end of the sheet 2, the CPU 60 temporarily stops the stepping motor for driving the re-feed roller pair 35 so that the sheet 2 is stopped in the second reversing path 55.

Figure 30E:
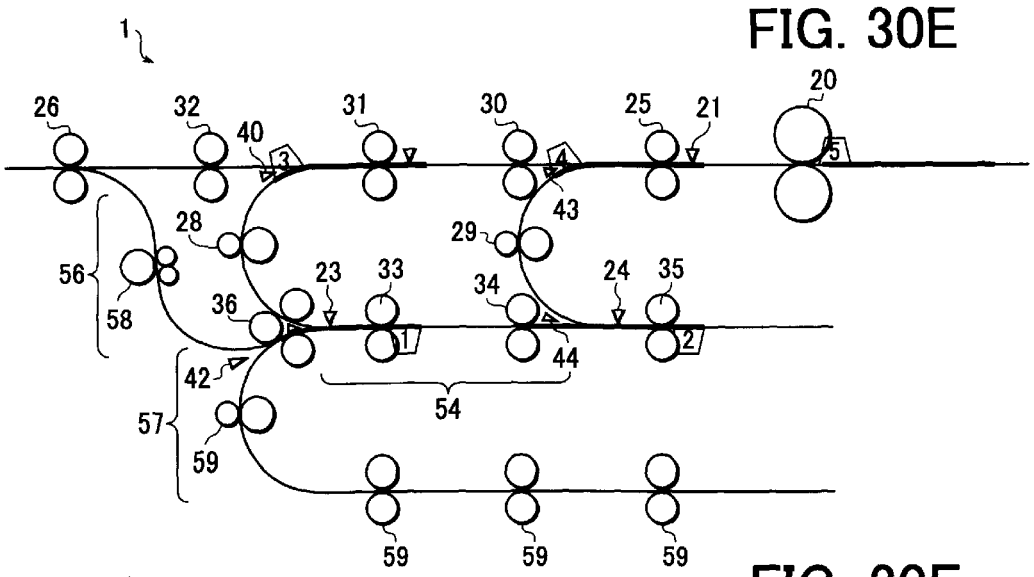

After the sheet 1 has been temporarily stopped in FIG. 30D, the CPU 60 starts backward rotation of the stepping motor for driving the re-feed roller pair 33 at once, whereupon the sheet 1 is transported to the sheet reversing ejection path 56, as shown in FIG. 30E. At this time, the elastic member provided in the three-roller unit 36 guides the sheet to be directed toward the junction point of the sheet reversing ejection path 56 and the duplex feed path 57. On the other hand, after the sheet 2 has been temporarily stopped, whether the sheet 2 does hit the sheet 1, i.e., the preceding sheet, is determined prior to starting backward transport of the sheet 2. If it is determined that the sheet 2 does not hit the sheet 1, the CPU 60 starts backward rotation of the stepping motors (not shown) for driving the re-feed roller pairs 34, 35, and at the same time switches over the flapper 44 so as to transport the sheet in the direction C, whereupon the sheet 2 is guided to the sheet reversing ejection path 56. At this time, the flapper 42 for selectively guiding the sheet to one of the sheet reversing ejection path 56 and the duplex feed path 57 is already switched over so as to transport the sheet the sheet reversing ejection path 56.

Figure 30F:
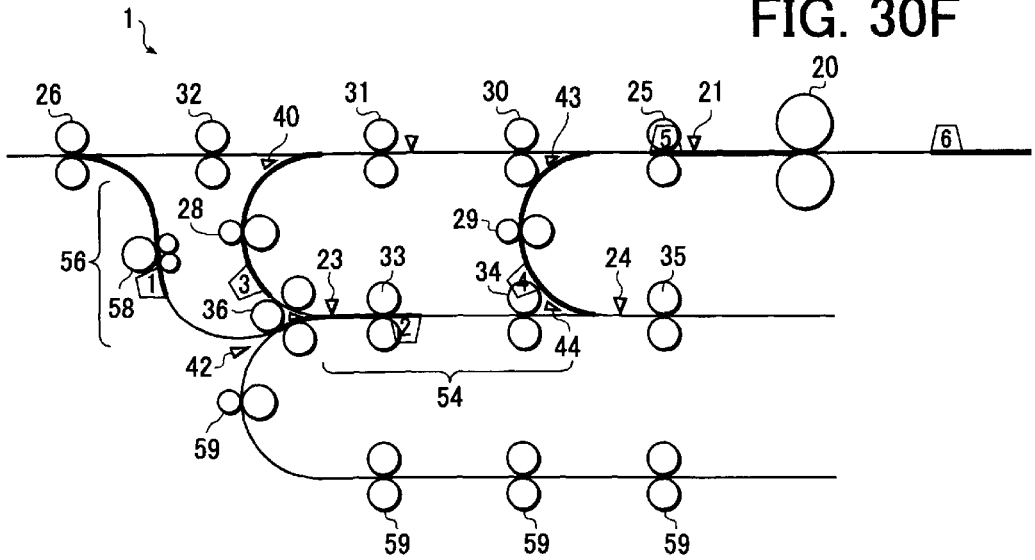

Then, as shown in FIG. 30F, the sheet 1 is transported through the sheet reversing ejection path 56 in the ejection direction, and the sheet 2 is guided to the sheet reversing ejection path 56 through the first reversing path 54 after the sheet 1. On the other hand, before the leading end of the sheet 3 bites into the three-roller unit 36, the timing of finishing the use of the re-feed roller pair 33 for the sheet 2 is compared with the timing of starting the use of the re-feed roller pair 33 for the sheet 3. If it is determined that the timing of starting the use of the re-feed roller pair 33 for the sheet 3 is earlier, the sheet 3 is temporarily stopped to stand by before the three-roller unit 36. After repeating the comparison between the timing of finishing the use of the re-feed roller pair 33 for the sheet 2 and the timing of starting the use of the re-feed roller pair 33 for the sheet 3, if it is determined that the timing of starting the use of the re-feed roller pair 33 for the sheet 3 is later, the transport of the sheet 3 is resumed. The three-roller unit 36 is of a structure allowing the sheet 3 transported toward the first reversing path 54 and the sheet 2 transported toward the sheet reversing ejection path 56 to pass each other in the opposite directions.

Figure 30G:
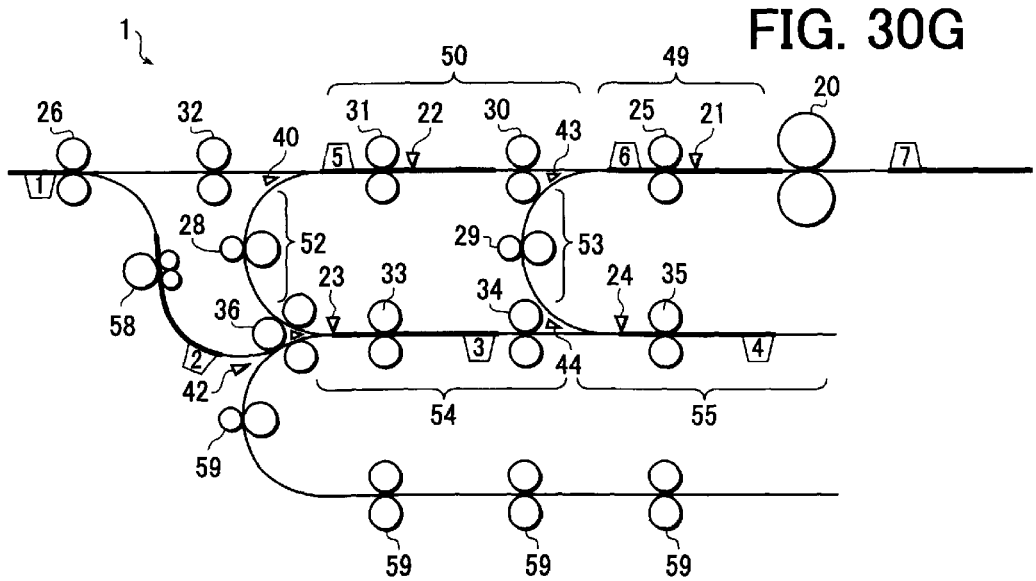

Then, as shown in FIG. 30G, the sheets 1 and 2 are continuously transported in the ejection direction. The sheet 3 is transported to the first reversing path 54 while passing by the sheet 2 in the opposed direction, and a sheet 4 is guided to the second reversing path 55, respectively, in a similar manner to the preceding odd and even sheets. Subsequent sheets are successively transported to the respective reversing paths and then transported backward as with the sheets 1 and 2 in sequence, whereby the face-down ejection mode is continuously performed.

The sheet straight feed path 50, the first reversing inlet path 52, the second reversing inlet path 53, the first reversing path 54, and the second reversing path 55 are each formed to have a feed path length greater than the sheet size. With such an arrangement, if it is determined that the feed of the preceding sheet is delayed or that the sheet interval is reduced because of earlier arrival of the relevant sheet, the relevant sheet can be held on standby in each feed path so as to absorb variations in feed of the preceding sheet.

A series of control flow in the face-down sheet ejection mode when there is neither failure nor trouble in the first reversing inlet path 52, but there is a failure or trouble in the second reversing inlet path 53, will be described below with reference to schematic operational views of FIGS. 31A to 31G.

Figure 31A:
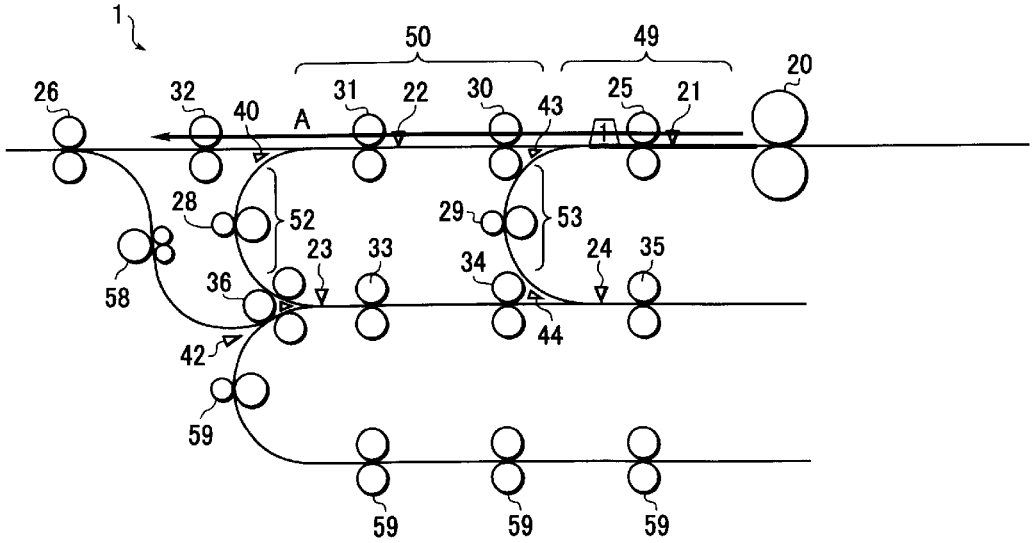
FIGS. 31A to 31G are schematic views showing a series of process flow for sheet feed control in the face-down sheet ejection mode in the image forming apparatus of FIG. 24 when a failure or a trouble has occurred in a second reversing inlet path.

First, as shown in FIG. 31A, sheets, each of which is subjected to the fusing of the toner image, are successively transported at a greater sheet interval by reducing the productivity of the copying machine than the predetermined one set for the case in which there is neither failure nor trouble in both the first reversing inlet path 52 and the second reversing inlet path 53, because it is recognized from the failure determination on the sheet reversing path that a failure or trouble occurs in the second reversing inlet path 53. When the leading end of a sheet 1, i.e., a head sheet, is detected by the first inner sheet ejection sensor 21, the CPU 60 switches over the flapper 43 so as to transport the sheet in the direction A, whereupon the sheet 1 is guided to the sheet straight feed path 50.

The reason why the sheet interval must be increased when sheets are all reversed using only one sheet reversing path, is as follows. The sheets are drawn one by one from the sheet reversing inlet path into the sheet reversing path. After stopping the drawn sheet in the sheet reversing path, it is transported backward through the sheet reversing path, and then guided to the sheet reversing ejection path 56 or the duplex feed path 57. Before starting to draw the next sheet, therefore, the process of reversing the preceding sheet in the sheet reversing inlet path to the sheet reversing path must have been finished to be ready for drawing the next sheet. Correspondingly, the sheet interval must be increased in comparison with that required in the case of reversing sheets using two sheet reversing paths.

More particularly, when a sheet is reversed using the first reversing inlet path 52, the sheet interval can be reduced to some extent because the three-roller unit 36 allows a preceding sheet and a succeeding sheet to pass each other in the opposite directions. However, because a preceding sheet and a succeeding sheet are not allowed to pass each other in the opposite directions when using the second reversing inlet path 53, the succeeding cannot be drawn into the second sheet reversing path 55 before the preceding sheet has completely passed the junction point of the second reversing inlet path 53 and the second reversing path. This raises the necessity of increasing the sheet interval.

Figure 31B:
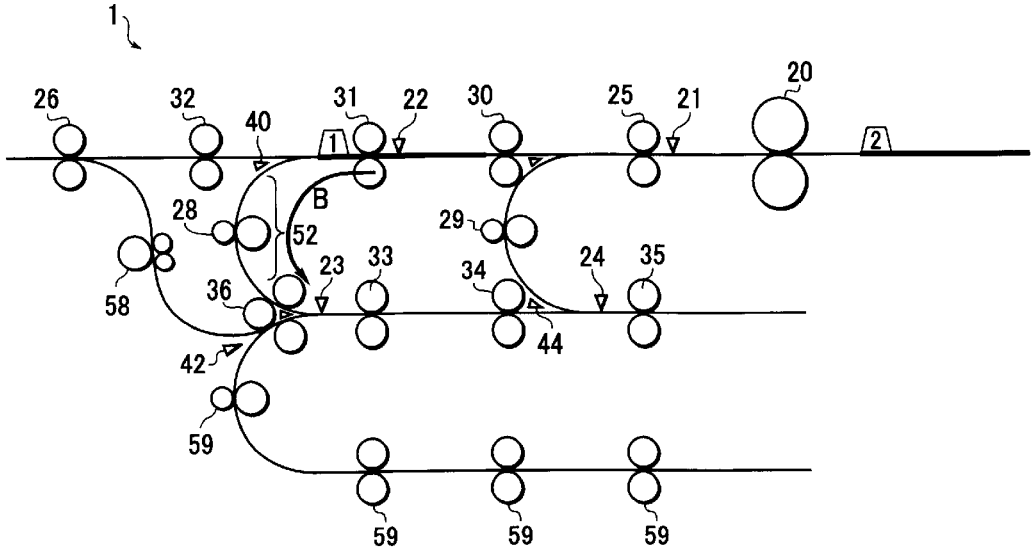

Subsequently, as shown in FIG. 31B, when the leading end of the sheet 1 is detected by the second inner sheet ejection sensor 22, the CPU 60 switches over the flapper 40 so as to transport the sheet in the direction B, whereupon the sheet 1 is guided to the first reversing inlet path 52. Because of the result of the failure determination, the succeeding sheet 2 is transported after the sheet 1 at the sheet interval corresponding to the reduced productivity.

Figure 31C:
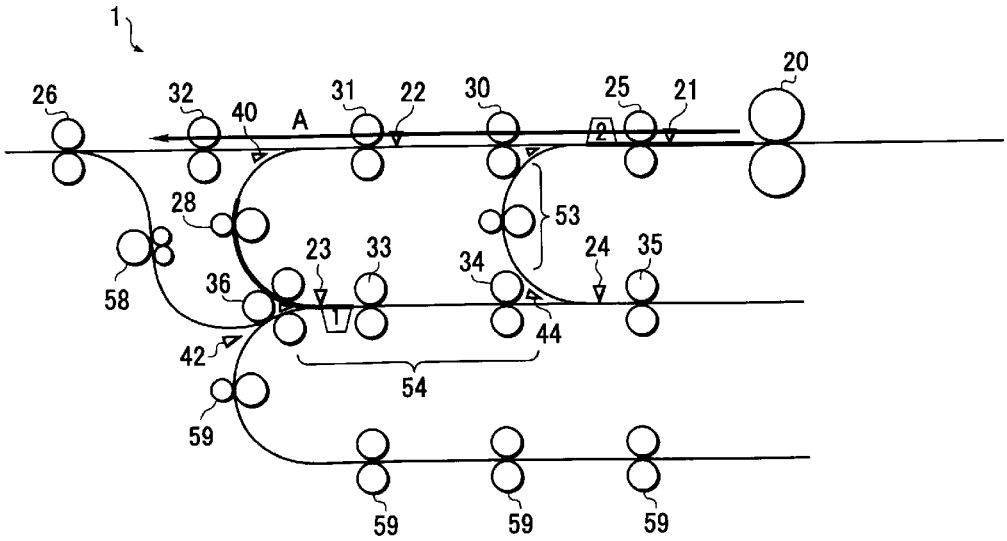

Then, as shown in FIG. 31C, after the lapse of a predetermined time, the CPU 60 starts forward rotation of the stepping motor (not shown) for driving the re-feed roller pair 33, whereupon the sheet 1 is transported to the first reversing path 54. Because it is determined that the second reversing inlet path 53 is disabled due to a failure, the sheet 2 is also transported in the direction A as with the sheet 1. At this time, the three-roller unit 36 is already rotated.

Figure 31D:
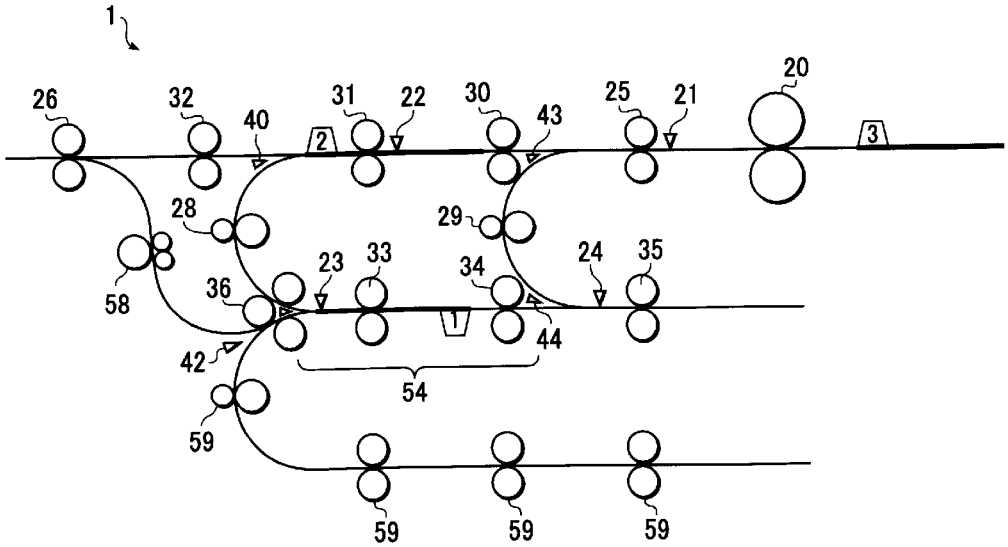

Thereafter, as shown in FIG. 31D, when the first reversal sensor 23 detects the tailing end of the sheet 1, the CPU 60 temporarily stops the stepping motor for driving the re-feed roller pair 33 so that the sheet 1 is stopped in the first reversing path 54. The sheet 2 is transported through the same feed rout as that for the sheet 1.

Figure 31E:
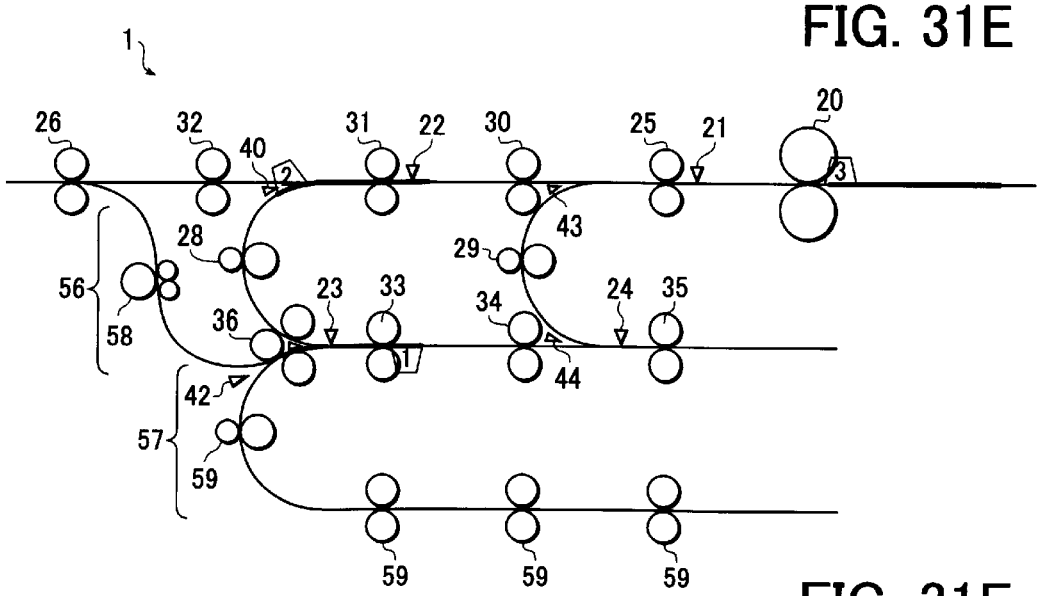

After the sheet 1 has been temporarily stopped in FIG. 31D, the CPU 60 starts backward rotation of the stepping motor for driving the re-feed roller pair 33 at once and switches over the flapper 42 so as to transport the sheet in the direction toward the sheet reversing ejection path 56, whereupon the sheet 1 is transported to the sheet reversing ejection path 56, as shown in FIG. 31E. At this time, the elastic member provided in the three-roller unit 36 guides the sheet to be directed toward the junction point of the sheet reversing ejection path 56 and the duplex feed path 57. The sheet 2 is likewise transported. Furthermore, a sheet 3 is transported at the sheet interval corresponding to the reduced productivity as with the sheet 2.

Figure 31F:
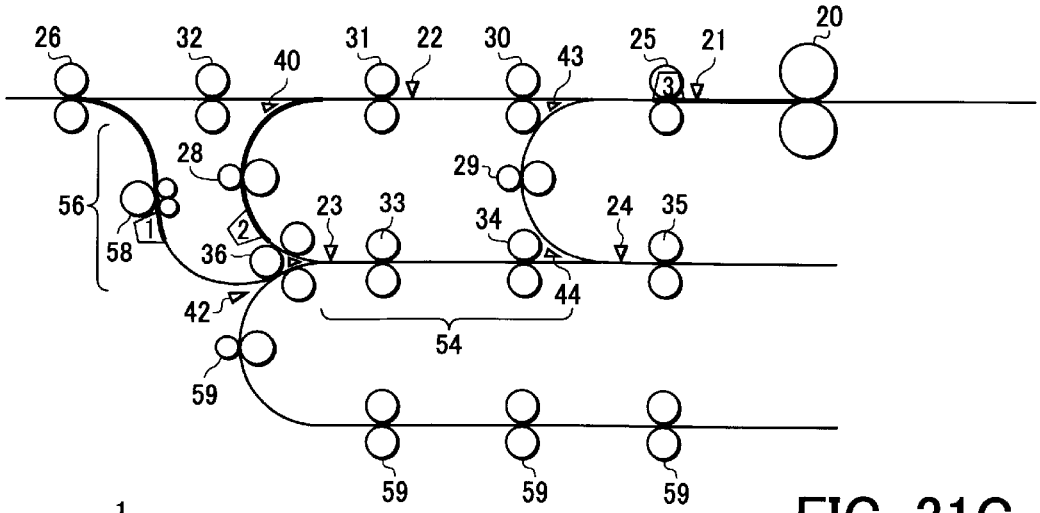

Then, as shown in FIG. 31F, the sheet 1 is transported through the sheet reversing ejection path 56 in the ejection direction, and the sheet 2 is guided to the first reversing path 54 after the sheet 1. The sheet 3 is transported through the same feed rout as that for the preceding sheet.

Figure 31G:
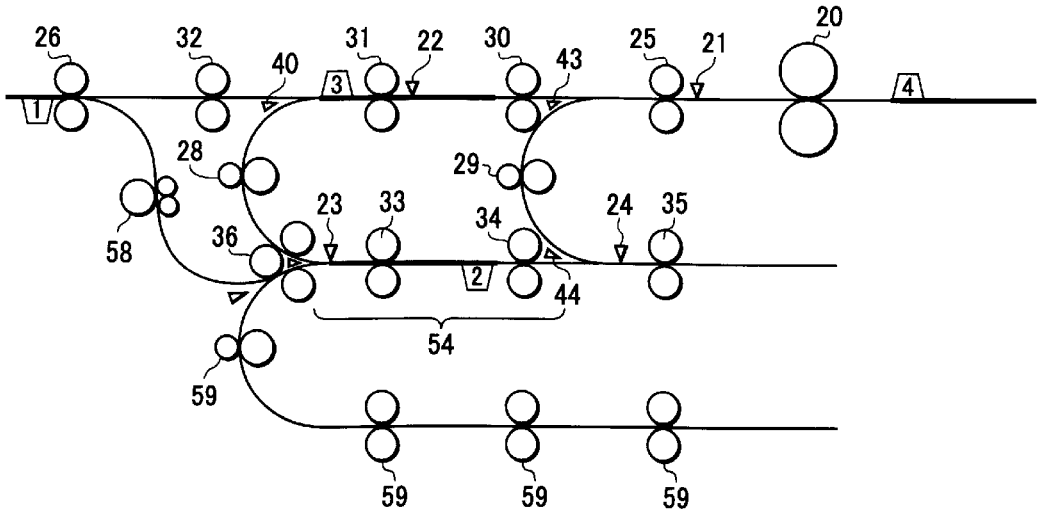

Then, as shown in FIG. 31G, the sheet 1 is continuously transported in the ejection direction, the sheet 2 is transported to the first reversing path 54, and the sheet 3 is transported through the same feed rout as that for the preceding sheet. Thus, subsequent sheets are successively transported to the first reversing path and then transported backward as with the sheets 1 and 2, whereby the face-down ejection mode is continuously performed.

Fifth Embodiment

In a fifth embodiment of the present invention, first and second sheet jam detecting units S1, S2 (shown in FIG. 25) for detecting a sheet jam are disposed in the first reversing inlet path 52 and the second reversing inlet path 53, respectively, to directly detect an operation failure. The remaining arrangement is the same as that in the embodiments described above.

In the above-described basic operation of the face-down sheet ejection mode in single-sided copying and of the duplex copying mode, the sheet transported from the inner sheet ejection roller pair 25 is selectively advanced in the direction B (toward the first reversing inlet path 52) or in the direction E (toward the second reversing inlet path 53) under control of the CPU 60.

When a jam of the sheet is detected by the first sheet jam detecting unit Si in the first reversing inlet path 52, the CPU 60 controls the flapper 43 to be operated such that the sheet is transported only in the direction E. As a result, the face-down sheet ejection mode in single-sided copying and the duplex copying mode are performed using only the second reversing inlet path 53.

When a jam of the sheet is detected by the second sheet jam detecting unit S2 in the second reversing inlet path 53, the CPU 60 controls the flapper 43 to be operated such that the sheet is transported only in the direction A. As a result, the face-down sheet ejection mode in single-sided copying and the duplex copying mode are performed using only the first reversing inlet path 52.

The first reversing inlet path 52 and the second reversing inlet path 53 are each of a structure capable of drawing it from the front side of the image forming apparatus even during the operation of the apparatus unless the relevant reversing inlet path is operated. Even if a jam occurs in one reversing inlet path, the apparatus can continue the operation using the other reversing inlet path. Accordingly, the sheet jammed in the reversing inlet path can be removed without interrupting the apparatus operation.

When the reversing inlet path restored from the jam is inserted in the apparatus and the associated jam detecting unit detects the absence of a jam, the CPU 60 control sheets to be transported through both the first reversing inlet path 52 and the second reversing inlet path 53 in the same manner as that prior to the occurrence of a jam.

With a sheet feed mechanism constructed as described above, in the face-down sheet ejection mode in single-sided copying and the duplex copying mode, when the sheet jam detecting unit in one reversing inlet path detects a jam, the apparatus operation is prevented from being stopped by feeding sheets through the other reversing inlet path in which a jam does not occur. Also, by removing the jammed sheet during the apparatus operation, restoring the apparatus to a normal condition, and then operating the apparatus in the same way as that before the occurrence of jam, the jam eliminating process can be realized without stopping the apparatus at all.

The present invention is not limited to the above-described embodiment. For example, while a stepping motor is employed as the driving source for the duplex feed in the above-described embodiment, a clutch may be used instead. Also, while productivity is improved in the above-described embodiment without speed-up control in the reversing process to suppress an increase of the motor cost, it is possible to further improve productivity with the speed-up control. Thus, the sheet transport speed in the reversing and duplex sections is not limited to a constant speed, but may be freely set.

Additionally, in the above-described embodiment, when a sheet is transported backward after passing the position at which the sheet is reversed, the CPU 60 controls the sheet to be transported backward when the tailing end of the sheet is detected by the first reversal sensor 23 or the second reversal sensor 24. However, the backward transport of the sheet may be started on an assumption that the tailing end of the sheet reaches the reversal position after a predetermined time from the timing at which the leading end of the sheet has been detected by the first inner sheet ejection sensor 21 or the second inner sheet ejection sensor 22. This modification is effective in reducing the number of parts and hence cutting the cost.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

an image forming section;

a plurality of reversing means each for reversing a sheet having an image formed thereon by said image forming section; and control means for controlling said plurality of reversing means so that when one of the plurality of reversing means is unusable, a sheet feed operation continues using reversing means which are usable.

2. An image forming apparatus according to claim 1, further comprising re-feed means for feeding, again to the image forming section, the sheet having the image formed thereon by the image forming section, wherein each of said plurality of reversing means are connected to said re-feed means.

3. An image forming apparatus according to claim 1, further comprising a sheet reversing ejection path for ejecting the sheet having the image formed thereon by the image forming section, wherein said plurality of reversing means are connected to said sheet reversing ejection path.

4. An image forming apparatus according to claim 1, wherein said control means controls said plurality of reversing means so as to output again a sheet corresponding to a sheet at a certain position in total page order, which has caused one of the reversing means to be unusable.

5. An image forming apparatus according to claim 4, further comprising proper page order combining means for putting, in proper page order, the sheet having been output again when the sheet feed operation is continued by said control means.

6. An image forming apparatus according to claim 1, wherein said control means controls the plurality of reversing means to be used in sequence for successively feeding sheets when all of the plurality of reversing means are usable.

7. An image forming apparatus in which a sheet having an image formed on one side by an image forming section is re-fed to the image forming section to form an image on an other side of the sheet, the apparatus comprising:

a reversing feed path for reversing the sheet;

a re-feed path for re-feeding the sheet having been reversed in the reversing feed path to the image forming section;

a reversing inlet feed path for transporting, to the reversing feed path, the sheet having the image formed on one side by the image forming section;

a plurality of reversing outlet feed paths branched from the reversing feed path at plural points and for transporting, to the re-feed path, the sheets having been transported to the reversing feed path; and control means for controlling said plurality of reversing outlet feed paths so that when one of the plurality of reversing outlet feed paths is unusable, a sheet feed operation continues by using reversing outlet feed paths which are usable.

8. An image forming apparatus according to claim 7, wherein the reversing inlet feed path is provided in plural and the respective reversing inlet feed paths join with the reversing feed path at plural points.

9. An image forming apparatus in which a sheet having an image formed on one side by an image forming section is re-fed to the image forming section to form an image on an other side of the sheet, the apparatus comprising:

a reversing feed path for reversing the sheet;

a re-feed path for re-feeding the sheet having been reversed in the reversing feed path to the image forming section;

a plurality of reversing inlet feed paths joining with the reversing feed path at plural points and transporting, to the reversing feed path, the sheets each having the image formed on one side by the image forming section;

a plurality of reversing outlet feed paths branched from the reversing feed path at plural points and for transporting, to the re-feed path, the sheets having been transported to the reversing feed path; and control means for controlling said plurality of reversing inlet feed paths so that when one of the plurality of reversing inlet feed paths is unusable, a sheet feed operation continues by using reversing inlet feed paths which are usable.

10. An image forming apparatus according to claim 9, wherein the control means controls said plurality of reversing inlet feed paths to output again a sheet corresponding to a sheet at a certain position in total page order, which has caused one of the reversing inlet feed paths to be unusable.

11. An image forming apparatus according to claim 10, further comprising proper page order combining means for putting, in proper page order, the sheet having been output again when the sheet feed operation is continued by the control means.

12. An image forming apparatus according to claim 11, wherein said proper page order combining means comprises a pair of sheet ejection trays and moving means for moving at least one sheet from sheets stacked on one of plural sheet ejection trays to another of the plural sheet ejection trays, and the sheet having been output again is inserted between the at least one sheet stacked on the one sheet ejection tray and sheets stacked on the other sheet ejection tray, whereby all the output sheets are put in proper page order.

13. An image forming apparatus according to claim 11, wherein said proper page order combining means includes a stack tray for temporarily receiving sheets transported to the reversing inlet feed path, the stack tray temporarily receiving sheets transported earlier with passing control than the sheet at a certain position in total page order, which has caused one of the reversing outlet feed paths to be unusable, and then sending out the received sheets in order after the sheet having been output again is transported to proceed beyond the stack tray, whereby all the output sheets are put in proper page order.

14. An image forming apparatus according to claim 9, wherein the control means controls the plurality of reversing outlet feed paths to be used in sequence for successively feeding sheets when the plurality of reversing outlet feed paths are normally usable.

15. An image forming apparatus according to claim 9, wherein the control means controls the plurality of reversing inlet feed paths to be used in sequence for successively feeding sheets when the plurality of reversing inlet feed paths are normally usable.

16. An image forming apparatus comprising:

main feed means for feeding a sheet having an image formed thereon by an image forming section;

first sheet switchback transport means and second sheet switchback transport means arranged side by side, for transporting the sheet fed from the main feed means to a downstream side when rotated forward, and then for transporting the sheet backward to an upstream side when rotated backward;

sheet switchback transport path selecting means for selectively advancing the sheet fed from the main feed means to the first sheet switchback transport means and the second sheet switchback transport means;

failure detecting means for detecting a failure in operation of at least one of the first sheet switchback transport means and the second sheet switchback transport means; and control means for controlling said first sheet switchback transport means and said second sheet switchback transport means so that when information indicating a failure in operation of one of the first sheet switchback transport means and the second sheet switchback transport means is recognized based on information from the failure detecting means, operation of the non-failed sheet switchback transport means continues.

17. An image forming apparatus according to claim 16, wherein the failure detecting means detects an operation failure by determining whether a motor provided in each of the first sheet switchback transport means and the second sheet switchback transport means for driving feed rollers is out of synchronism.

18. An image forming apparatus according to claim 16, wherein the failure detecting means detects an operation failure by determining whether a jam frequently occurs in each of the first sheet switchback transport means and the second sheet switchback transport means.

19. An image forming apparatus according to claim 16, wherein a sheet feed interval when transporting sheets backward using only one of the first sheet switchback transport means and the second sheet switchback transport means is greater than a sheet feed interval when transporting sheets backward using both the first and second sheet switchback transport means.

20. An image forming apparatus according to claim 16, wherein the first sheet switchback transport means and the second sheet switchback transport means include respectively a first reversing inlet path and a second reversing inlet path for reversing sheets, and a first sheet straight feed path connected to the first reversing inlet path and a second sheet straight feed path connected to the second reversing inlet path.

21. An image forming apparatus according to claim 16, wherein the first sheet switchback transport means and the second sheet switchback transport means are each movable to be drawn out of an apparatus body for eliminating a jam, the failure detecting means is sheet jam detecting means for detecting a sheet jam in each of the first sheet switchback transport means and the second sheet switchback transport means, and when the jam detecting means detects a jam in one of the first sheet switchback transport means and the second sheet switchback transport means, the sheet transport is continued using the other sheet switchback transport means while the one sheet switchback transport means in which a jam has been detected is drawn out of the apparatus body for eliminating the jam.

22. An image forming apparatus comprising:

a feed path arranged downstream of an image forming section and provided with feed rollers for transporting a sheet having an image formed thereon by the image forming section;

a plurality of reversing paths arranged substantially parallel to the feed path and provided with feed rollers for transporting sheets transported to the image forming section;

a plurality of reversing inlet paths arranged between the feed path and the reversing paths, and having a U-shape to guide sheets from the feed path to the reversing paths; and a control unit for controlling the reversing inlet paths so that when one of the plurality of reversing inlet paths is unusable, the sheet feed operation continues using a usable reversing inlet path.

23. An image forming apparatus comprising:

a feed path arranged downstream of an image forming section and provided with feed rollers for transporting a sheet having an image formed thereon by the image forming section;

a plurality of reversing paths arranged substantially parallel to the feed path and provided with feed rollers for transporting sheets to the image forming section;

a duplex feed path arranged substantially parallel to the reversing paths and provided with feed rollers for feeding the sheet having the image formed thereon again to the image forming section;

a plurality of reversing inlet paths arranged between the feed path and the reversing paths, and having a U-shape to guide sheets from the feed path to the reversing paths;

a plurality of reversing outlet paths arranged between the reversing paths and the duplex feed path, and having a U-shape to guide sheets from the reversing paths to the duplex feed path; and a control unit for controlling the plurality of reversing outlet paths so that when one reversing outlet path is unusable, the sheet feed operation continues using a usable reversing outlet path.

* * * * *

UNITED STATES PATENT AND TRADEMARK OFFICE

CERTIFICATE OF CORRECTION

PATENT NO. : 6,778,787 B2
DATED : August 17, 2004
INVENTOR(S) : Hidehiko Kinoshita et al.

It is certified that error appears in the above-identified patent and that said Letters Patent is hereby corrected as shown below:

Column 15,
Lines 61 and 64, “leafs” should read -- leaves --.

Column 33,
Line 32, “are” should read -- is --.

Signed and Sealed this

Twelfth Day of October, 2004

JON W. DUDAS
*Director of the United States Patent and Trademark Office*